US009951791B2

(12) United States Patent
Jung et al.

(10) Patent No.: US 9,951,791 B2
(45) Date of Patent: Apr. 24, 2018

(54) AIR CONDITIONER

(71) Applicant: SAMSUNG ELECTRONICS CO., LTD., Suwon-si, Gyeonggi-do (KR)

(72) Inventors: Chang-Woo Jung, Suwon-si (KR); Hyun Uk Park, Suwon-si (KR); Wan-Ku Kang, Uiwang-si (KR); Sung Hyun Chun, Suwon-si (KR); Chan Young Park, Suwon-si (KR); Jun Won Seo, Hwaseong-si (KR); Geon Hee Lee, Suwon-si (KR); Jin Baek Kim, Suwon-si (KR); Moon Sun Shin, Suwon-si (KR); Jun Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 347 days.

(21) Appl. No.: 14/814,753

(22) Filed: Jul. 31, 2015

(65) Prior Publication Data

US 2016/0032942 A1 Feb. 4, 2016

(30) Foreign Application Priority Data

Aug. 4, 2014 (KR) ..... 10-2014-0099907
Dec. 4, 2014 (KR) ..... 10-2014-0173204

(51) Int. Cl.

| | |
|---|---|
| ***F04D 29/56*** | (2006.01) |
| ***F04D 29/70*** | (2006.01) |
| ***F04D 27/00*** | (2006.01) |
| ***F04D 19/00*** | (2006.01) |
| ***F04D 25/10*** | (2006.01) |

(52) U.S. Cl.
CPC ..... *F04D 29/563* (2013.01); *F04D 19/002* (2013.01); *F04D 25/10* (2013.01); *F04D 27/002* (2013.01); *F04D 29/703* (2013.01)

(58) Field of Classification Search
CPC ..... F24F 13/08; F24F 13/081; F24F 13/082; F04D 29/563; F04D 19/002
See application file for complete search history.

(56) References Cited

FOREIGN PATENT DOCUMENTS

| | | | | |
|---|---|---|---|---|
| EP | 0477612 | A2 * | 4/1992 | ..... F24F 1/0007 |
| JP | 2009-162439 | A | 7/2009 | |
| KR | 10-2003-0075552 | A | 9/2003 | |
| KR | 10-1346834 | B1 | 1/2014 | |
| KR | 10-2014-0012437 | A | 2/2014 | |
| KR | 10-2014-0049101 | A | 4/2014 | |

OTHER PUBLICATIONS

International Search Report dated Nov. 27, 2015 issued in corresponding International Patent Application PCT/KR2015/008108.

* cited by examiner

*Primary Examiner* — Richard Edgar
*Assistant Examiner* — John S Hunter
(74) *Attorney, Agent, or Firm* — Staas & Halsey LLP

(57) ABSTRACT

An air conditioner including an improved airflow regulator is configured to easily regulate the airflow. The air conditioner includes a fan assembly configured to blow air a diffuser assembly configured to include a center panel and a grill arranged at the outside of the center panel such that the air blown by the fan assembly flows through a flow passage formed between the center panel and the grill; and an airflow regulator configured to rotate the diffuser assembly so as to change a direction of the flow passage.

10 Claims, 59 Drawing Sheets

(a)

(b)

(c)

(a) (b)

AIR CONDITIONER

CROSS-REFERENCE TO RELATED APPLICATIONS

This application claims the benefit of Korean Patent Application Nos. 10-2014-0099907 and 10-2014-0173204, respectively filed on Aug. 4, 2014 and Dec. 4, 2014 in the Korean Intellectual Property Office, the disclosure of which is incorporated herein by reference.

BACKGROUND

1. Field

One or more embodiments of the present disclosure relate to an air conditioner configured to change the direction of a discharged airflow.

2. Description of the Related Art

Generally, an air conditioner is an apparatus which maintains indoor air suitable for human activity using a refrigeration cycle so as to provide a user with a more pleasant indoor environment. A general air conditioner may cool an indoor space by repeating suction of warm air in the indoor space, heat exchange between the warm air and a low-temperature refrigerant, and discharge of the heat-exchanged air to the indoor space, or may heat the indoor space by opposite interaction, thereby air-conditioning the indoor space.

The air conditioner may cool or heat an indoor space using a refrigeration cycle in which a refrigerant circulates through a compressor, a condenser, an expansion valve, and an evaporator in a forward or reverse direction. The compressor provides a refrigerant in a high-temperature and high-pressure gaseous state, and the condenser provides a refrigerant in a normal-temperature and high-pressure liquid state. The expansion valve decompresses the refrigerant in the normal-temperature and high-pressure liquid state, and the evaporator evaporates the decompressed refrigerant into a low-temperature gaseous state.

Air conditioners are classified into split-type air conditioners having an indoor unit and an outdoor unit separately installed, and integrated-type air-conditioners having an indoor unit and an outdoor unit installed together in one cabinet.

The indoor unit of the split-type air conditioner includes a heat exchanger to exchange heat with air suctioned into a panel, a fan to suction air from a room into the panel and to supply the suctioned air into the room, and a blade to adjust the direction of discharged air.

SUMMARY

Therefore, it is an aspect of the present disclosure to provide an air conditioner including an improved airflow regulator so as to easily regulate the airflow.

Additional aspects of the disclosure will be set forth in part in the description which follows and, in part, will be apparent from the description, or may be learned by practice of the disclosure.

In accordance with an aspect of the present disclosure, an air conditioner includes: a fan assembly configured to blow air; a diffuser assembly configured to include a center panel and a grill arranged at the outside of the center panel such that the air blown by the fan assembly flows through a flow passage formed between the center panel and the grill; and an airflow regulator configured to rotate the diffuser assembly so as to change a direction of the flow passage.

The airflow regulator may be configured to change the airflow direction by rotating the grill.

A rotation shaft may be disposed at one end of the grill, and the grill may rotate around the rotation shaft by the airflow regulator so that the airflow direction is changed.

The flow passage may be changed in different ways according to the position of the rotation shaft.

The rotation shaft may be disposed at each of an upper part and a lower part of the grill; and if the grill rotates around the rotation shaft, the flow passage may be directed in a horizontal direction.

The rotation shaft may be disposed at each of left and right parts of the grill; and if the grill rotates around the rotation shaft, the flow passage may be directed in a vertical direction.

The airflow regulator may include a driving source and a gear unit configured to transmit driving force of the driving source to the rotation shaft.

A guide protrusion may be formed at one side of the diffuser assembly.

The airflow regulator may include a guide unit configured to direct the guide protrusion.

A curved guide hole may be formed at a side surface of the guide unit, and the guide protrusion may be inserted into the guide hole.

If the guide protrusion rotates, the guide protrusion may be directed by the guide hole and move.

If the guide unit rotates, the flow passage direction may be changed.

A case having a curved guide hole may be disposed at the rear of the center panel.

The case may include a pressing member that is inserted into the guide hole and then guided.

If the case rotates, the pressing member may be directed by the guide hole so as to pressurize one side of the center panel; and if the one side of the center panel is pressurized, the flow passage may be directed in the other direction.

In accordance with another aspect of the present disclosure, an air conditioner includes: a fan assembly configured to blow air; and a diffuser assembly configured to direct movement of the air blown through the fan assembly, wherein the diffuser assembly includes: a center panel; and a blade unit including not only a grill disposed at the outside of the center panel, but also a plurality of blades disposed between the center panel and the grill so as to direct movement of the air, wherein at least some parts of the blade unit are rotatably coupled to the center panel so as to change a direction of the grill.

The blade unit may include a first blade unit hinged to the center panel and a second blade unit fixed to the center panel.

The air conditioner may further include: a cover coupled to the front of the center panel.

The cover may include a guide plate in which a guide hole is formed.

The center panel may include a guide protrusion inserted into the guide hole.

A rotation angle of the first blade unit may be changed according to an elongated length of the guide hole.

The air conditioner may further include: a support unit protruding forward of the first blade unit.

The air conditioner may further include: a pressing unit protruding from a rear surface directed to the guide plate.

If the support port is pressurized by the pressing unit because the guide plate slides to one direction, the first blade unit in which the support unit is formed may rotate around a rotation shaft such that an airflow direction is directed in the other direction.

The first blade may be disposed at each of left and right parts of the center panel; and if the guide plate slides to the left, the airflow caused by the first blade unit may be directed to the left.

In accordance with another aspect of the present disclosure, an air conditioner includes: a housing in which a circular opening is formed; a fan assembly to blow air in a manner that the air is discharged through the opening; and a duct assembly disposed at the front of the opening, configured to guide the air blown through the fan assembly and to change an airflow direction, wherein the duct assembly includes: a first duct rotatably disposed at the front of the opening in a manner that a side surface of the first duct is irregular in height; and a second duct slidably mounted to a front part of the first duct in a manner that a side surface of the second duct is irregular in height.

If the first duct rotates, the second duct may run idle at the front of the first duct.

If the first duct rotates, a direction of the front part of the second duct may be changed so that the airflow direction is also changed.

The air conditioner may further include: a holder disposed between the first duct and the second duct so that the holder rotates together with the first duct.

The first duct may be hook-coupled to the holder.

In accordance with another aspect of the present disclosure, an air conditioner includes: a housing in which a circular opening is formed; a fan assembly to blow air in a manner that the air is discharged through the opening; and a guide blade formed to correspond to the shape of the opening, and rotatably provided in the housing, wherein an airflow direction is changed by rotation of the guide blade.

The guide blade may include a rotation protrusion protruding from at least one side of the guide blade.

The guide blade may be configured to rotate around the rotation protrusion.

The rotation protrusion may receive driving force of a motor, and may be coupled to a rotatable rotation link.

The rotation link and the guide blade may be integrated with each other and be rotatable in an integrated manner.

The air conditioner may further include: a rotation plate having a guide protrusion formed to have eccentricity at one surface and protrudes from the one surface in a manner that the rotation plate is rotatable by a driving source; and a link member, one side of which is coupled to the rotation protrusion, and the other side of which includes a guide hole in which the guide protrusion is inserted.

The guide hole may be elongated in a longitudinal direction of the link member.

If the rotation plate rotates, the link member and the guide blade may be integrated with each other and may rotate in an integrated manner.

The guide blade may include a first guide blade having a first rotation protrusion; and a second guide blade formed to correspond to the first guide blade, configured to include a second rotation protrusion.

The air conditioner may further include a holder blade having a guide hole in which the first rotation protrusion and the second rotation protrusion are inserted.

The guide hole may be formed in a curved shape.

The guide hole may include: a linear section, a first curved section curved from a left end of the linear section, and a second curved section curved from a right end of the linear section.

The first curved section may be elongated to a left rear direction, and the second curved section may be elongated to a right rear direction.

If the second rotation protrusion is located at the first curved section, the guide blade may rotate around the rotation protrusion such that discharged air is directed in a right front direction.

If the first rotation protrusion is located at the second curved section, the first guide blade may rotate around the rotation protrusion such that discharged air is directed in a left front direction.

In accordance with another aspect of the present disclosure, an air conditioner including not only a fan assembly to blow air but also a diffuser assembly to direct the air blown through the fan assembly, includes: the diffuser assembly including: a center panel; a grill located at the outside of the center panel so as to form an airflow passage; a plurality of blades disposed between the center panel and the grill, and formed of a flexible material; and a rotation link mounted to one side of the plurality of blades, wherein the plurality of blades are changed in shape by rotation of the rotation link such that an airflow direction is changed.

In accordance with another aspect of the present disclosure, an air conditioner acting as a diffuser assembly formed to direct air blown through a circular opening, includes: the diffuser assembly including: a center panel; a rotation link rotatably mounted to the center panel; a grill located at the outside of the center panel; and a plurality of blades, one side of which is rotatably mounted to the rotation link, and the other side of which is rotatably mounted to the grill, wherein the plurality of blades are formed to be rotatable by rotation of the rotation link.

The air conditioner may further include: a rotation protrusion disposed at the other side of each blade, wherein, if the rotation link rotates in one direction, the blade rotates in one direction on the basis of the rotation protrusion.

In accordance with another aspect of the present disclosure a diffuser assembly for an air conditioner may include a central panel, a grill disposed outside of the center panel to form an airflow passage, a plurality of blades disposed between the center panel and the grill and a circular link rotatably coupled to the center panel. The plurality of blades may be coupled to the circular link such that a rotation of the circular link changes an angle of the plurality of blades thereby changing a direction of airflow. The circular link may further include a plurality of link grooves spaced apart circumferentially from each other at a predetermined distance and each of the plurality of blades comprises a link shaft that is inserted into each link groove.

In accordance with another aspect of the present disclosure a diffuser assembly for an air conditioner may include a central panel, a grill disposed outside of the center panel to form an airflow passage, a plurality of blades disposed between the center panel and the grill, a case of the diffuser assembly including a guide hole formed at a side surface of the case and a pressing member disposed outside of the case and including a guide protrusion inserted into the guide hole formed at the side surface of the case. The diffuser assembly may rotate thereby changing an airflow direction when the pressing member exerts pressure on the diffuser assembly.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
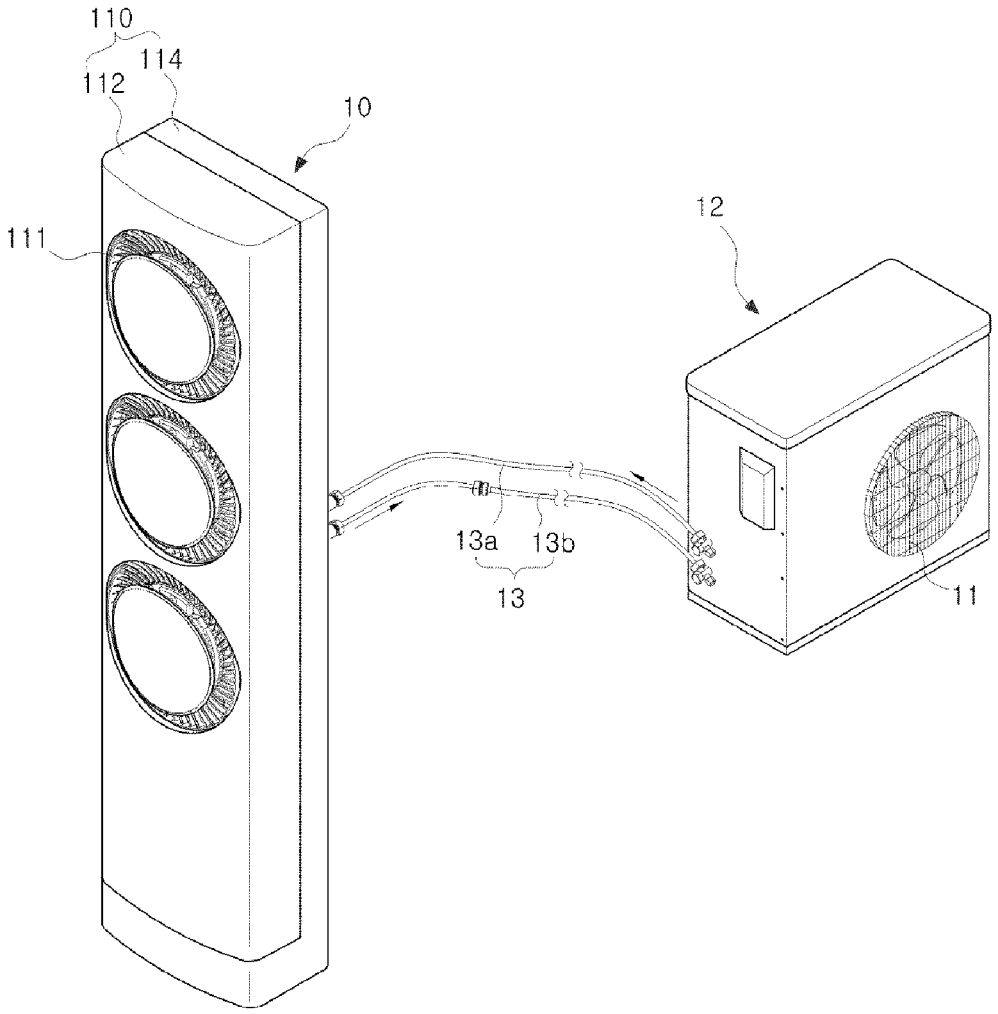
FIG. 1 is a perspective view illustrating an air conditioner according to a first embodiment of the present disclosure.

Reference will now be made in detail to the embodiments of the present disclosure, examples of which are illustrated in the accompanying drawings, wherein like reference numerals refer to like elements throughout. An air conditioner according to embodiments of the present disclosure will hereinafter be described with reference to the attached drawings.

FIG. 1 is a perspective view illustrating an air conditioner according to a first embodiment of the present disclosure.

Referring to FIG. 1, the air conditioner according to an embodiment of the present disclosure includes an indoor unit 10 and an outdoor unit 12. The indoor unit 10 may be connected to the outdoor unit 12 by a refrigerant tube 13.

The refrigerant tube 13 may include a first refrigerant tube 13*a* and a second refrigerant tube 13*b*. Refrigerant condensed by the outdoor unit 12 may move to the indoor unit 10 through the first refrigerant tube 13*a*. Refrigerant heat-exchanged with indoor air in the indoor unit 10 may move to the outdoor unit 12 through the second refrigerant tube 13*b*. As described above, the refrigerant may circulate not only in a refrigerant pipe (not shown) contained in the indoor unit 10 but also in a refrigerant pipe (not shown) contained in the outdoor unit 12 through the refrigerant tube 13.

The indoor unit 10 discharges the air heat-exchanged with the refrigerant compressed/condensed in the indoor unit 12 into an indoor space, such that indoor temperature can be cooled and maintained at a proper temperature. The indoor unit 10 may include an expansion valve and an evaporator. Air cooled by refrigerant evaporated by the evaporator is discharged into the indoor space, so that indoor air can be cooled. The indoor unit 10 may include a fan assembly 140 and a diffuser assembly 150 so as to easily discharge the air cooled by the refrigerant into the indoor space.

The outdoor unit 12 may include a compressor, a condenser, and a fan 11. An air inlet through which outside air can be introduced or discharged may be formed at one side of the outdoor unit 12. The compressor may compress refrigerant, and the compressed refrigerant may be introduced into the condenser and then condensed by the condenser. In this case, the fan 11 may be driven, and outside air introduced through the air inlet may exchange heat with the condenser.

Figure 2:
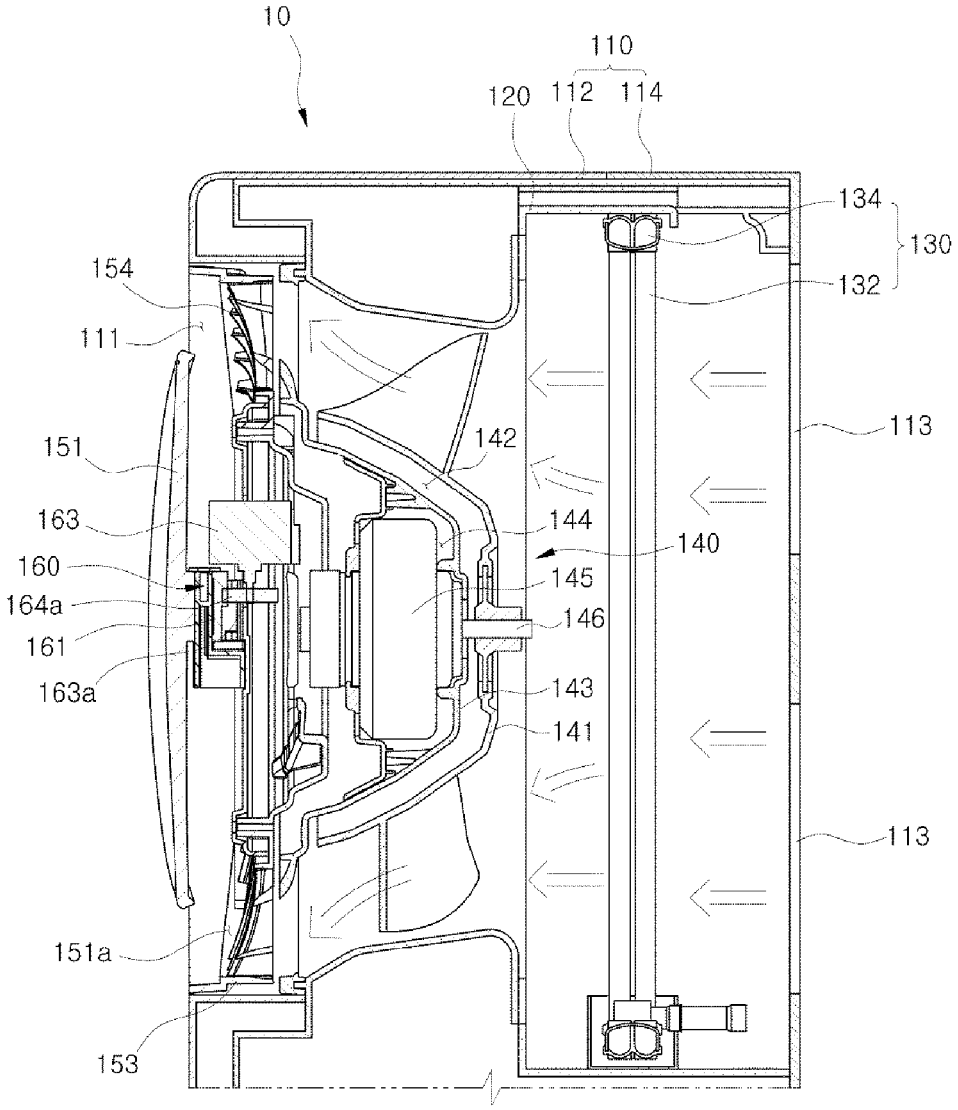
FIG. 2 is a side cross-sectional view illustrating some parts of an indoor unit of the air conditioner according to the first embodiment of the present disclosure.
Figure 3:
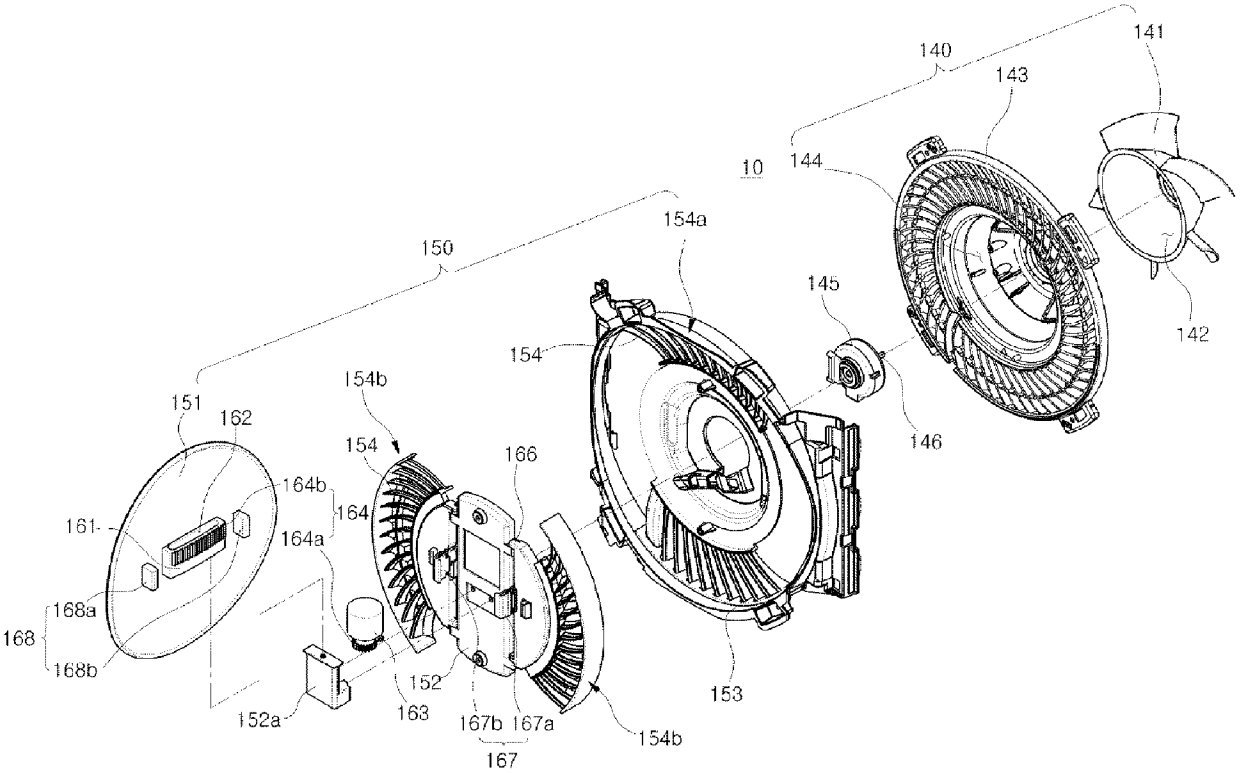
FIG. 3 is an exploded perspective view illustrating some parts of an indoor unit according to the first embodiment of the present disclosure.
Figure 4:
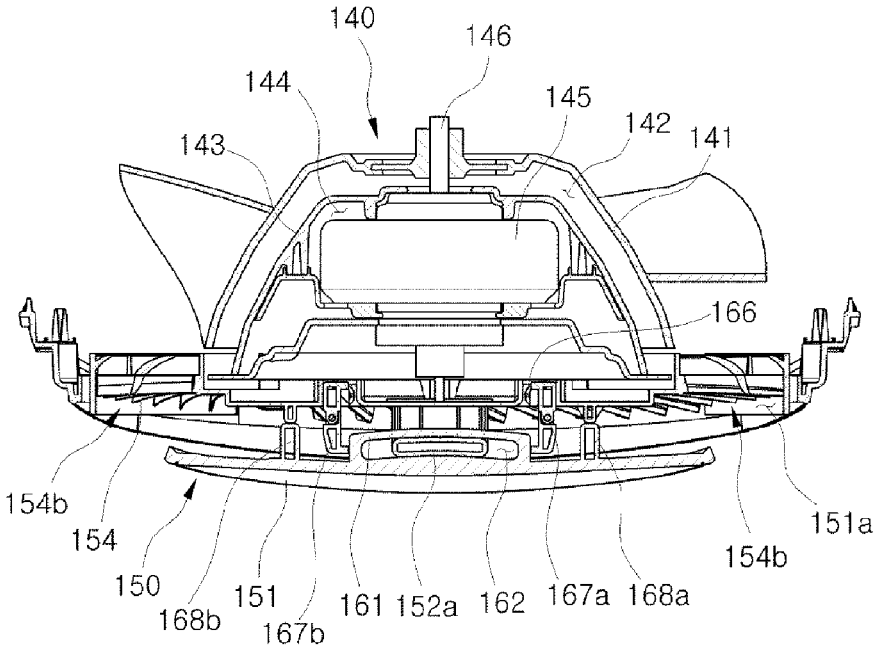
FIG. 4 is a top cross-sectional view illustrating some parts of an indoor unit according to the first embodiment of the present disclosure.

FIG. 2 is a side cross-sectional view illustrating some parts of an indoor unit of the air conditioner according to the first embodiment of the present disclosure. FIG. 3 is an exploded perspective view illustrating some parts of an indoor unit according to the first embodiment of the present disclosure. FIG. 4 is a top cross-sectional view illustrating some parts of an indoor unit according to the first embodiment of the present disclosure.

Referring to FIGS. 2 to 4, the indoor unit 10 according to the first embodiment may include a housing 110 configured to form the external appearance of the indoor unit 10, a diffuser assembly 150 arranged in the housing 10 so as to guide discharge of air, a fan assembly 140 disposed at the rear of the diffuser assembly 150, an airflow regulator 160 configured to adjust (or regulate) the flow of air discharged from the diffuser assembly 150, and at least one heat exchanger 130 disposed at the rear of the fan assembly 140 in the housing 110.

The housing 110 may include a front panel 112 and a rear panel 114. An opening may be formed in the front panel 112. The opening may serve as the outlet 111 through which the air generated from the fan assembly is discharged to the outside. For simplicity, the opening will hereinafter be referred to as an outlet 111. The outlet 111 may be formed in a circular shape. The air suctioned through the fan assembly 140 may be discharged through the outlet 111 formed in the front panel 112.

The rear panel 114 is coupled to a rear part of the front panel 112 such that the rear surface of the indoor unit 10 can be formed. The rear panel 114 may include a plurality of inlets 113.

The heat exchanger 130 may be disposed between the fan assembly 140 and the rear panel 114. The heat exchanger 130 may be installed in the indoor unit 10 with a fixed bracket. The heat exchanger 130 may absorb heat from air introduced through the inlets 113 or may transfer heat to the air introduced through the inlets 113.

The heat exchanger 130 may include a tube 132, a header 134, and a plurality of heat-exchange fins. The header 134 may be connected to one end or both ends of the tube 132. A refrigerant pipe connected to the refrigerant pipe of the outdoor unit 12 is connected to the header 134, such that refrigerant may be introduced into or discharged from the tube 132. The plurality of heat-exchange fins may be mounted to the tube 132 so that heat-exchange efficiency of the heat exchanger 130 can be increased.

The fan assembly 140 may be arranged at the rear of the front panel 112. The fan assembly 140 may be arranged at the front of the heat exchanger 130, and air heat-exchanged in the heat exchanger 130 is suctioned and then discharged through the outlet 111.

The fan assembly 140 may include a fan 141, a motor cover 143, and a motor 145. The fan 141 may be a mixed-flow fan configured to rotate by the motor 145.

The motor cover 143 may include a motor accommodation unit 144 in which the motor 145 can be inserted. The motor accommodation unit 144 may be formed to have a space protruding backward. The motor 145 may be accommodated in the motor accommodation unit 144. The motor cover 143 may be interposed between the motor 145 and the fan 141. A space 142 enclosing the motor accommodation unit 144 may be provided at one side of the fan 141.

A shaft 146 may be disposed at one side of the motor 145 such that the shaft 145 can receive a driving force from the motor 145. This shaft 146 may be configured to pass through the motor cover 143, so that the fan 141 can be mounted to the shaft 146. Therefore, the fan 142 may receive the driving force from the motor 145 such that the fan 142 can rotate according to the received driving force. The shaft 146 contained in the motor 145 may be arranged to face the rear panel 114.

As the fan assembly 140 operates, the air introduced into the indoor unit 10 through the inlet 113 may be discharged through the outlet 111 formed in the front panel 112. In this case, the diffuser assembly 150 configured to direct the air generated from the fan assembly 140 to the outlet 111 may be disposed at the front of the fan assembly 140.

The diffuser assembly 150 may include a circular cover 151, a center panel 152 coupled to the cover 151, a grill 153 disposed at the outside of the radial direction of the center panel 152, and a blade 154 disposed between the center panel 152 and the grill 153 so as to direct the air blown from the fan 141.

A ring-shaped outlet 151*a* may be formed between the cover 151 and the grill 153. The blade 154 may be formed to have a spiral shape at a formation position of the outlet 151*a*, such that the blade 154 can direct the discharged air blown from the fan 141. The diffuser assembly 150 is disposed at the front of the fan assembly 140, such that the air suctioned by the fan 141 can be discharged to the front of the front panel 112 through the outlet 151*a*.

In accordance with the first embodiment of the present disclosure, the air conditioner may include an airflow regulator 160 configured to regulate the direction of linear airflow discharged from the diffuser assembly 150. The airflow regulator 160 may move the cover 151 of the diffuser assembly 150 in a horizontal direction, and at the same time some parts of the plurality of blades 154 also move along with the diffuser assembly 150, so that the airflow can be changed in a horizontal direction. A detailed description of the airflow regulator 160 will be described later.

For regulation of the airflow, the plurality of blades 154 provided in the diffuser assembly 150 may include a blade fixing unit 154*a* and a blade moving unit 154*b*. One end of each blade 154 may be connected to the center panel 152, and the other end thereof may be connected to the grill 153.

The blade fixing unit 154*a* may be connected to the center panel 152, the grill 153, and the blade 154. The blade moving unit 154*b* may be connected to the center panel 152 in such a manner that the blade 154 coupled to the grill 153 can move from the center panel 152.

The blade moving unit 154*b* may be hinged to the center panel 152 in such a manner that the blade moving unit 154*b* can move at a predetermined angle. The blade moving unit 154*b* may move in cooperation with the cover 151. The blade moving unit 154*b* may be disposed at either of the left and right sides with respect to the cover 151.

The airflow regulator 160 may include a guide plate 161 installed in the cover 151 in a manner that the cover 151 can move in a horizontal direction, a motor 163 to provide driving force in a manner that the guide plate 161 can move along with the cover 151, and a gear unit 164 to provide rotational force of the motor 163.

A guide hole 162 having a predetermined length in a horizontal direction may be formed in the guide plate 161. An output gear 164*b* facing the center panel 152 of the diffuser assembly 150 may be provided at an outer surface of the guide plate 161.

The output gear 164*b* may be meshed with a motor shaft 163*a* of the motor 163. Rotation speed of the motor 163 is changed by a gear ratio of the output gear 164*b*, and the changed rotation speed of the motor 163 can be applied to the guide plate 161. The output gear 164*b* may be implemented as a rack gear. The guide plate 161 may receive a rotational force through a drive gear 164*a* such that the guide plate 161 may slide to the left or right by the driving force of the motor 163.

A guide protrusion 152*a* formed to pass through the guide hole 162 may be formed in the center panel 152. The guide protrusion 152*a* may be formed stepwise in a manner that the guide protrusion 152*a* protrudes perpendicularly from the center panel 152, such that the guide protrusion 152 is inserted into the guide hole 152. The guide protrusion 152*a* may support the guide plate 161 during movement of the guide plate 161, and may also restrict movement of the guide plate 161 when a side end portion of the guide protrusion 152*a* contacts the end portion of the guide hole 162.

The airflow regulator 160 may further include a link unit that rotates by a predetermined angle by interworking with the blade moving unit 154*b* during movement of the cover 151. The link unit may include a hinge unit 166 that enables the blade moving unit 154 to be rotatably coupled to the center panel 152; a support unit 167 protruding from the blade moving unit 154*b* to the cover 151; and a pressing unit 168 protruding from the guide plate 161 toward the blade 154 or protruding from the cover 151 toward the blade 154.

The support unit 167 and the pressing unit 168 may be respectively disposed at the left and right sides with respect to the center point of the cover 151. For example, one pair of the support units 167 and one pair of the pressing units 168 may be provided. The support units 167 and the pressing units 168 may be horizontally spaced apart from each other by a predetermined distance. The pressing units 168 may be disposed at the outside of the support units 167.

Figure 5:
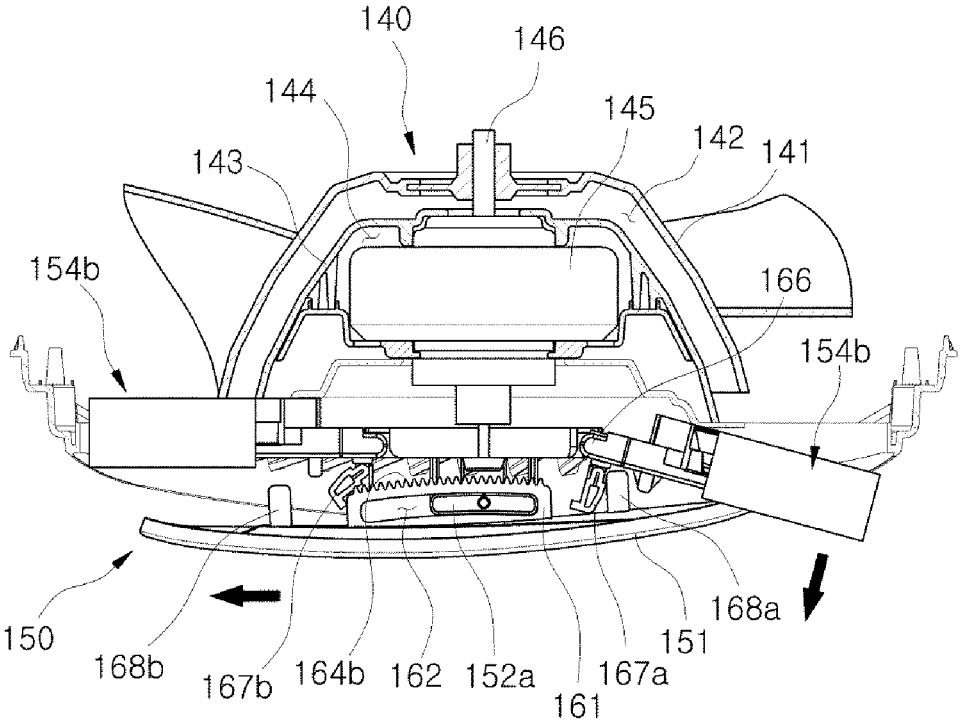
FIGS. 5 and 6 illustrate the operations generated by the airflow regulator according to the first embodiment of the present disclosure.
Figure 6:
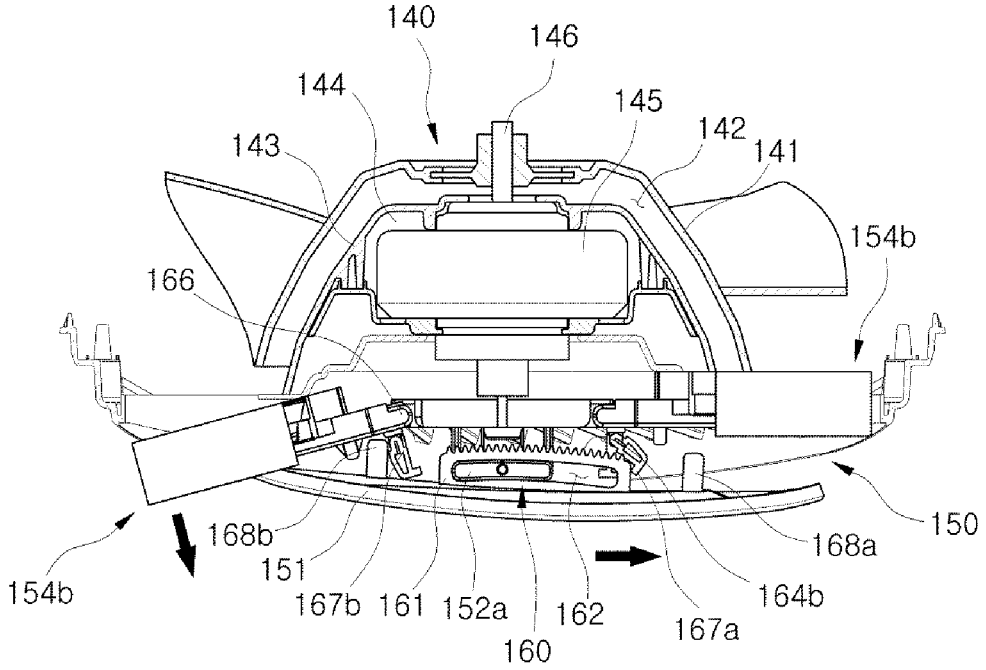

FIGS. 5 and 6 illustrate the operations generated by the airflow regulator according to the first embodiment of the present disclosure. The operation for regulating the airflow discharged from the diffuser assembly 150 through the airflow regulator 160 according to the first embodiment of the present disclosure will hereinafter be described with reference to FIGS. 5 and 6.

If the driving force of the motor 163 is generated, rotational force is transferred to the guide plate 161 through the gear unit 164. The guide plate 161 may slide to the left or right according to forward and reverse rotational force generated by the motor 163. When the guide plate 161 moves, the blade moving unit 154*b* interworks with the cover 151 by the link unit, such that the blade moving unit 154*b* may rotate around the hinge unit 166. In this case, the blade moving unit 154*b* may enable the other blade moving unit 154*b* located opposite to the movement direction of the cover 151 to rotate around the hinge unit 166.

For example, as shown in FIG. 5, under the condition that the guide plate 161 moves to the left, if the right pressing unit 168*a* formed in the guide plate 161 presses the right support unit 167*a* of the blade moving unit 154*b*, the blade moving unit 154*b* located at the right side may rotate by a predetermined angle in a forward direction on the basis of the hinge unit 166. In this case, the left pressing unit 168*b* formed in the guide plate 161 may move away from the left support unit 167*b* of the blade moving unit 154*b*.

If the cover 151 moves to the left with respect to a front viewpoint, the cover 151 covers some parts of the left outlet 151*a*, and the left blade moving unit 154*b* may be located in the same plane as the blade fixing unit 154*a*. The right blade moving unit 154*b* may rotate by a predetermined angle in such a manner that one of the right blade moving unit 154*b* may be arranged to face forward. Therefore, the direction of airflow discharged in the form of linear airflow may be changed to the left airflow.

Likewise, if the cover 151 moves to the right, the left blade moving unit 154*b* rotates along with the cover 151 and the guide plate 161 as shown in FIG. 6, such that the airflow discharged in the form of linear airflow may be changed to the right airflow.

In the meantime, although the cover 151 and the blade moving unit 154*b* move in a horizontal direction by the above-mentioned airflow regulator 160 so as to adjust the direction of airflow in a left or right direction, the scope or spirit of the present disclosure is not limited thereto, and the position of the airflow regulation structure may also be changed to another position as necessary. For example, the blade moving units 154*b* are respectively arranged in upper and lower directions, and the cover 151 is arranged to move vertically, such that the vertical wind direction can be adjusted or regulated.

The air conditioner having an airflow regulator according to a second embodiment of the present disclosure will hereinafter be described with reference to the attached drawings. The air conditioner according to the second embodiment includes an indoor unit and an outdoor unit. The indoor unit according to the second embodiment may include a housing, a diffuser assembly, a fan assembly, a heat exchanger, and an airflow regulator. Although the indoor unit of the second embodiment has the same constituent elements as those of the first embodiment, the indoor unit of the second embodiment has a diffuser assembly structure and an airflow regulator, which are configured to adjust the direction of discharged air, differently from the first embodiment. That is, the present disclosure aims to adjust the discharged airflow, such that an airflow regulation structure will hereinafter be described and a detailed description of the remaining constituent elements of the indoor unit other than the airflow regulation structure will be omitted for convenience of description.

Figure 7:
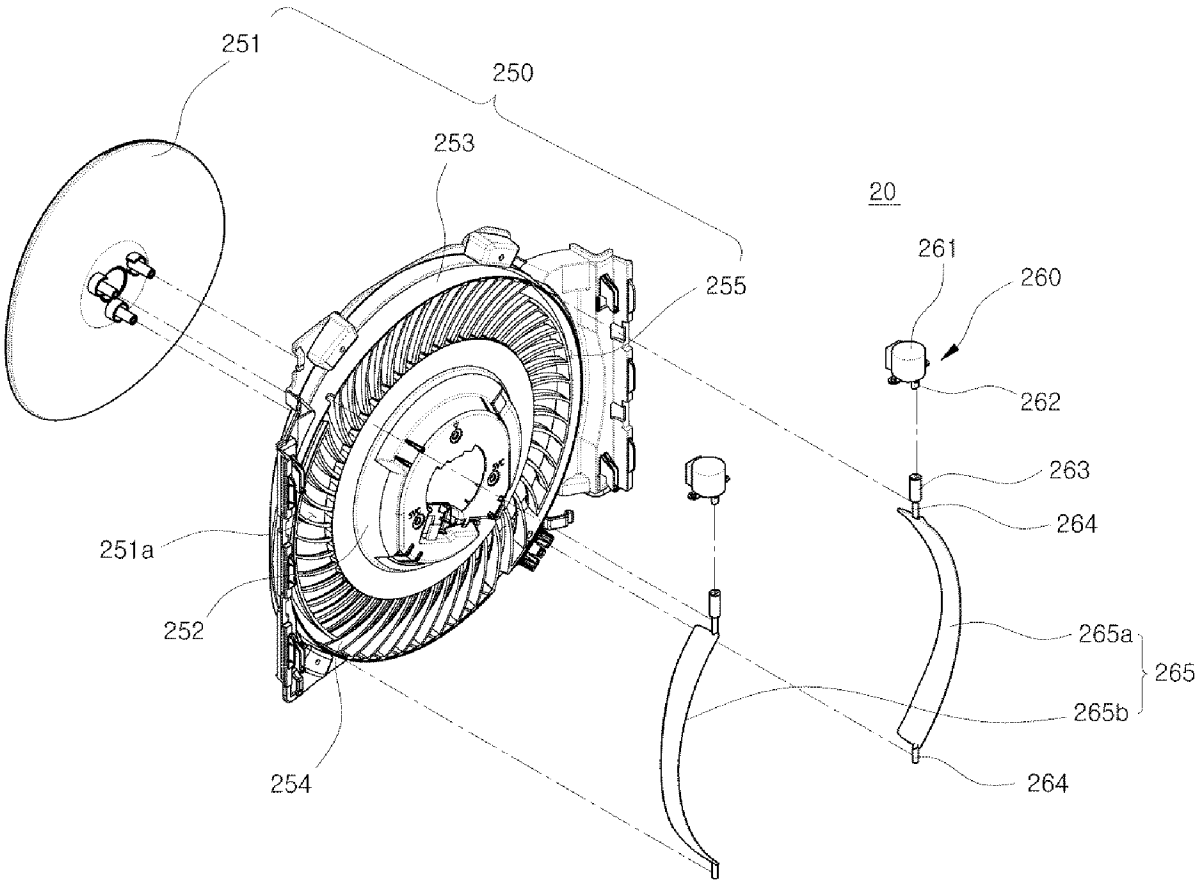
FIG. 7 is an exploded perspective view illustrating some parts of an indoor unit according to a second embodiment of the present disclosure.
Figure 8A:
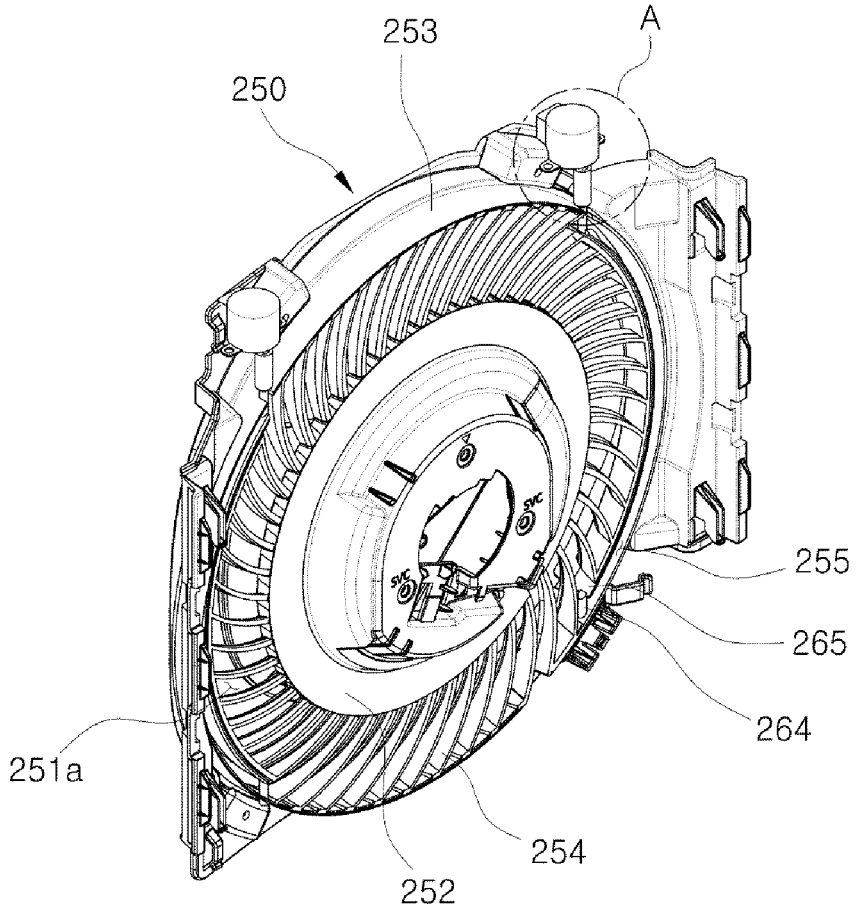
FIGS. 8A and 8B are rear perspective views illustrating some parts of an indoor unit according to the second embodiment of the present disclosure.
Figure 8B:
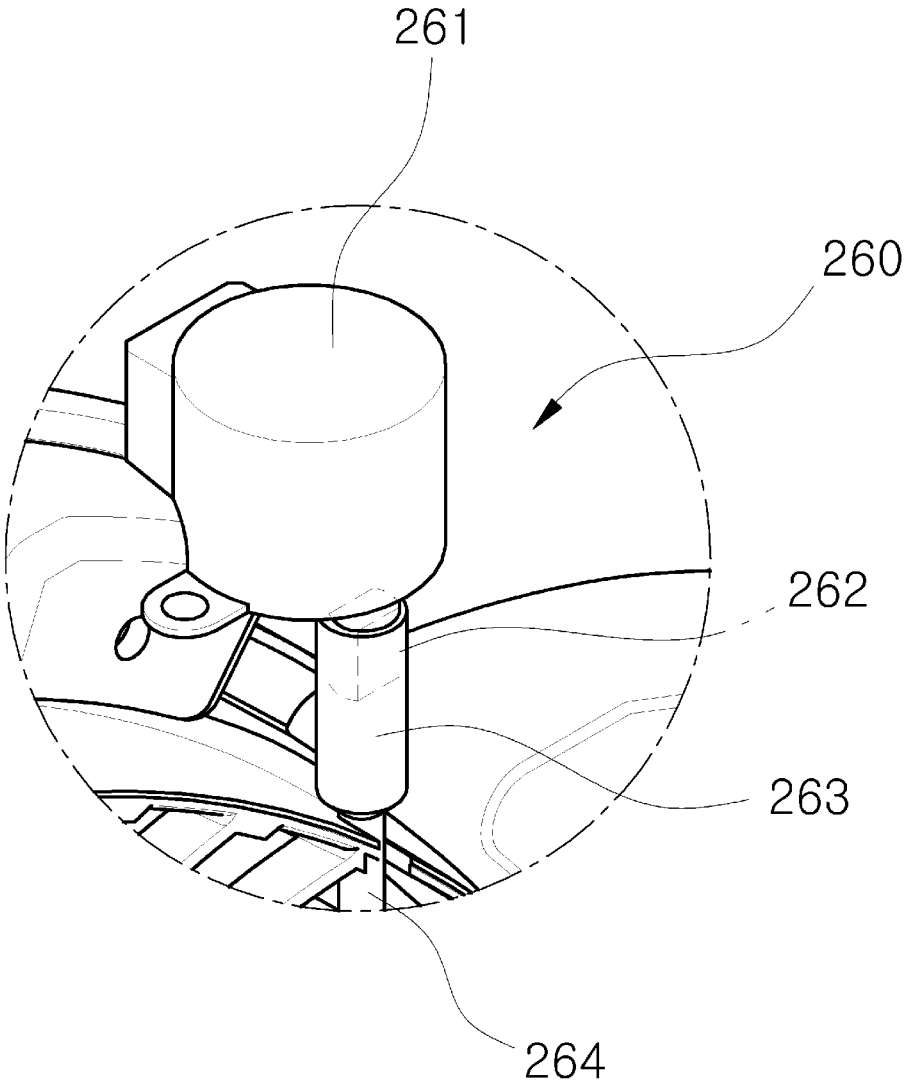

FIG. 7 is an exploded perspective view illustrating some parts of an indoor unit according to a second embodiment of the present disclosure. FIGS. 8A and 8B are rear perspective views illustrating some parts of an indoor unit according to the second embodiment of the present disclosure. For convenience of description, the same or similar structures as those described in the first embodiment are denoted by the same reference numerals, and explanation thereof will be omitted herein.

Figure 9A:
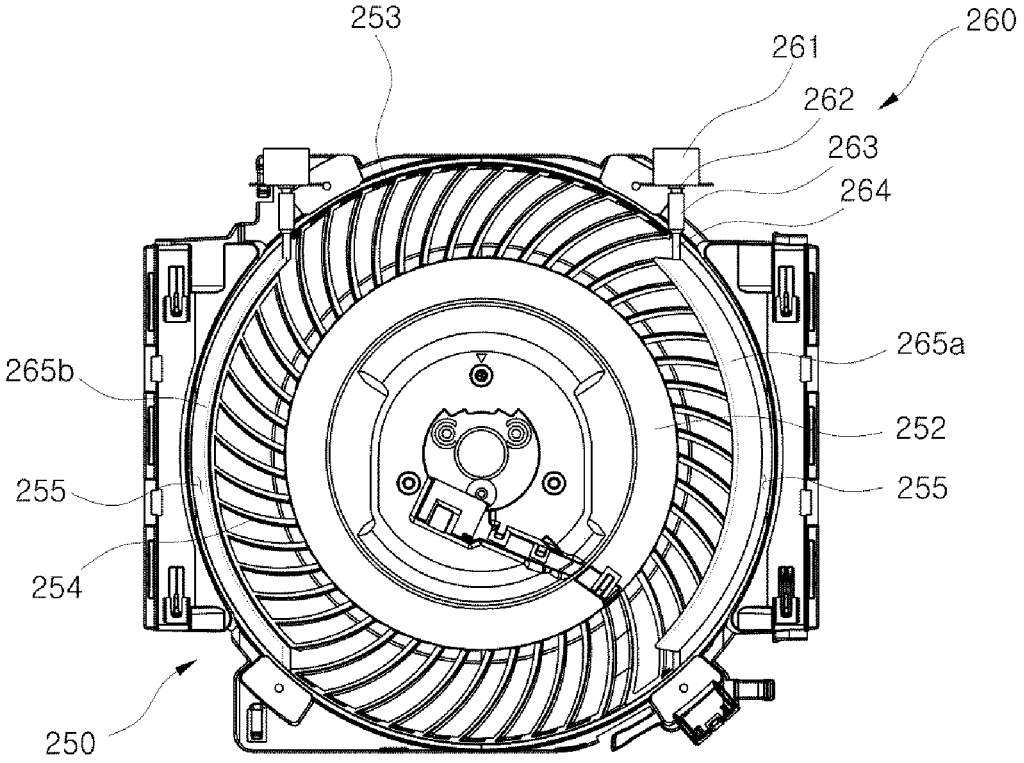
FIGS. 9A, 9B, and 9C illustrate the operation states of an airflow regulator according to the second embodiment of the present disclosure.

Referring to FIGS. 7, 8A, and 8B, the diffuser assembly 250 installed in the indoor unit 20 may include a circular cover 251, a center panel 252 coupled to the cover 251, a grill 253 located at the outside of the radial direction of the center panel 252, and a blade 254 disposed between the center panel 252 and the grill 253 so as to guide the air blown from the fan (see '141' of FIG. 9A). The accommodation unit 255 in which the guide blade 265 is located may be disposed between the center panel 252 and the grill 253.

The airflow regulator 260 may include a guide blade 265 rotatably installed. The guide blade 265 may be disposed in the accommodation unit 255 so as to guide the airflow discharged through the blade 254. The airflow regulator 260 may include a motor 261 configured to provide driving force to the guide blade 265, and a link shaft 263 configured to provide the driving force of the motor 261 to the guide blade 265.

The accommodation unit 255 may be formed at left, right, upper and lower sides with respect to the center panel 252. One pair of the accommodation units 255 may face each other. The following embodiment in which the accommodation units 255 are respectively arranged at left and right sides with respect to the center panel 252 will hereinafter be described with reference to FIGS. 7, 8A, and 8B.

One pair of guide blades 265 may be provided, such that the pair of guide blades 265 may be disposed in each accommodation unit 255. The guide blade 265 may be formed in a circular shape corresponding to an inner surface of the grill 253. The guide blade 265 may receive rotational force from the motor 261, so that the guide blade 265 may rotate by a predetermined angle. The guide blade 265 may guide the flow of air generated from the fan assembly 140 in such a manner that the air can be discharged to the outlet 251*a*.

Rotation shafts 264 may be respectively disposed at both ends of the guide plate 265. The rotation shaft 264 may be connected to one side of the link shaft 263. The other end of the link shaft 263 may be connected to the motor shaft 262. The motor shaft 262 and the rotation shaft 264 may be coupled to the link shaft 263 in a manner that the motor shaft 262 and the rotation shaft 264 can be aligned. The driving force of the motor 261 may be transmitted to the rotation shaft 264 through the motor shaft 262 and the link shaft 263, so that the motor 264 can rotate the guide blade 265.

One pair of guide blades 265 respectively located at left and right sides may be controlled independently, and any one of guide blades 265 may be selectively driven by a user so that the airflow can be directed in the left or right direction.

Figure 9B:
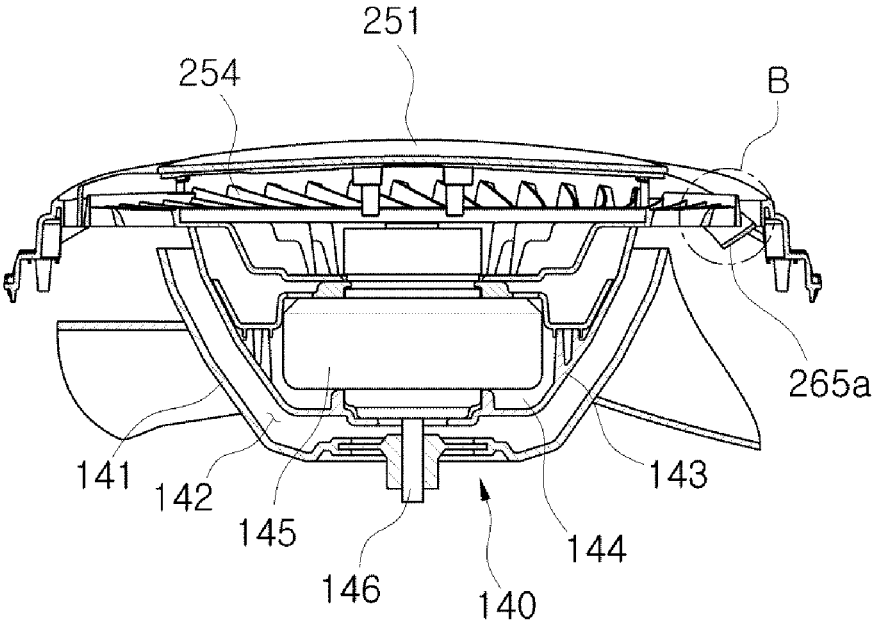
Figure 9C:
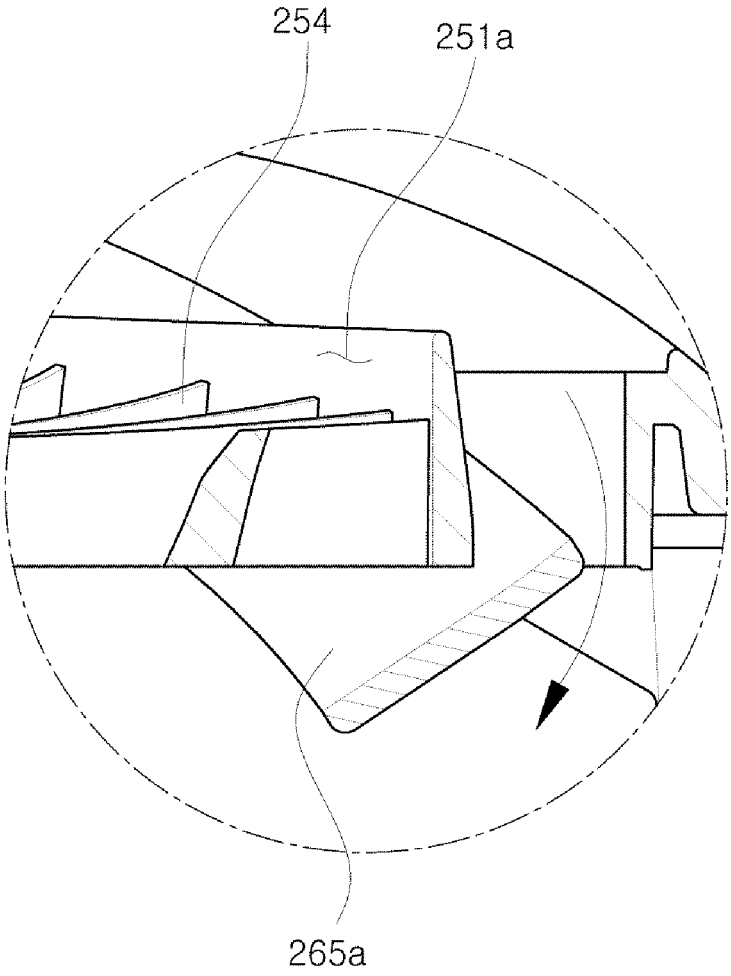

FIGS. 9A, 9B, and 9C illustrate the operation states of an airflow regulator according to the second embodiment of the present disclosure. Variation states of the flow of discharged air will hereinafter be described with reference to FIGS. 9A to 9C.

Figure 10:
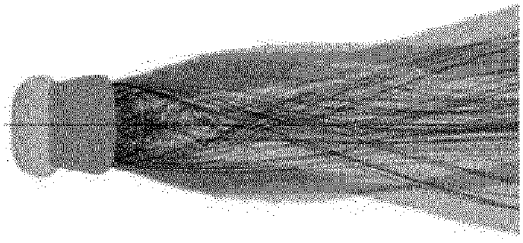
FIG. 10 illustrates flow of discharged air changed by the airflow regulator according to the second embodiment of the present disclosure.
Figure 10:
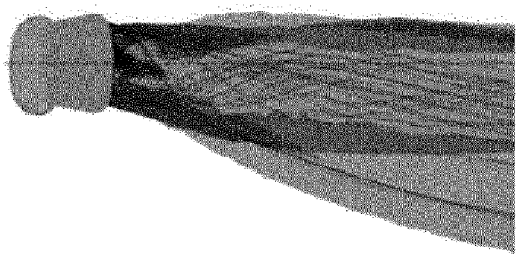
Figure 10:
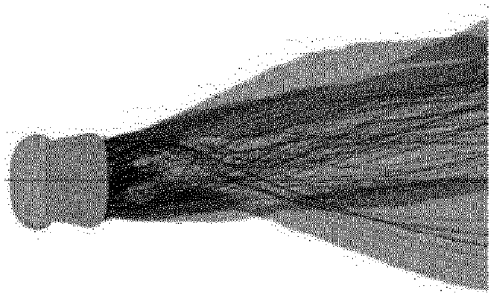

Referring to FIGS. 9A, 9B, and 9C, if the right guide blade 265*a* rotates inward of the outlet for air discharge by a predetermined angle according to driving of the motor 261, the right guide blade 265*a* is used to guide the discharged air, resulting in formation of left airflow (see FIG. 10 (*b*).

Similarly, if the left guide blade 265*b* rotates inward of the outlet by a predetermined angle, the right airflow is formed as shown in FIG. 10 (*c*). In this case, if the guide blades (265*a*, 265*b*) does not rotate inward of the outlet and the outer surfaces of the guide blades (265*a*, 265*b*) are arranged to face the inner surfaces of the grill 253, the airflow can be discharged in a rectilinear airflow shape as shown in FIG. 10 (*a*).

The air conditioner having an airflow regulator according to a third embodiment of the present disclosure will hereinafter be described with reference to the attached drawings. The air conditioner according to the second embodiment includes an indoor unit and an outdoor unit. The indoor unit according to the second embodiment may include a housing, a diffuser assembly, a fan assembly, a heat exchanger, and an airflow regulator. Although the indoor unit of the third embodiment has the same constituent elements as those of the second embodiment, the indoor unit of the third embodiment additionally has a diffuser assembly structure and an airflow regulator, which are configured to adjust the direction of discharged air, differently from the second embodiment. That is, the present disclosure aims to adjust the discharged airflow, such that an airflow regulation structure will hereinafter be described and a detailed description of the remaining constituent elements of the indoor unit other than the airflow regulation structure will be omitted for convenience of description.

Figure 11:
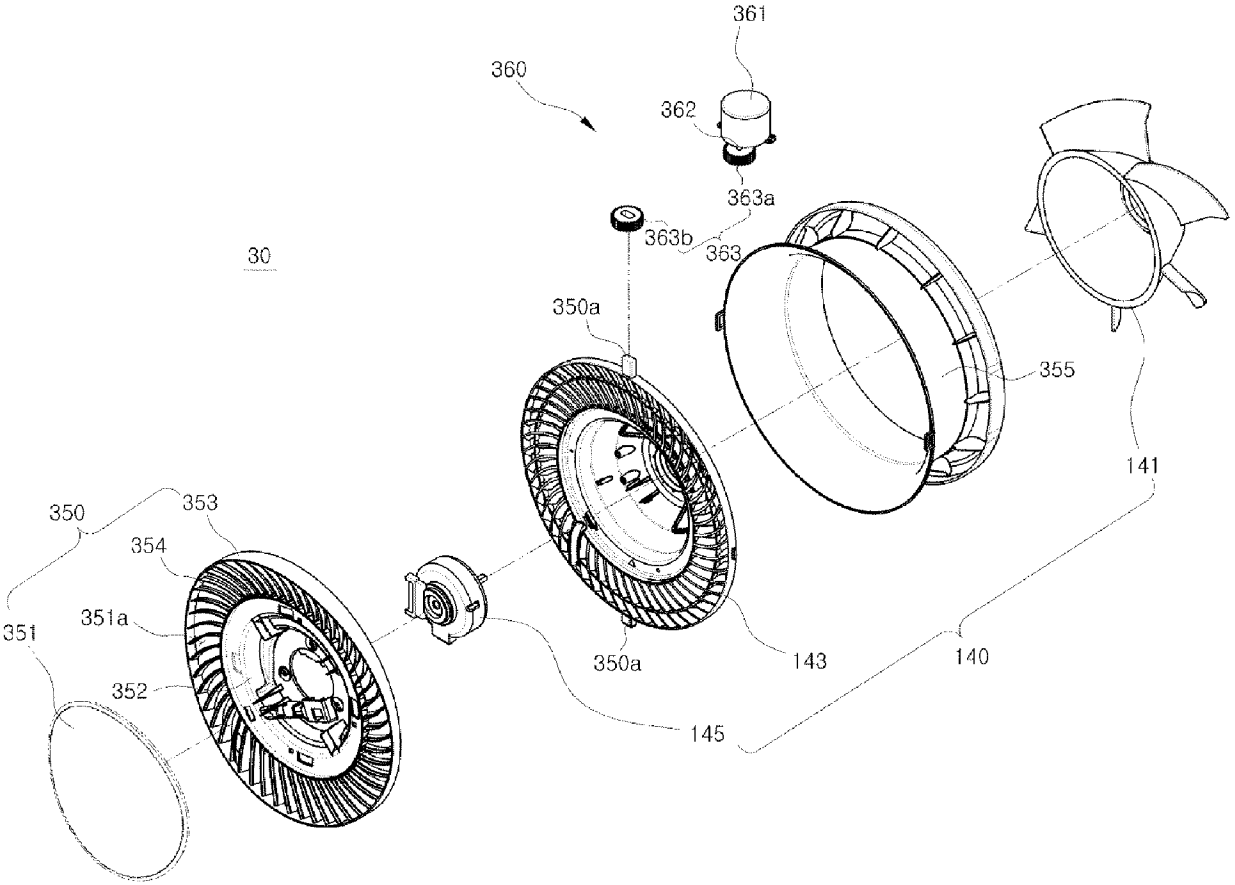
FIG. 11 is an exploded perspective view illustrating some parts of an indoor unit according to a third embodiment of the present disclosure.
Figure 12:
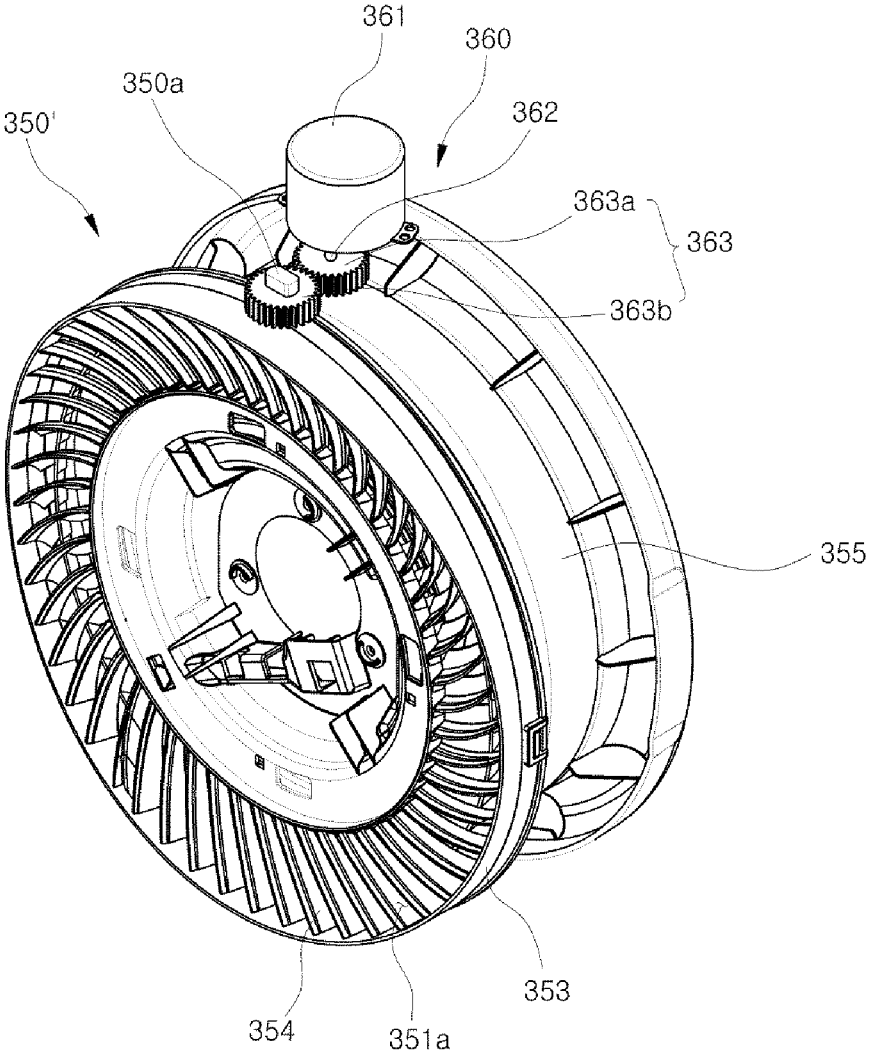
FIG. 12 is an assembled perspective view illustrating the indoor unit shown in FIG. 12.
Figure 13:
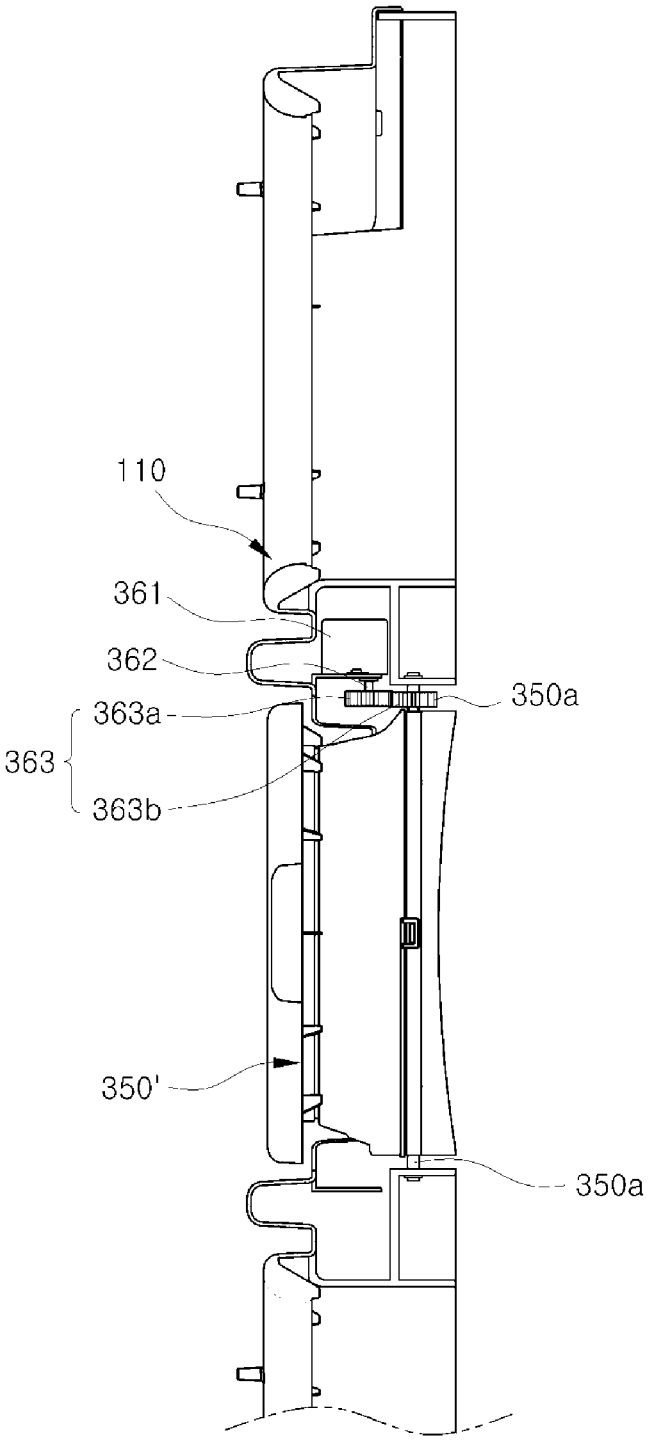
FIG. 13 illustrates that a fan assembly and a diffuser assembly are mounted to a housing according to the third embodiment of the present disclosure.

FIG. 11 is an exploded perspective view illustrating some parts of an indoor unit according to a third embodiment of the present disclosure. FIG. 12 is an assembled perspective view illustrating the indoor unit shown in FIG. 11. FIG. 13 illustrates that a fan assembly and a diffuser assembly are mounted to a housing according to the third embodiment of the present disclosure. For convenience of description, the same or similar structures as those described in the above-mentioned embodiments are denoted by the same reference numerals, and explanation thereof will be omitted herein.

Referring to FIGS. 11, 12, and 13, the fan assembly 140 installed in the indoor unit 30 may be integrated with the diffuser assembly 350. The integrated structure of the fan assembly 140 and the diffuser assembly 350 may be rotatable. This rotatable integrated structure of the fan assembly 140 and the diffuser assembly 350 may be referred to as a rotation unit 350'. The airflow regulator 360 may include a rotation unit to rotate the rotation unit 350', a motor 361 to provide driving force by which the rotation unit 350' can rotate, and a gear unit 363 to provide the driving force of the motor 361.

The diffuser assembly 350 may include a circular cover 351, a center panel 352 coupled to the cover 351, a grill located at the outside of the radial direction of the center panel 352, and a blade 354 disposed between the center panel 352 and the grill 353 so as to direct air blown from the fan 141.

Meanwhile, reference number 355 indicates a coupling unit configured to integrate the fan assembly 140 with the diffuser assembly 350.

The rotation unit 350' may be axially coupled to the housing 110 in such a manner that the rotation unit 350' can rotate by a predetermined angle within the indoor unit 30. For example, the rotation shaft 350*a* may be arranged at each of the upper center part and the lower center part of the rotation unit 350'. Therefore, the rotation unit 350' may rotate around the rotation shaft 350*a* by a predetermined angle, such that the direction of airflow discharged through the outlet 351*a* may be adjusted to the left or right.

Figure 14:
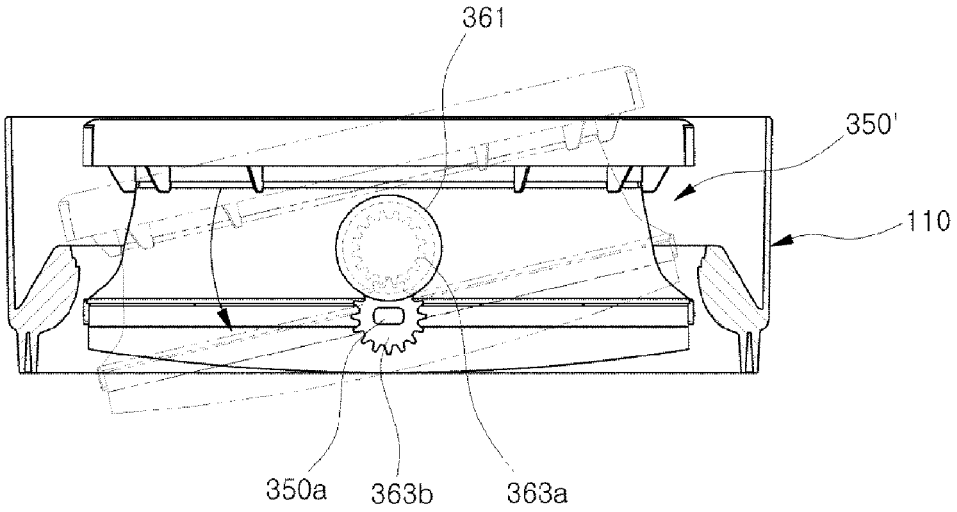
FIG. 14 illustrates the operations of a rotation unit configured to operate by an airflow regulator according to the third embodiment of the present disclosure.

In order to rotate the rotation unit 350' by a predetermined angle, the driving force may be transferred from the motor 361 to at least one rotation shaft 350*a* from among the plurality of rotation shafts 350*a* arranged at the upper and lower parts. The output gear 363*a* may be coupled to the rotation shaft 350*a*, and the output gear 363*b* may be meshed with the drive gear 363*a* coupled to the motor shaft 362 of the motor 361. FIG. 14 illustrates the operations of a rotation unit configured to operate by an airflow regulator according to the third embodiment of the present disclosure. Referring to FIG. 14, the rotation unit 350' may rotate to the left or right by driving force received from the motor 361 so that the direction of airflow discharged from the outlet 351*a* can be changed.

As described above, although the above-mentioned embodiment has exemplarily disclosed that the drive gear 363*a* coupled to the motor 361 is coupled to the output gear 363*b* so that the rotation shaft 350*a* coupled to the output gear 363*b* rotates for convenience of description and better understanding of the present disclosure, the scope or spirit of the gear unit configured to transfer the driving force to the rotation shaft 350*a* is not limited thereto. For example, the drive gear 363*a* of the motor 361 and the output gear 363*b* connected to the rotation shaft 350*a* may be coupled to each other by the rack gear.

The air conditioner having an airflow regulator according to a fourth embodiment of the present disclosure will hereinafter be described with reference to the attached drawings. The air conditioner according to the fourth embodiment includes an indoor unit and an outdoor unit. The indoor unit according to the fourth embodiment may include a housing, a diffuser assembly, a fan assembly, a heat exchanger, and an airflow regulator. Although the indoor unit of the fourth embodiment has the same constituent elements as those of the third embodiment, the indoor unit of the fourth embodiment has a diffuser assembly structure and an airflow regulator, which are configured to adjust the direction of discharged air, differently from the third embodiment. That is, the present disclosure aims to adjust the discharged airflow, such that an airflow regulation structure will hereinafter be described and a detailed description of the remaining constituent elements of the indoor unit other than the airflow regulation structure will be omitted for convenience of description.

Figure 15:
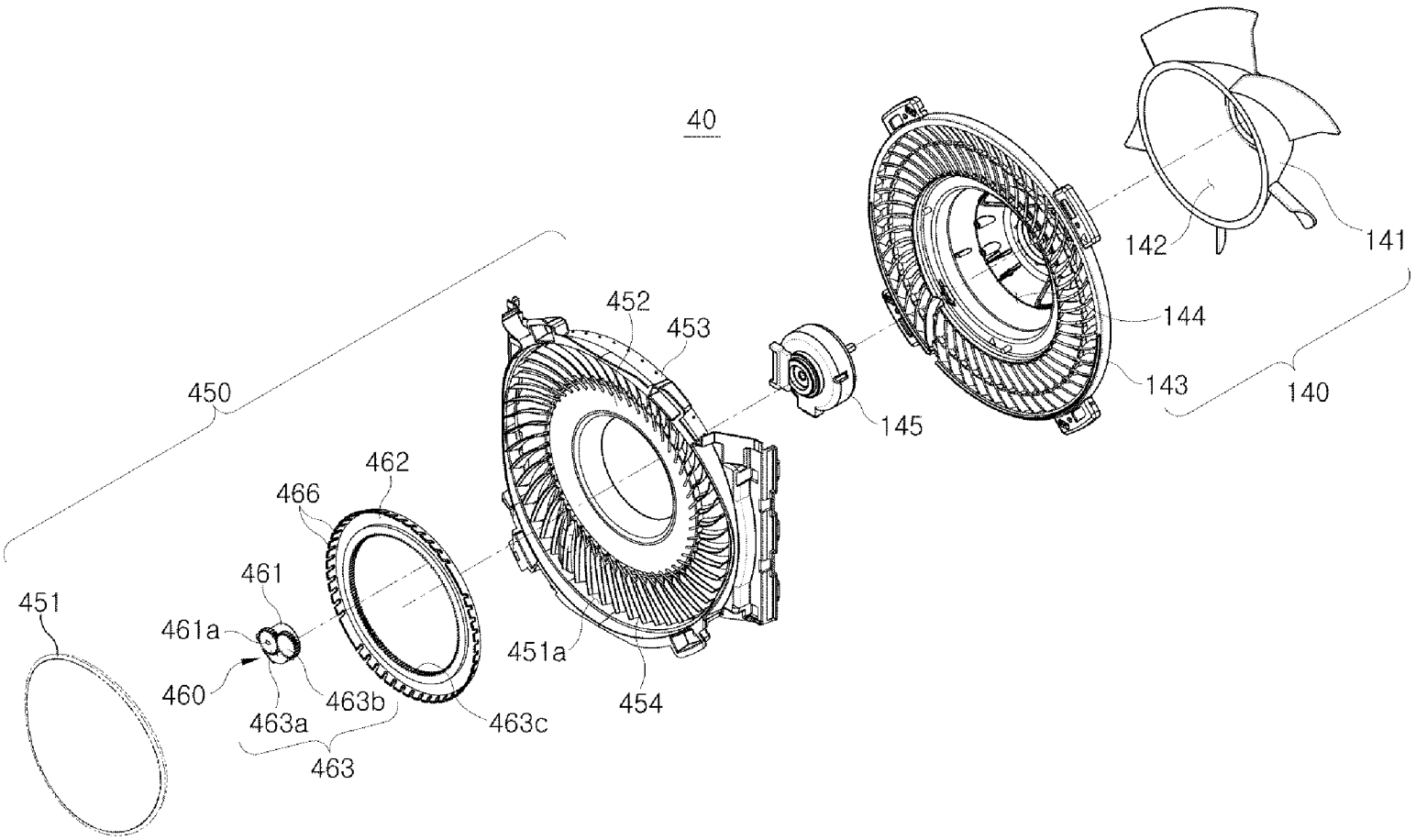
FIG. 15 is an exploded perspective view illustrating some parts of an indoor unit according to a fourth embodiment of the present disclosure.
Figure 16:
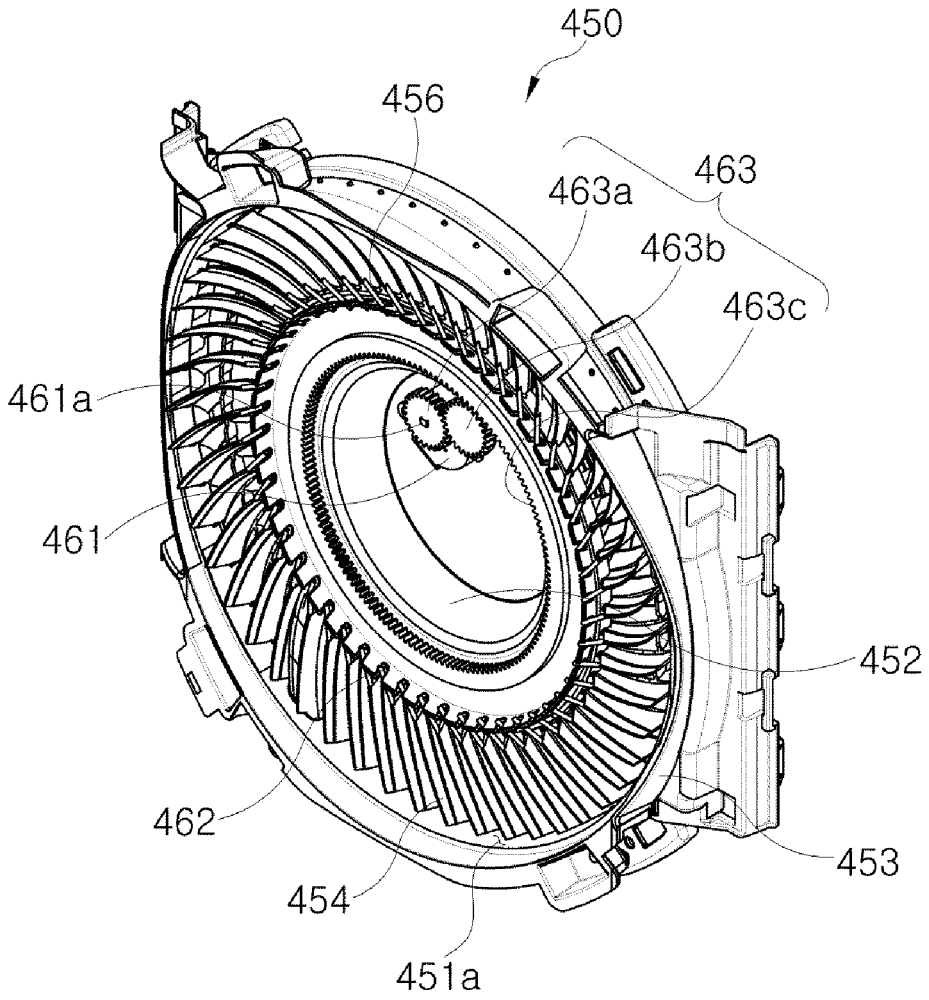
FIG. 16 is an assembled perspective view illustrating the indoor unit shown in FIG. 15.
Figure 17:
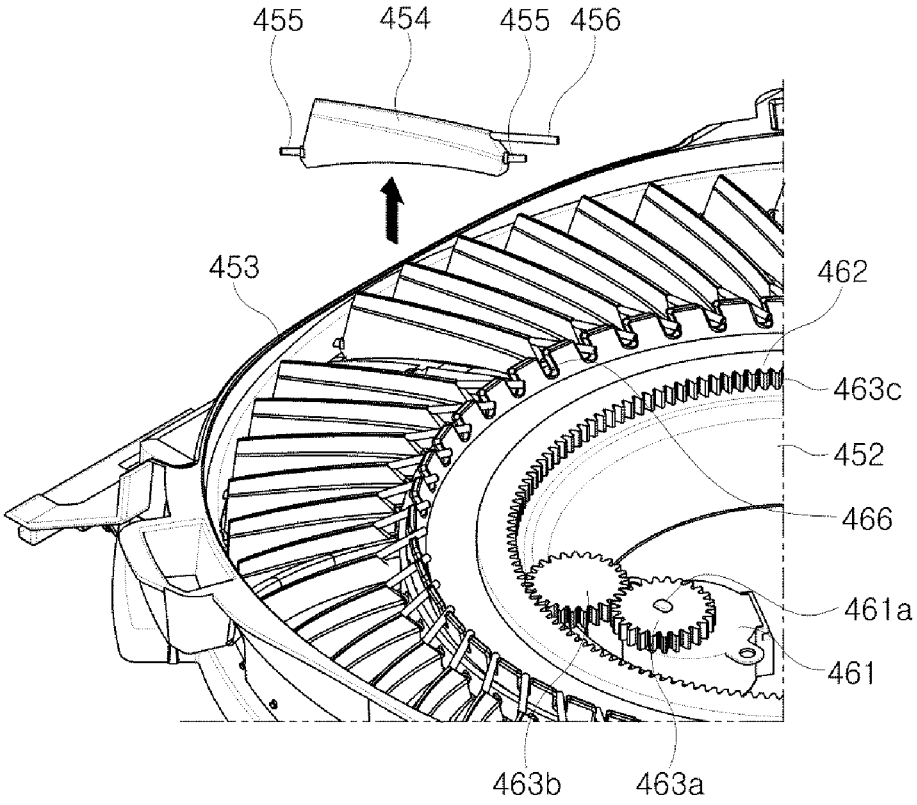
FIG. 17 illustrates that a blade of a diffuser assembly is combined with an airflow regulator according to the fourth embodiment of the present disclosure.

FIG. 15 is an exploded perspective view illustrating some parts of an indoor unit according to a fourth embodiment of the present disclosure. FIG. 16 is an assembled perspective view illustrating the indoor unit shown in FIG. 15. FIG. 17 illustrates that a blade of a diffuser assembly is combined with an airflow regulator according to the fourth embodiment of the present disclosure. For convenience of description, the same or similar structures as those described in the above-mentioned embodiments are denoted by the same reference numerals, and explanation thereof will be omitted herein.

Referring to FIGS. 15, 16, and 17, the indoor unit 40 according to the fourth embodiment may include a diffuser assembly 450 and a fan assembly 140. The fan assembly 140 may include a fan 141, a motor cover 143, and a motor 145. The fan 141 may be a mixed-flow fan configured to be rotated by the motor 145. The motor cover 143 may be disposed between the motor 145 and the fan 141. The motor accommodation unit 144 in which the motor 145 can be inserted may be formed in the motor cover 143. The space 142 enclosing the motor accommodation unit 144 may be arranged at one side of the fan 141.

The diffuser assembly 450 may include a circular cover 451, a center panel 452 coupled to the cover 451, a grill 453 disposed at the outside of the radial direction of the center panel 452, and a blade 454 disposed between the center panel 452 and the grill 453 so as to direct the air blown from the fan 141. The diffuser assembly 450 according to the fourth embodiment may include a plurality of blades 454 rotatable between the center panel 452 and the grill 453 so as to achieve the airflow regulation.

The rotation shafts 455 may be respectively disposed at both ends of the blade 454 in a manner that the rotation shafts 455 can be aligned. Individual blades 454 may be disposed between the center panel 452 and the grill 453 so that the blades 454 can be axially coupled to the center panel 452 and the grill 453. In addition, the link shaft 456 may be formed in each blade 454. The link shaft 456 may be spaced apart from the rotation shaft 455 at either end of each blade 454. The link shaft 456 may be coupled to the circular link 462 to be described later. The operation structure of the blade 454 to be operated according to the operation of the circular link 462 will hereinafter be described.

The airflow regulator 460 may include a circular link 462 to simultaneously rotate the plurality of blades 454 in a manner that each blade 454 can be tilted by a predetermined angle; a motor 461 to provide driving force so as to rotate the circular link 462; and a gear unit 463 to provide the driving force of the motor 461.

The circular link 462 may be rotatably coupled to the center panel 452. Link grooves 466 may be spaced apart from one another by a predetermined distance in a circumferential direction may be formed in the circular link 462. The link shaft 456 contained in the blade 454 may be inserted into each link groove 466.

The link shaft 456 may be arranged in a direction from one end of the blade 454 close to the circular link 462 to the inner side of the circular link 462. Since the link shaft 456 passes through each link groove 466, the link shaft 456 may also move along with the circular link 462 during rotation of the circular link 462. Since the link shaft 456 moves along with the circular link 462, the blade 454 connected to the link shaft 456 may be tilted by a predetermined angle with respect to the rotation shaft 455. As described above, if the blade 454 is tilted by a predetermined angle with respect to the rotation shaft 455, the direction of airflow discharged through the outlet 451*a* may be adjusted in response to a variation in the angle of the blade 454.

The gear unit 463 may include a drive gear 463*a* coupled to the motor shaft 461*a* of the motor 461, a connection gear 463*b* meshed with the drive gear 463*a*, and an output gear 463*c* meshed with the connection gear 463*b*. The output gear 463*c* may be formed at an inner circumferential surface of the circular link 462, and may receive rotational force from the drive gear 463*a* through the connection gear 463*b*. The driving force of the motor 461 is applied to the circular link 462 by the gear unit 463, such that the circular link 462 can rotate.

Although the above-mentioned embodiment has exemplarily disclosed that the output gear 463*c* is configured to receive rotational force through the connection gear 463*b*, it should be noted that the output gear 463*c* is directly meshed with the drive gear 463*a* so that the output gear 463*c* can also receive the rotational force. In addition, a stopper, a location sensor, or the like may be installed to limit the movement range of the circular link 462 rotated by the driving force of the motor 461.

Figure 18:
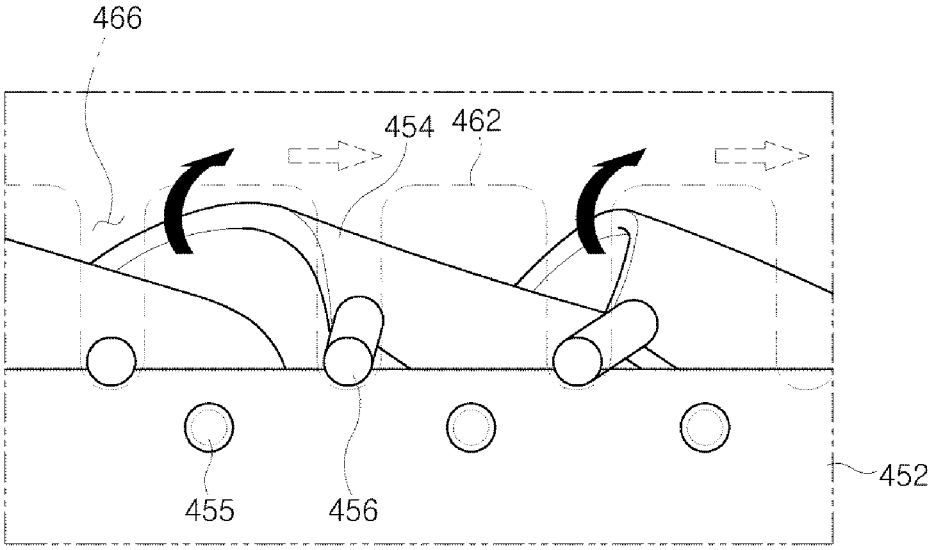
FIGS. 18, 19, and 20 illustrate that a blade angle is adjusted by the airflow regulator according to the fourth embodiment of the present disclosure.
Figure 19:
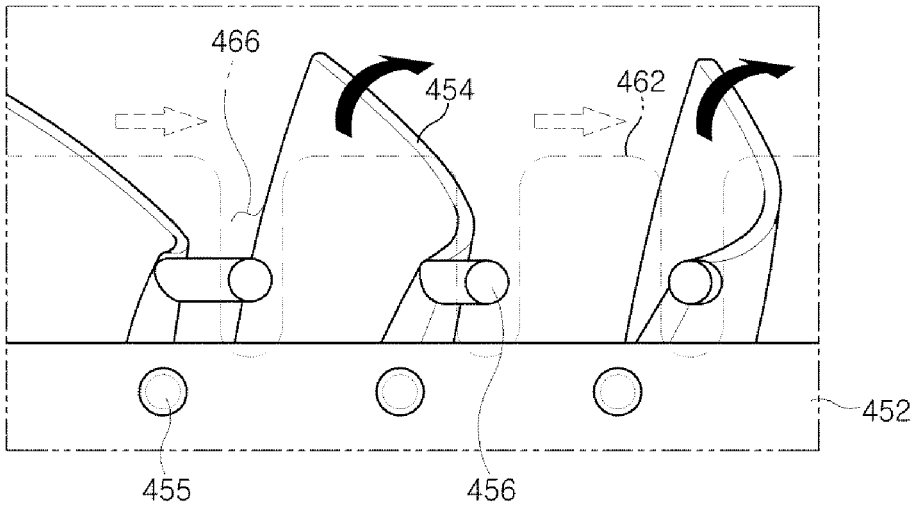
Figure 20:
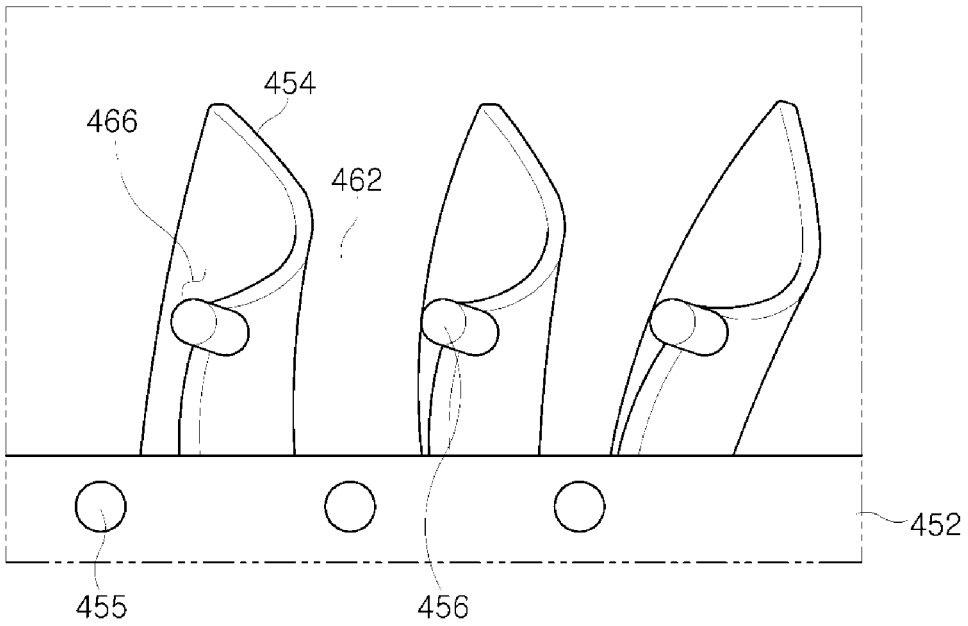

FIGS. 18, 19, and 20 illustrate that a blade angle is adjusted by the airflow regulator according to the fourth embodiment of the present disclosure. The airflow regulation operation state of the above-mentioned indoor unit 40 will hereinafter be described with reference to FIGS. 18, 19, and 20.

Referring to FIG. 19, the air heat-exchanged through the fan assembly 140 during the operation of the indoor unit 40 is directed by the blade 454 so that the linear airflow is discharged through the outlet 451*a*. In this case, it is assumed that the blade is tilted by a predetermined angle of 0° with respect to the blade angle through which the linear airflow is discharged.

In FIG. 18, the blade 454 rotates counterclockwise by a predetermined angle so as to close the outlet 451*a*. For example, the blade 454 may rotate by a predetermined angle of about −80° with respect to the blade angle shown in FIG. 19 so as to close the outlet 451*a*. The above-mentioned situation may indicate a pre-operation state of the indoor unit 40, such that the outlet 451*a* is closed when the air conditioner is not in use. As a result, foreign materials or dust can be prevented from entering the indoor unit 40. If the air conditioner is powered on, the blade 454 rotates clockwise and thus the direction of airflow can be changed as shown in FIG. 19.

As can be seen from FIG. 20, the circular link 462 further rotates in a manner that the blade 454 configured to discharge the linear airflow can be further tilted in a direction through which the outlet 451*a* is opened. For example, the circular link 462 may rotate clockwise by a predetermined angle of about 20° with respect to the blade angle shown in FIG. 19. The air discharged through the outlet 451*a* may be directed or guided by the blade 454, such that the discharged air can be diffused and discharged.

Although the above-mentioned embodiment has exemplarily disclosed the air discharge state changing depending on the angle variation of the blade 454 for convenience of description, the scope or spirit of the present disclosure is not limited thereto, the above-mentioned blade angle is only exemplary, and the angle of the blade 454 is precisely adjusted such that the direction of air discharged through the outlet 451*a* can be changed.

Although the above-mentioned embodiment has exemplarily disclosed that the rotatable blades 454 are coupled to the circular link 462 mounted to the center panel 452 such that the angle of the blade 454 can be changed, the scope or spirit of the structure capable of changing the blade angle is not limited thereto, and all kinds of structures configured to change the blade angle by simultaneously rotating the plurality of blades 454 can also be applied to the present disclosure without departing from the scope or spirit of the present disclosure. For example, the circular link 462 in which the link groove 466 is formed is rotatably installed at a position at which the grill 453 is formed, and is connected to each blade 454, such that the angle of the blade 454 can also be changed according to rotation of the circular link 462.

The air conditioner having an airflow regulator according to a fifth embodiment of the present disclosure will hereinafter be described with reference to the attached drawings. The air conditioner according to the fifth embodiment includes an indoor unit and an outdoor unit. The indoor unit according to the fifth embodiment may include a housing, a diffuser assembly, a fan assembly, a heat exchanger, and an airflow regulator. Although the indoor unit of the fifth embodiment has the same constituent elements as those of the fourth embodiment, the indoor unit of the fifth embodiment has a diffuser assembly structure and an airflow regulator, which are configured to adjust the direction of discharged air, differently from the fourth embodiment. That is, the present disclosure aims to adjust the discharged airflow, such that an airflow regulation structure will hereinafter be described and a detailed description of the remaining constituent elements of the indoor unit other than the airflow regulation structure will be omitted for convenience of description.

Figure 21:
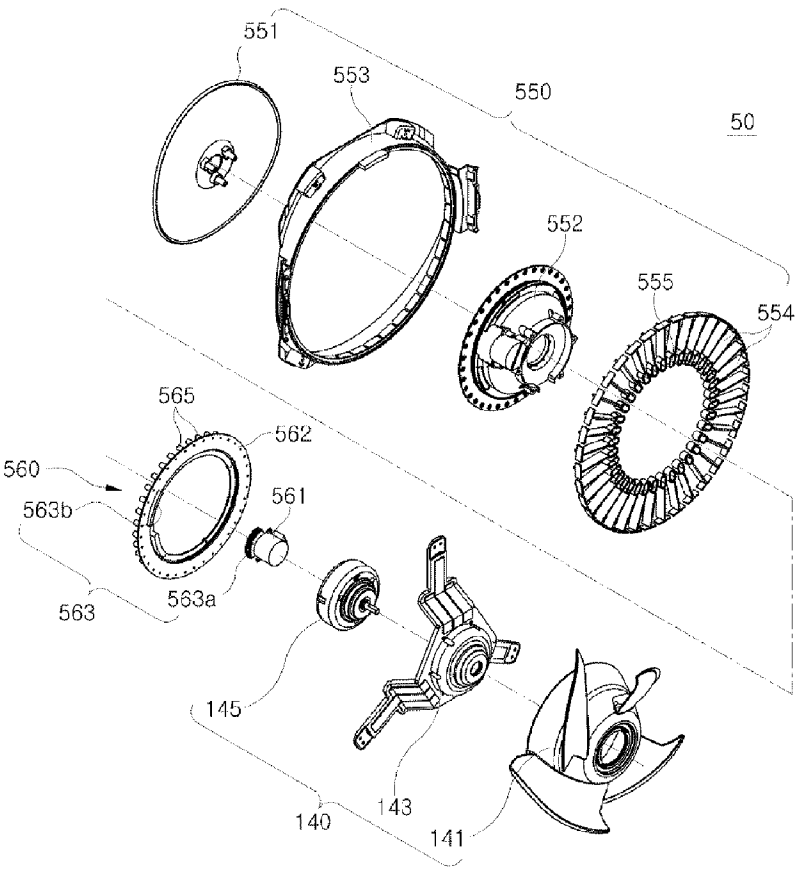
FIG. 21 is an exploded perspective view illustrating some parts of an indoor unit according to a fifth embodiment of the present disclosure.
Figure 22:
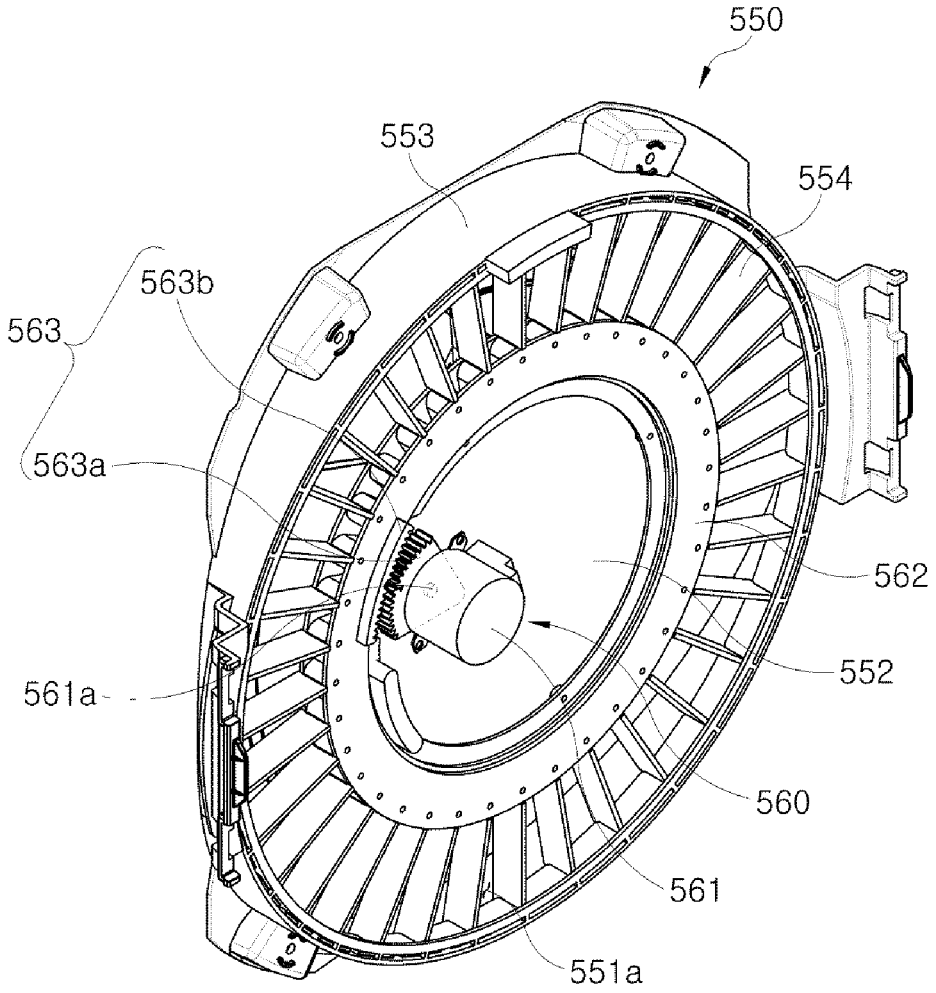
FIG. 22 is an assembled perspective view illustrating the indoor unit shown in FIG. 21.
Figure 23:
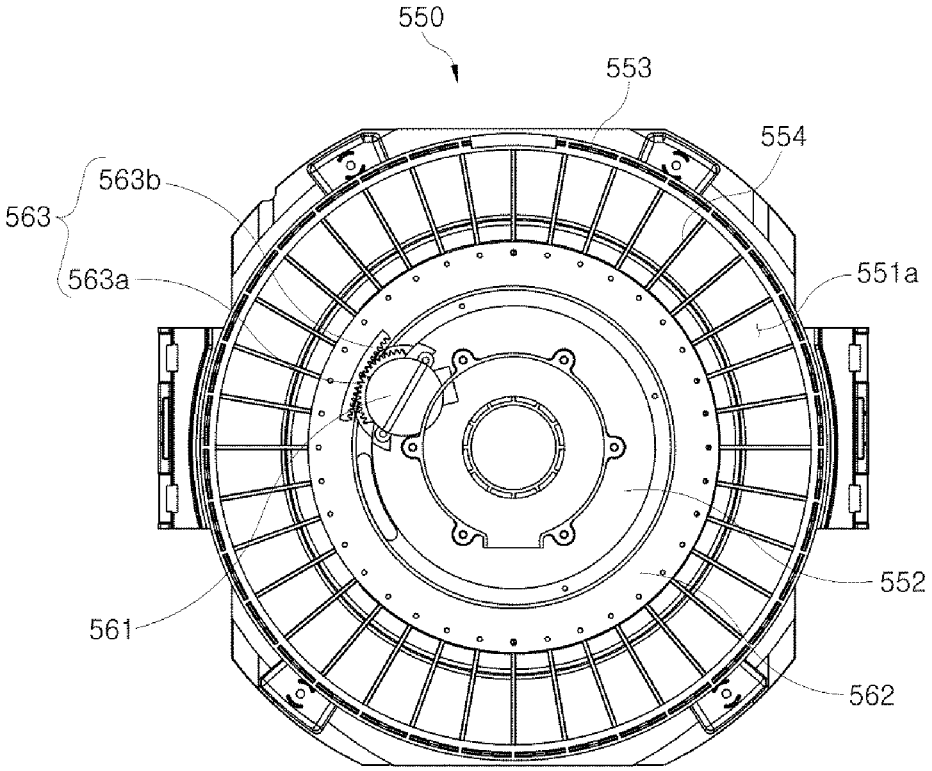
FIG. 23 is a rear view illustrating a diffuser assembly including an airflow regulator according to the fifth embodiment of the present disclosure.

FIG. 21 is an exploded perspective view illustrating some parts of an indoor unit according to a fifth embodiment of the present disclosure. FIG. 22 is an assembled perspective view illustrating the indoor unit shown in FIG. 21. FIG. 23 is a rear view illustrating a diffuser assembly including an airflow regulator according to the fifth embodiment of the present disclosure. For convenience of description, the same or similar structures as those described in the above-mentioned embodiments are denoted by the same reference numerals, and explanation thereof will be omitted herein.

Referring to FIGS. 21, 22, and 23, the diffuser assembly 550 contained in the indoor unit 50 according to the fifth embodiment may include a circular cover 551, a center panel 552 coupled to the cover 551, a grill 553 disposed at the outside of the radial direction of the center panel 552, and a blade 554 disposed between the center panel 552 and the grill 553 so as to direct the air blown from the fan 141. The blade 554 according to the fifth embodiment may be formed of a flexible material.

One end of the blade 554 may be movably installed, and the other end thereof may be fixed. The other end of the blade 554 may be coupled to the grill 553. A link hole 555 may be formed in one end of the blade 554. The link hole 555 may be disposed to connect to the circular link 562 to be described later. The operations of the blade 554 according to the operation of the circular link 562 will hereinafter be described.

The airflow regulator 560 may include a circular link 562 connected to one end of the blade 554 so as to simultaneously move the individual blades 554, a motor 561 configured to provide driving force to the circular link 562 to be rotated, and a gear unit 563 configured to transmit the driving force of the motor 561.

The circular link 562 may be rotatably coupled to the center panel 552. The circular link 562 may include a link shaft 565 inserted into the link hole 555 formed in the blade 554. The plurality of link shafts 565 may be spaced apart from each other by a predetermined distance. The link shaft 565 may protrude toward the center panel 552. A plurality of link shafts 565 may be provided to correspond to the plurality of link holes 555 formed in the plurality of blades 554.

If the circular link 562 rotates, one end of the blade 554 also moves along with the link shaft 565 by the link shaft 565, and the blade 554 may be modified to be curved in shape. According to the rotation direction of the circular link 562, the blade 554 may be curved in a direction opposite to the rotation direction of the fan 141 provided in the fan assembly 140. Alternatively, the blade 554 may be curved in the same direction as the rotation direction of the fan 141. As described above, the blade shape is changed in the rotation direction of the fan 141 or is changed in an opposite direction to the rotation direction, such that the direction of airflow discharged through the outlet 551*a* can be adjusted or regulated.

The gear unit 563 configured to transmit the driving force of the motor 561 to the circular link 562 so as to rotate the circular link 562 may include a drive gear 563*a* coupled to the motor shaft 561*a* of the motor 561, and an output gear 563*b* meshed with the drive gear 563*a*. The output gear 563*b* may be formed at an inner surface of the circular link 562. The output gear 563*b* may receive rotational force from the drive gear 563*a* so as to rotate the circular link 562. In order to restrict the movement distance of the circular link 562 rotating by the driving force of the motor 561, a stopper, a position sensor, or the like may be used as necessary.

The airflow regulation operation of the indoor unit 50 will hereinafter be described with reference to FIGS. 24 and 25.

Figure 24:
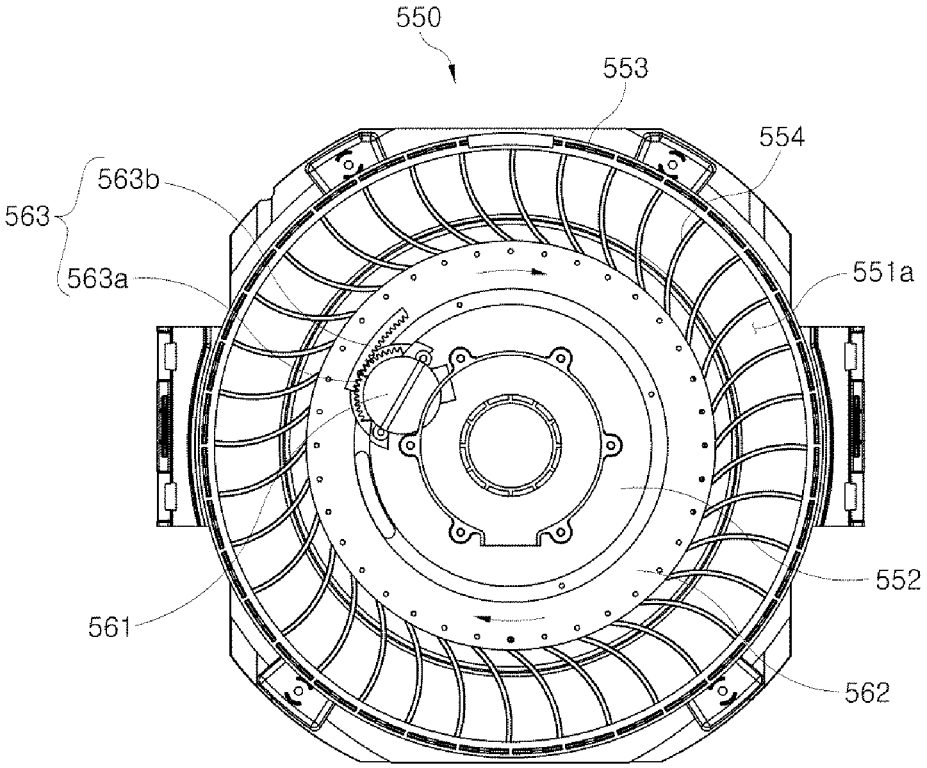
FIGS. 24 and 25 illustrate that a blade shape is changed by an airflow regulator according to the fifth embodiment of the present disclosure.
Figure 25:
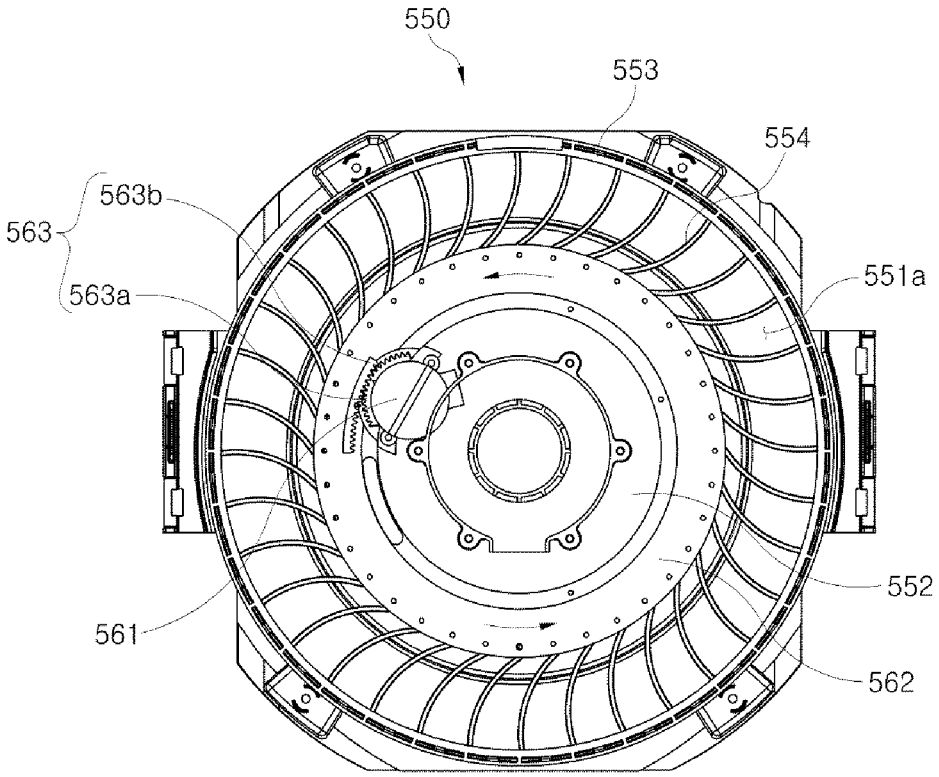

FIGS. 24 and 25 illustrate that a blade shape is changed by an airflow regulator according to the fifth embodiment of the present disclosure.

Figure 26:
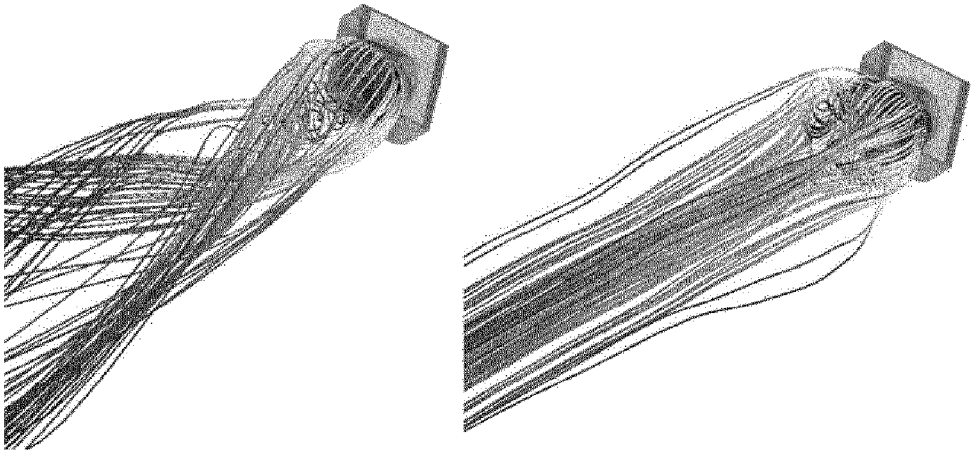
FIG. 26 illustrates the flow of discharged air changed by the airflow regulator according to the fifth embodiment of the present disclosure.

Referring to FIG. 24, if the circular link 562 rotates clockwise with respect to the cover 551, the blade 554 may be curved in a clockwise direction from the center panel 552 to the grill 553. In this case, the blade 554 may be curved in the same direction as the rotation direction of the fan 141. The air discharged from the fan 141 may be directed to the outlet 551*a* through the blade 554, so that a diffused airflow may be formed at the rear part, rather than at the front part as shown in FIG. 26 (*a*).

Referring to FIG. 25, if the circular link 562 rotates counterclockwise with respect to the cover 551, the blade 554 may be curved in a counterclockwise direction from the center panel 552 to the grill 553. In this case, the blade 554 may be curved in an opposite direction to the rotation direction of the fan 141. In this case, the blade 554 may disturb diffusion of the discharged air blown from the fan 141, so that the linear airflow may be discharged through the outlet 551*a* as shown in FIG. 26 (*b*).

As described above, the curved shape of the blade 554 may be changed in response to the rotation direction of the circular link 562, and the discharged airflow can also be changed in response to the curved shape of the blade 554.

Although the above-mentioned embodiment has exemplarily disclosed that one end of the blade 554 is coupled to the circular link 562 mounted to the center panel 552 so that the blade 554 is modified in shape, the scope or spirit of the modification structure of blade shape is not limited thereto, and all kinds of structures configured to change the shape of the blade 554 in response to a forward or reverse rotation can also be applied to the present disclosure without departing from the scope or spirit of the present disclosure.

For example, in one case in which the link shaft is formed in the blade 554 and a link hole in which the link shaft is inserted is formed in the circular link 562 so that the blade 554 is coupled to the circular link 562, or in the other case in which the circular link 562 having the link shaft 565 is rotatably installed at a formation position of the grill 553 such that the circular link 562 is coupled to each blade 554, the shape of the blade 554 can also be changed in response to rotation of the circular link 562.

Figure 27:
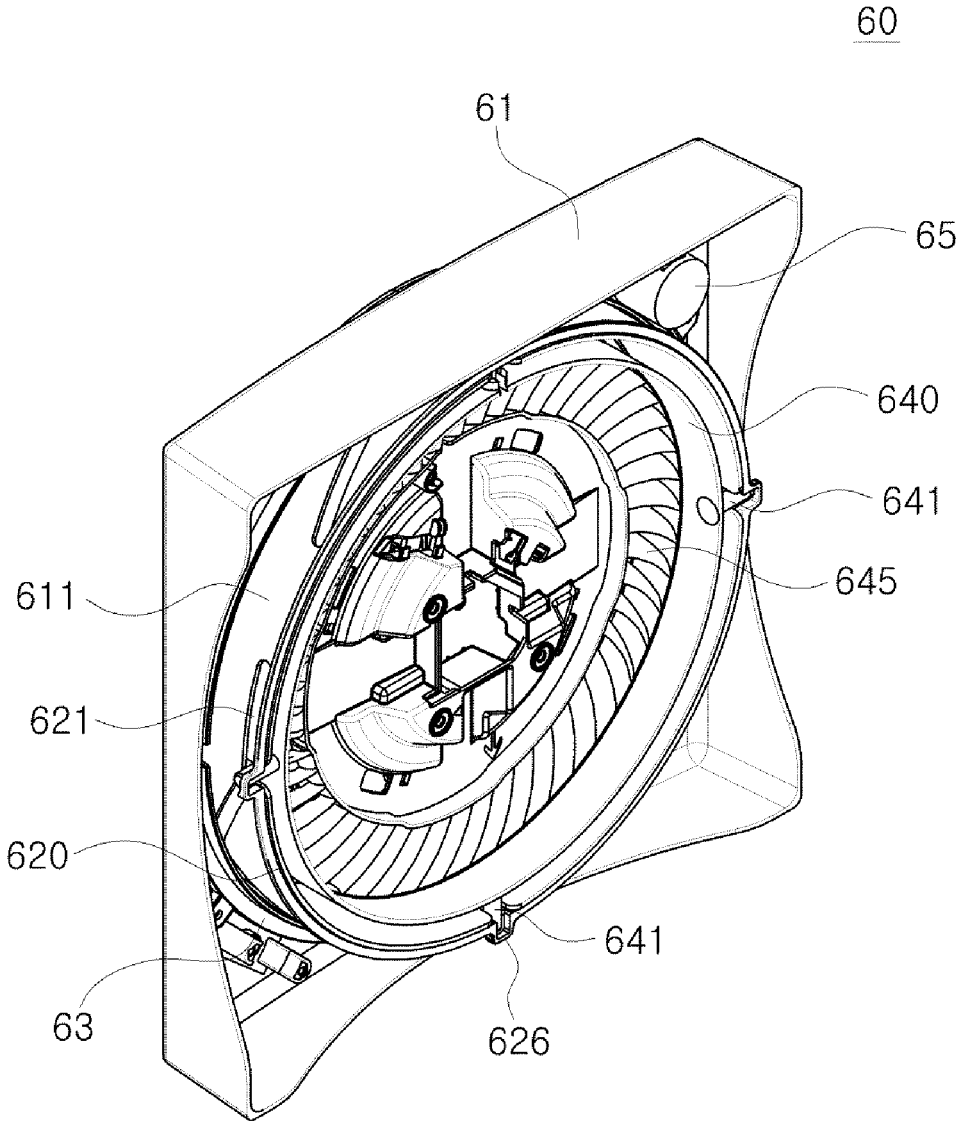
FIG. 27 is a perspective view illustrating an airflow regulator according to a sixth embodiment of the present disclosure.
Figure 28:
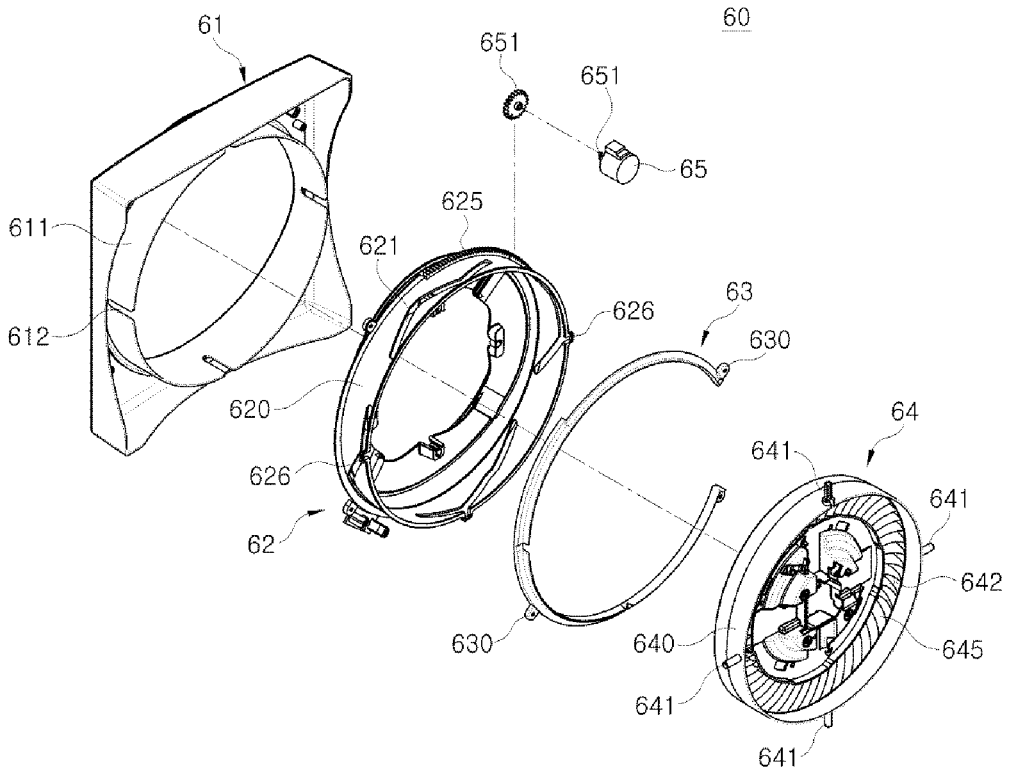
FIG. 28 is an exploded perspective view illustrating an airflow regulator according to the sixth embodiment of the present disclosure.
Figure 29:
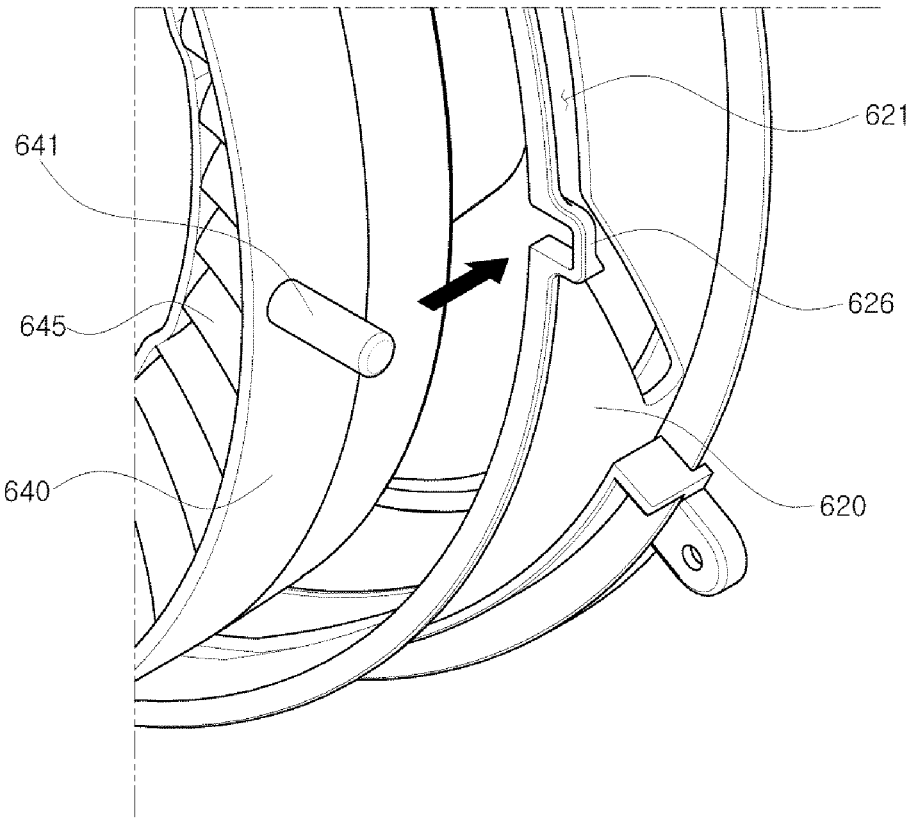
FIG. 29 is a view illustrating some parts of the airflow regulator according to the sixth embodiment of the present disclosure.

FIG. 27 is a perspective view illustrating an airflow regulator according to a sixth embodiment of the present disclosure. FIG. 28 is an exploded perspective view illustrating an airflow regulator according to the sixth embodiment of the present disclosure. FIG. 29 is a view illustrating some parts of the airflow regulator according to the sixth embodiment of the present disclosure.

Referring to FIGS. 27, 28, and 29, the airflow regulator 60 according to the sixth embodiment may include a fixed panel 61, a guide unit 62, and a diffuser assembly 64. The guide unit 62 may be rotatably coupled to a discharge unit 610 formed in the fixed panel 61. The guide unit 62 may be fixed to the fixed panel 61 by a fixed holder 63.

The fixed panel 61 may include the discharge unit 610 at the center part thereof. A side portion 611 protruding in forward and backward directions may be arranged in the vicinity of the discharge unit 610 in a manner that the side portion 611 can be arranged perpendicular to the surface at which the discharge unit 610 is formed. For example, the discharge unit 610 may be formed in a circular shape, and the side portion 611 may be extended along a peripheral part of the discharge unit 610. An insertion hole 612 in which a guide protrusion 641 to be described later can be inserted may be formed in at least one end of the side portion 611.

The guide unit 62 may enclose the outer surface of the side portion 611 of the fixed panel 61. For example, the shape of the guide unit 62 may be similar to a ring shape enclosing the side portion 611 of the fixed panel 61. The guide unit 62 may rotate upon receiving driving force from the motor 65. The driving force of the motor 65 may be transmitted to the guide unit 62 through the gear unit, so that the guide unit 62 can rotate. The gear unit may include an output gear 625 formed in some parts of the outer surface of the guide unit 62, and a drive gear 651 coupled to the motor shaft 650 of the motor 65. The output gear 625 may be meshed with the drive gear 651. The guide unit 62 may rotate clockwise or counterclockwise by the driving force of the motor 65.

A guide hole 621 having a predetermined shape may be formed in the guide unit 62. More specifically, in an embodiment, the guide hole 621 may be formed in the guide unit assembly 620. The guide protrusion 641 contained in the diffuser assembly 64 to be described later may be inserted into the guide hole 621. A plurality of guide holes 621 may be used such that the guide holes 621 may be spaced apart from each other by a predetermined distance. Each guide hole 621 may be formed in a curved shape.

The guide unit 62 may be mounted to the fixed panel 61 by the fixed holder 63. The fixed holder 63 may be formed to interfere with at least some parts of the guide unit 62. A coupling unit 630 may be provided in the fixed holder 63. The fixed holder 63 may be mounted to the fixed panel 61 by a coupling member configured to pass through the coupling unit 630.

The diffuser assembly 64 may be inserted into the guide unit 62. The diffuser assembly 64 may include a circular grill 640 shaped to correspond to an inner surface of the guide unit 62, a center panel coupled to a cover, and a plurality of blades 645 disposed between the grill 640 and the center panel 646 so as to direct the air blown from the fan. A discharge unit 641 may be disposed between the grill 640 and the center panel 646 in a manner that the air can be discharged through the discharge unit 642, and a plurality of blades 645 may be formed in the discharge unit 642 so as to direct the discharged air.

A guide protrusion 641 may be formed to protrude from the outer surface of the grill 640. A plurality of guide protrusions 641 may be used so that the guide protrusions 641 may be spaced apart from each other by a predetermined distance. For example, four guide protrusions 641 may be spaced apart from one another at intervals of 90° as shown in FIG. 28. Each guide protrusion 641 may be inserted into the guide hole 621 formed in the guide unit 62. The guide hole 621 may be shaped to correspond to the guide protrusion 641.

An elongated portion 625 in which a hole 625*a* corresponding to an elongated length of the guide protrusion 641 may be disposed at one side of the guide unit 62 in such a manner that the guide protrusion 641 can be easily inserted into the guide hole 621. The elongated portion 625 may be elongated to the outer side of the guide unit 62. The elongated portion 625 may be disposed at the front of the guide hole 621, and the hole 625*a* formed in the elongated portion 625 may interact with the guide hole 621. At least one guide protrusion 641 from among the guide protrusions 641 may pass through the hole 625*a* and then inserted into the guide hole 621. The elongated portion 625 may be disposed at the front of at least one guide hole 621 from among the plurality of guide holes 621.

Figure 30:
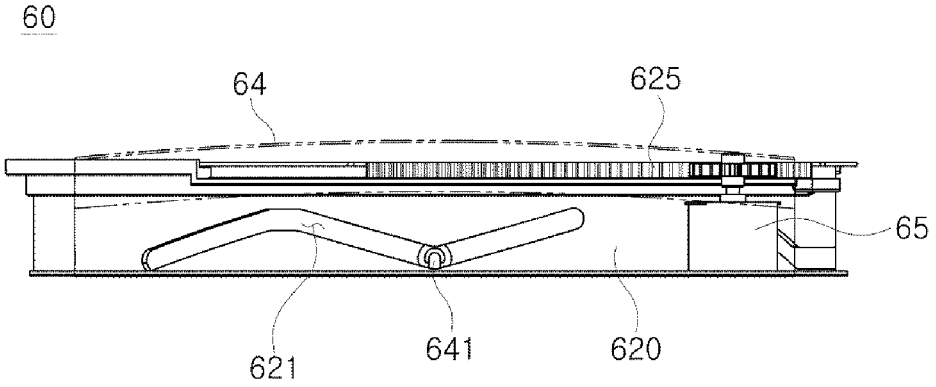
FIG. 30 is a side view illustrating the airflow regulator according to the sixth embodiment of the present disclosure.
Figure 31:
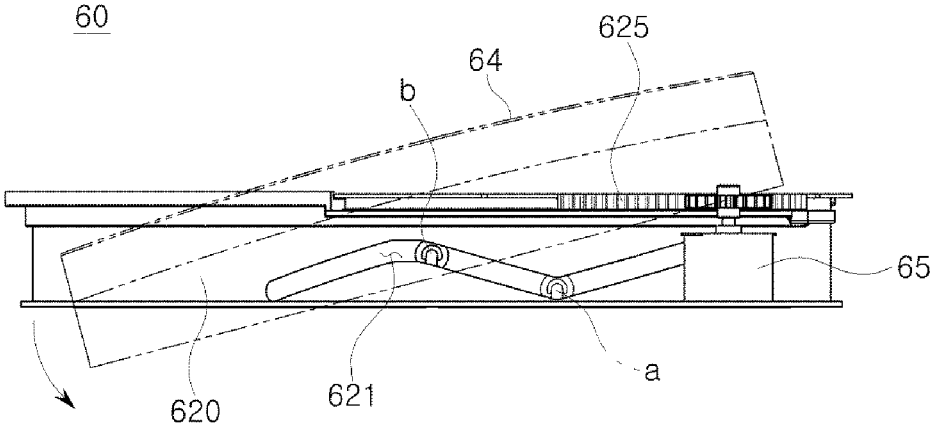
FIGS. 31 and 32 illustrate the operations of the airflow regulator according to the sixth embodiment of the present disclosure.
Figure 32:
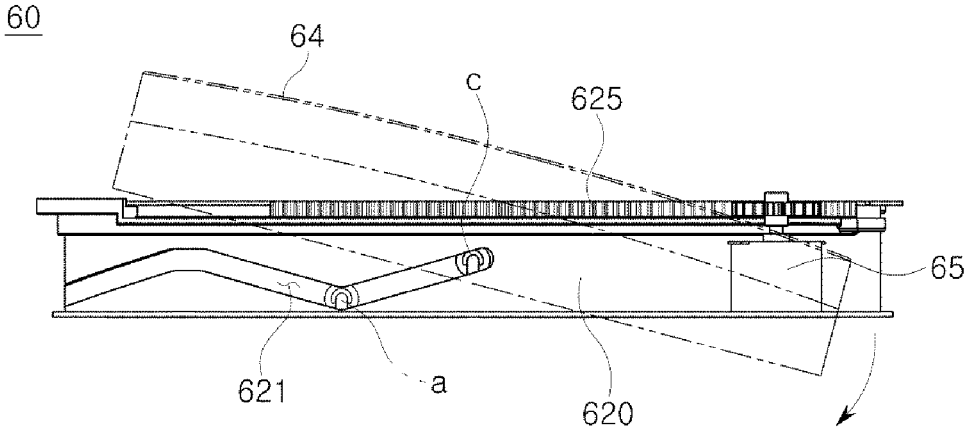

FIG. 30 is a side view illustrating the airflow regulator according to the sixth embodiment of the present disclosure. FIGS. 31 and 32 illustrate the operations of the airflow regulator according to the sixth embodiment of the present disclosure.

Referring to FIGS. 30, 31, and 32, the guide unit 62 according to the sixth embodiment may include a curved guide hole 621. If the guide unit 62 rotates by the driving force of the motor 64, the guide protrusion 641 inserted into the guide hole 621 may be pressurized in a specific direction by a side surface of the guide hole 621 due to the curved shape of the guide hole 621. Since the guide protrusion 641 is pressurized in the specific direction, the diffuser assembly 64 may rotate in a forward or backward direction or in a vertical or horizontal direction. The diffuser assembly 64 may rotate in a direction of various combinations due to the shape of the guide hole 621. As the curved angle of the guide hole 621 abruptly increases, the diffuser assembly 64 can be rapidly switched in direction.

For example, when the guide protrusion 632 is located at a first position (a) in the guide hole 621 shown in FIGS. 30, 31, and 32, the diffuser assembly 64 may be arranged to face forward. If the guide unit 62 rotates clockwise by the motor 65, the guide protrusion 641 may be located at a second position (b) of the guide hole 621. If the guide protrusion 641 moves from the first position (a) to the second position (b), the diffuser assembly 64 may rotate to the left.

Under the condition that the guide protrusion 641 is located at the first position (a), if the guide unit 62 rotates counterclockwise by the motor 65, the diffuser assembly 64 may be located at a third position (c) of the guide hole 621. If the guide protrusion 641 moves from the first position (a) to the third position (c), the diffuser assembly 64 may rotate to the right.

The rotation direction of the diffuser assembly 64 according to the present disclosure is not limited thereto. The diffuser assembly 64 may move in various combinations of directions (e.g., up and down directions, left and right directions, and forward and backward directions) according to the shape of the guide hole 621.

Figure 33:
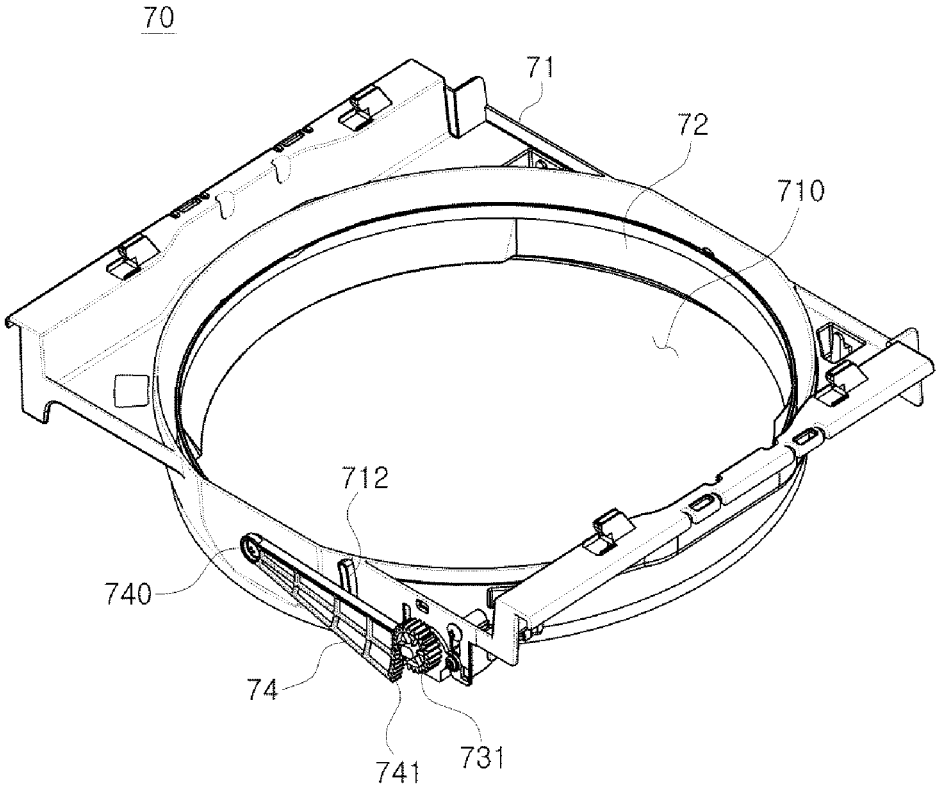
FIG. 33 is a perspective view illustrating an airflow regulator according to a seventh embodiment of the present disclosure.
Figure 34:
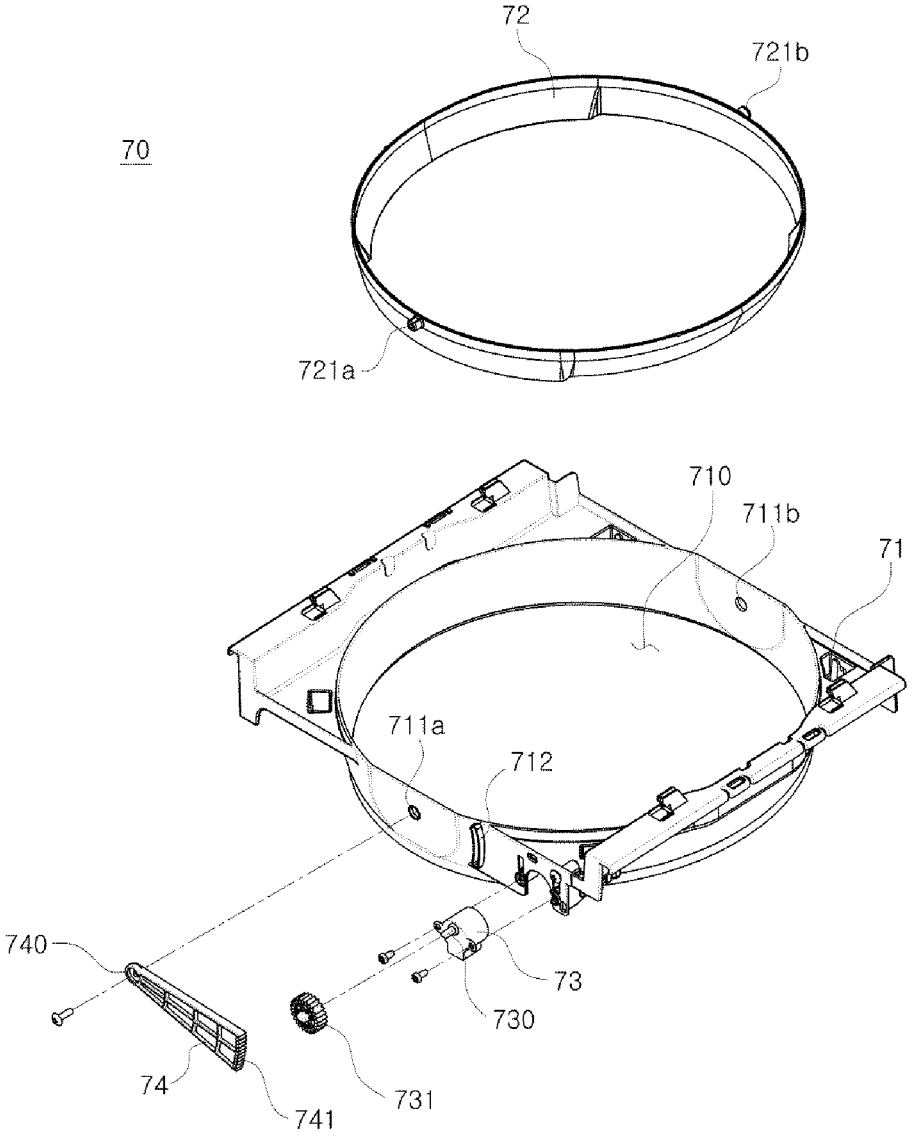
FIG. 34 is an exploded perspective view illustrating the airflow regulator according to the seventh embodiment of the present disclosure.

FIG. 33 is a perspective view illustrating an airflow regulator according to a seventh embodiment of the present disclosure. FIG. 34 is an exploded perspective view illustrating the airflow regulator according to the seventh embodiment of the present disclosure.

Referring to FIGS. 33 and 34, the airflow regulator 70 according to a seventh embodiment may include a guide blade 72 rotatably coupled to the fixed panel 71, and a motor 73 configured to provide driving force to the guide blade 72. The guide blade 72 may be mounted to the fixed panel 71. The guide blade 72 may be rotatably mounted to the discharge unit 710 of the fixed panel 71 such that the direction of airflow discharged through the discharge unit 710 can be changed.

The discharge unit 710 through which the air blown from the fan is discharged may be provided in the fixed panel 71. The guide blade 72 may be rotatably mounted to the inner surface of the fixed panel 71 configured to form the discharge unit 710. The guide blade 72 may be formed in a predetermined shape corresponding to the inner surface of the fixed panel 71 configured to form the discharge unit 710. For example, if the discharge unit 710 is formed in a circular shape, the guide blade 72 may be formed in a ring shape corresponding to the external diameter of the discharge unit 710.

Rotation protrusions (721*a*, 721*b*) may be formed in the guide blade 72. Holes (711*a*, 711*b*) in which the rotation protrusions (721*a*, 721*b*) are respectively inserted may be formed in the fixed panel. The rotation protrusions (721*a*, 721*b*) may include a first rotation protrusion 721*a* and a second rotation protrusion 721*b* arranged to face the first rotation protrusion 721*a*. The first rotation protrusion 721*a* and the second rotation protrusion 721*b* may be located at one straight line passing through the center point of the guide blade 72. The rotation protrusions (721*a*, 721*b*) may be rotatably inserted into the holes (711*a*, 711*b*).

A rotation link 74 may be coupled to at least one of the rotation protrusions (721*a*, 721*b*) provided in the guide blade 72. The rotation link 74 may rotate upon receiving the driving force from the motor 73. A coupling hole 740 in which the rotation protrusions (721*a*, 721*b*) can be inserted may be formed at one side of the rotation link 74, and an output gear 741 may be formed at the other side of the rotation link 74.

The coupling hole 720 and the rotation protrusions (721*a*, 721*b*) may be formed in other shapes other than the circular shape. For example, each of the coupling hole 740 and the rotation protrusions (721*a*, 721*b*) may be formed in a circular segment shape. Under the condition that the rotation protrusions (721*a*, 721*b*) are inserted into the coupling hole 740, if the rotation link 74 rotates, the rotation protrusions (721*a*, 721*b*) may rotate together with the rotation link 74. Therefore, if the rotation link 74 rotates, the guide blade 72 may rotate around the rotation protrusions (721*a*, 721*b*). The rotation link 74 may be coupled to the rotation protrusions (721*a*, 721*b*) by the coupling member.

The driving force of the motor 73 may be transferred to the rotation link 74 by the gear unit. The gear unit may include a drive gear 731 connected to the motor shaft 730 of the motor 73, and an output gear 741 disposed at one side of the rotation link 74. If the motor shaft 730 rotates clockwise or counterclockwise by the driving force of the motor 73, rotational force may be applied to the output gear 741 through the drive gear 731. If the rotational force is applied to the output gear 741, the rotation link 74 may rotate around the rotation protrusions (721*a*, 721*b*).

A guide unit 712 configured to guide movement of the rotation link 74 may be disposed at one side of the fixed panel 71. A guide protrusion (not shown) may be disposed at one surface of the rotation link 74, and the guide protrusion may be movable in the guide unit 712.

Figure 35:
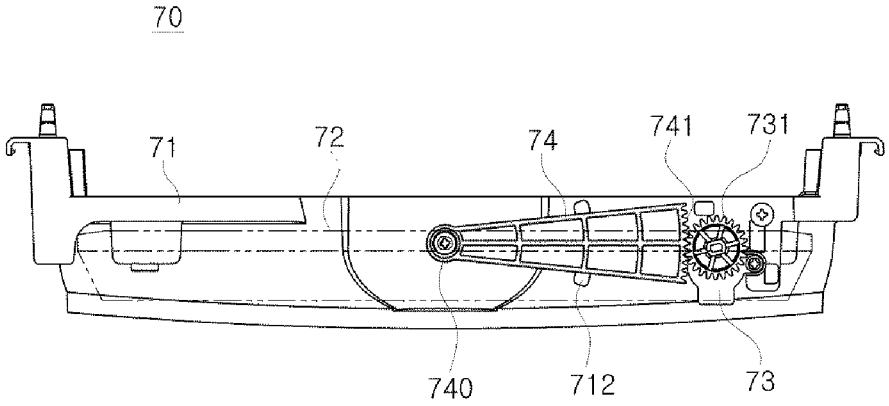
FIG. 35 is a side view illustrating the airflow regulator according to the seventh embodiment of the present disclosure.
Figure 36:
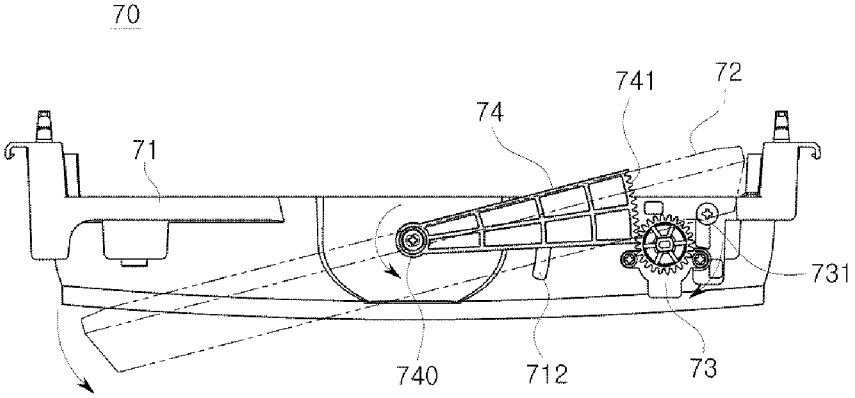
FIGS. 36 and 37 illustrate the operations of the airflow regulator according to the seventh embodiment of the present disclosure.
Figure 37:
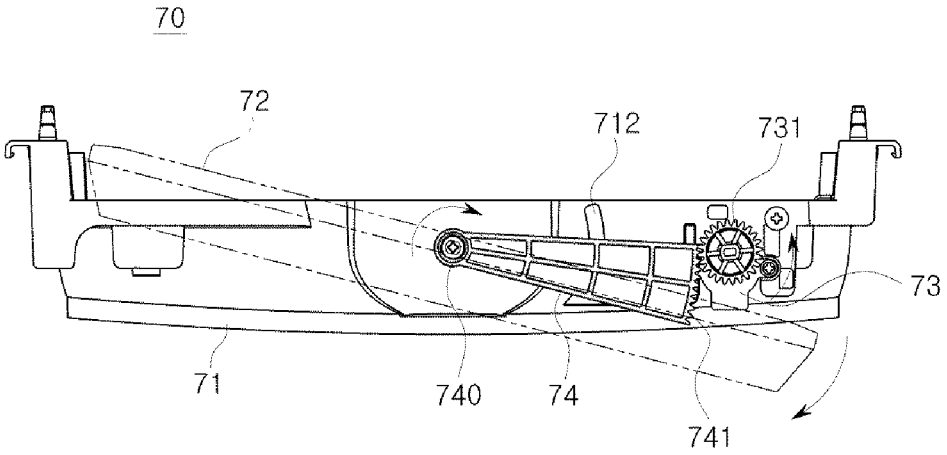

FIG. 35 is a side view illustrating the airflow regulator according to the seventh embodiment of the present disclosure. FIGS. 36 and 37 illustrate the operations of the airflow regulator according to the seventh embodiment of the present disclosure.

Referring to FIG. 35, the guide blade 72 according to the seventh embodiment may be arranged in a manner that the airflow is formed to face forward. As can be seen from FIG. 35, from the side viewpoint of the airflow regulator 70, the guide blade 72 may be arranged parallel to the fixed panel 71. The air blown by the fan assembly may be discharged in the forward direction of the discharge unit 710.

As can be seen from FIG. 36, the guide blade 72 rotates in a manner that the airflow discharged through the discharge unit 710 may be directed in the left front direction. The drive gear 731 may rotate counterclockwise by the driving force of the motor 73, and may receive the driving force through the output gear 741 meshed with the drive gear 731 such that the rotation link 74 can rotate clockwise on the basis of the rotation protrusions (721*a*, 721*b*). If the rotation protrusions (721*a*, 721*b*) rotate clockwise, the guide blade 72 may rotate in a manner that the airflow is directed in the left front direction of the discharge unit 710.

In FIG. 37, the guide blade 72 may rotate in a manner that the airflow discharged through the discharge unit 710 is directed in the right front direction. The drive gear 731 rotates clockwise by the driving force of the motor 73 and receives the driving force through the output gear 741 meshed with the drive gear 731, such that the rotation link 74 may rotate counterclockwise on the basis of the rotation protrusions (721*a*, 721*b*). If the rotation protrusions (721*a*, 721*b*) rotate counterclockwise, the guide blade 72 may rotate in a manner that the airflow is directed in the right front direction of the discharge unit 710.

As described above, the guide blade 72 formed in the discharge unit 710 rotates around the rotation protrusions (721*a*, 721*b*), such that the direction of airflow discharged through the discharge unit 710 can be changed. Although the above-mentioned embodiment has exemplarily disclosed that the airflow is changed in a horizontal direction by the guide blade 72 for convenience of description, the position of the rotation protrusions (721*a*, 721*b*) formed in the guide blade 72 is properly changed such that the airflow can be changed in various ways.

Figure 38:
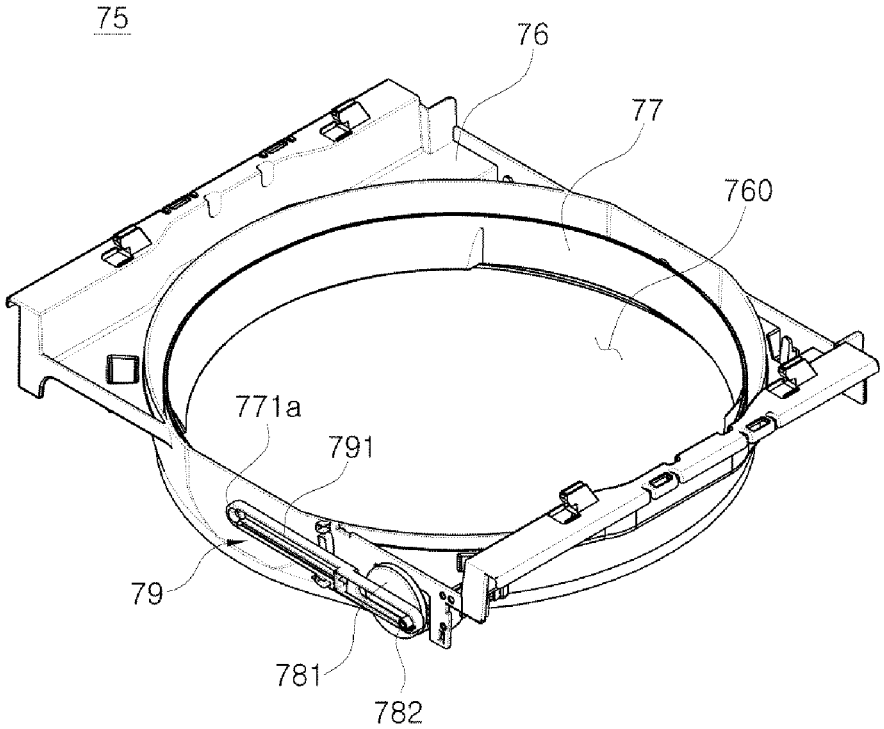
FIG. 38 is a perspective view illustrating an airflow regulator according to an eighth embodiment of the present disclosure.
Figure 39:
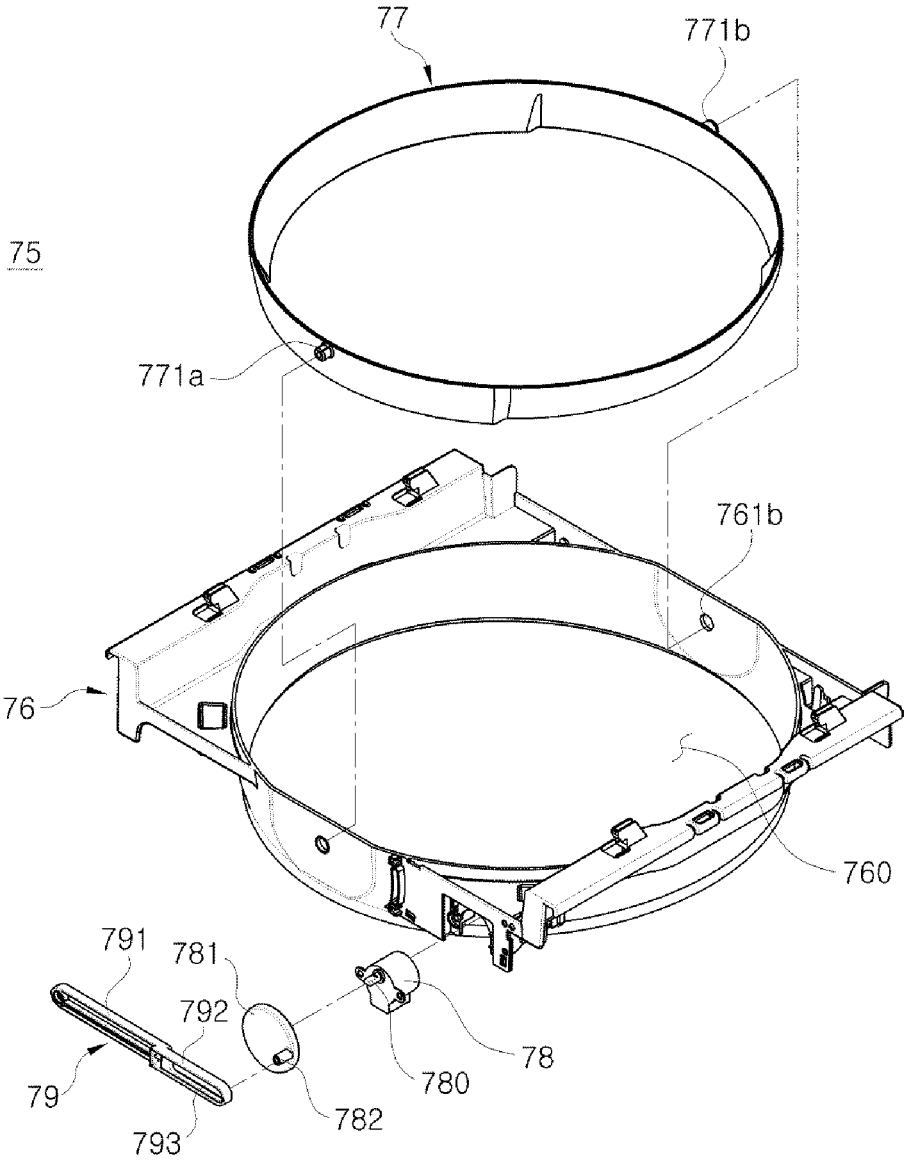
FIG. 39 is an exploded perspective view illustrating the airflow regulator according to the eighth embodiment of the present disclosure.

FIG. 38 is a perspective view illustrating an airflow regulator according to an eighth embodiment of the present disclosure. FIG. 39 is an exploded perspective view illustrating the airflow regulator according to the eighth embodiment of the present disclosure.

Referring to FIGS. 38 and 39, the airflow regulator 75 according to the eighth embodiment may include a guide blade 77 rotatably coupled to the discharge unit 760. The guide blade 77 may be rotatably coupled to one side of the discharge unit 760 formed in the fixed panel, such that the airflow discharged through the discharge unit 760 can be changed.

Compared to the airflow regulator 70 of the seventh embodiment, the airflow regulator 75 according to the eighth embodiment may be configured in a manner that the driving force of the motor 78 is transferred to the guide blade 77 in a different way from the seventh embodiment, and may be configured in a manner that the guide blade 77 is rotatably coupled to the fixed panel 76 in a similar way to the seventh embodiment.

The discharge unit 760 through which the air blown from the fan is discharged may be formed in the fixed panel 76. The guide blade 77 may be rotatably mounted to an inner wall of the fixed panel 76 configured to form the discharge unit 760. The guide blade 77 may be shaped to correspond to the inner surface of the fixed panel 76 configured to form the discharge unit 760. If the discharge unit 76 is formed in a circular shape, the guide blade 77 may be formed in a ring shape corresponding to the external diameter of the discharge unit 760.

Rotation protrusions (771*a*, 771*b*) may be included in the guide blade 77. Holes (761*a*, 761*b*) in which the rotation protrusions (771*a*, 771*b*) may be inserted may be formed in the fixed panel 76. The rotation protrusions (771*a*, 771*b*) may include a first rotation protrusion 771*a* and a second rotation protrusion 771*b* arranged to face the first rotation protrusion 771*a*. The first rotation protrusion 771*a* and the second rotation protrusion 771*b* may be located on a straight line passing through the center point of the guide blade 77. The rotation protrusions (771*a*, 771*b*) may be rotatably inserted into the rotation protrusions (761*a*, 761*b*).

At least one of the rotation protrusions (771*a*, 771*b*) contained in the guide blade 77 may be mounted to the link member 79. The link member 79 may rotate upon receiving the driving force from the motor 78. The rotation protrusions (771*a*, 771*b*) are coupled to the link member 79 so that the rotation protrusions (771*a*, 771*b*) can rotate along with the link member 79.

The link member 79 may include a first link 791 coupled to the rotation protrusions (771*a*, 771*b*) and a second link 792 elongated from the first link 791. A link hole 793 elongated along the extension direction of the second link 792 may be formed in the second link 792.

A rotation plate 781 may be mounted to the motor shaft 780. The rotation plate 781 is connected to the motor shaft 780 so that the rotation plate 781 can rotate along with the motor shaft 780. A guide protrusion 782 may protrude from one side of the rotation plate 781. The rotation plate 781 may be formed in a circular shape, and the guide protrusion 782 may be arranged to have eccentricity from the center point of the rotation plate 781.

The guide protrusion 782 may be inserted into the link hole 783. If the rotation plate 781 rotates by the driving force of the motor 78, the guide protrusion 782 may move along the link hole 792. Since the guide protrusion 782 moves along the link hole 792, the inner surface of the second link 792 configured to form the link hole 793 may be pressurized by the guide protrusion 782. Since the second link 792 is pressurized, the link member 79 may rotate around the rotation protrusions (771*a*, 771*b*). The guide blade 77 as well as the link member 79 may rotate around the rotation protrusions (771*a*, 771*b*). As a result, the direction of airflow may be changed by the guide blade 77.

Figure 40:
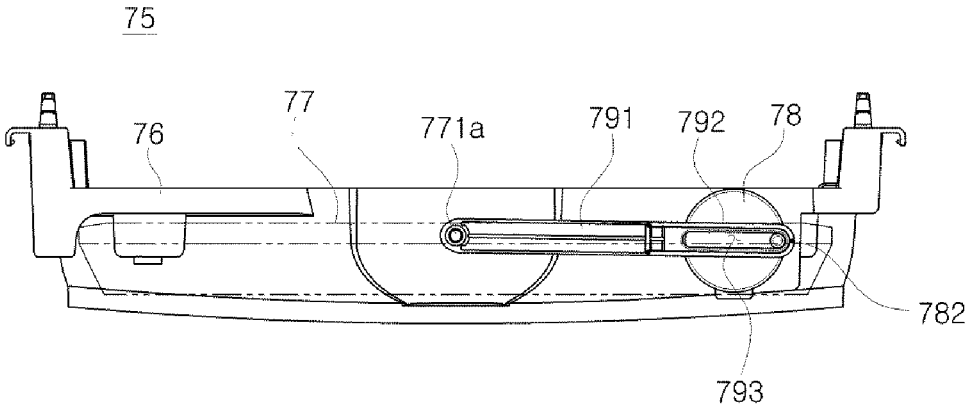
FIG. 40 is a side view illustrating the airflow regulator according to the eighth embodiment of the present disclosure.
Figure 41:
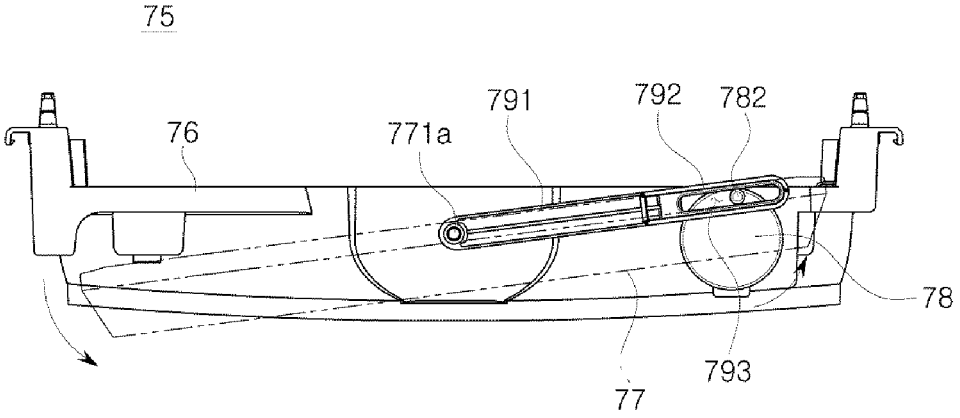
FIGS. 41 and 42 illustrate the operations of the airflow regulator according to the eighth embodiment of the present disclosure.
Figure 42:
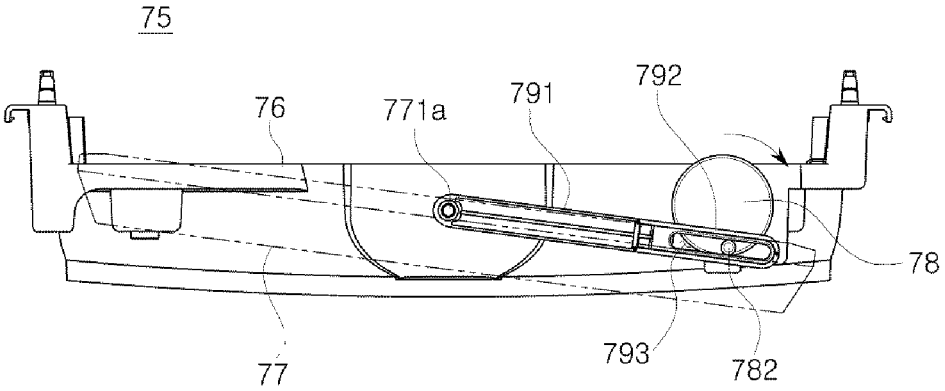

FIG. 40 is a side view illustrating the airflow regulator according to the eighth embodiment of the present disclosure. FIGS. 41 and 42 illustrate the operations of the airflow regulator according to the eighth embodiment of the present disclosure.

Referring to FIG. 40, the guide blade 77 according to the eighth embodiment may be arranged in a manner that the airflow is directed in the forward direction of the discharge unit 760. As can be seen from FIG. 40, from the side viewpoint of the airflow regulator 75, the guide blade 77 may be arranged parallel to the fixed panel 76. The air blown by the fan assembly may be discharged in the forward direction of the discharge unit 760. Here, in the case of using the airflow regulator 75 located at the first rotation protrusion 771*a*, the guide protrusion 782 may be located at the farthest position from the first rotation protrusion 771*a* within the link hole 793.

As can be seen from FIG. 41, the guide blade 77 may rotate in a manner that the airflow discharged through the discharge unit 760 can be directed in the right front direction. As shown in FIG. 40, under the condition that the guide protrusion 782 is located farthest from the first rotation protrusion 771*a*, if the rotation plate 781 rotates counterclockwise by the motor 78, the distance between the guide protrusion 782 and the first rotation protrusion 771*a* may be reduced.

The guide protrusion 782 rotates and at the same time pressurizes the inner surface of the link hole 793, such that the link member 79 can rotate counterclockwise on the basis of the first rotation protrusion 771*a*. If the link member 79 rotates counterclockwise, the guide blade 77 coupled to the link member 79 may also rotate counterclockwise. Since the guide blade 77 rotates counterclockwise, the air blown from the fan may be discharged to the right front direction through the discharge unit 760.

Referring to FIG. 42, the guide blade 77 may rotate in a manner that the air discharged through the discharge unit 760 is directed in the left front direction. As shown in FIG. 40, under the condition that the guide protrusion 782 is located farthest from the first rotation protrusion 771*a*, if the rotation plate 781 rotates clockwise by the motor 78, the distance between the guide protrusion 782 and the first rotation protrusion 771*a* may be reduced.

The guide protrusion 782 rotates and at the same time pressurizes the inner surface of the link hole 793, such that the link member 79 can rotate clockwise on the basis of the first rotation protrusion 771*a*. If the link member 79 rotates clockwise, the guide blade 77 coupled to the link member 79 may also rotate clockwise. Since the guide blade 77 rotates clockwise, the air blown from the fan may be discharged in the left front direction through the discharge unit 760.

Figure 43:
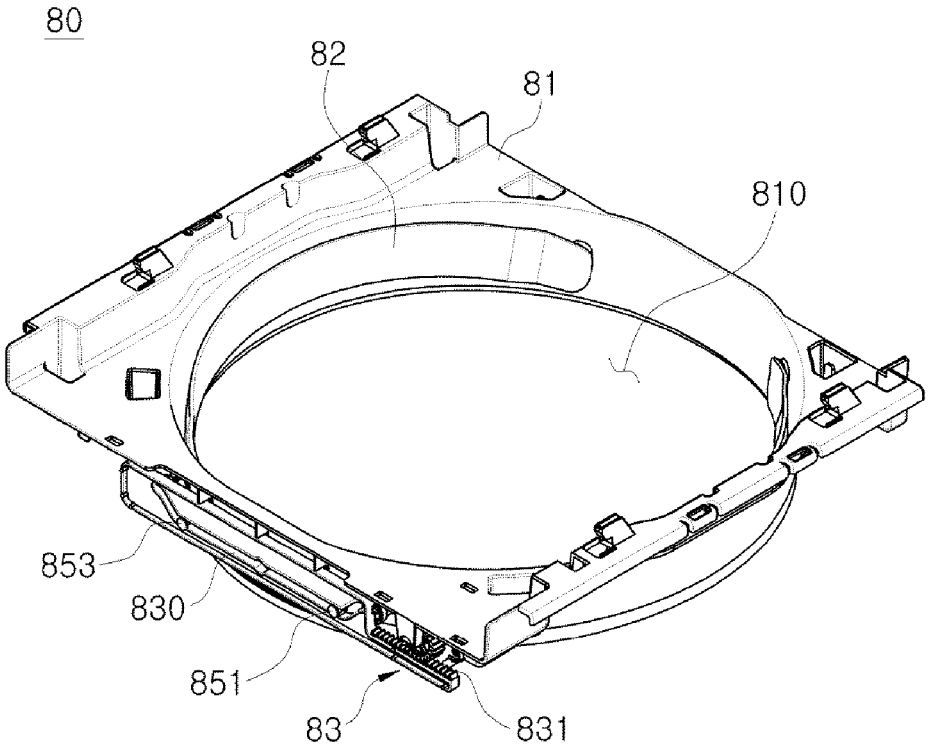
FIG. 43 is a perspective view illustrating an airflow regulator according to a ninth embodiment of the present disclosure.
Figure 44:
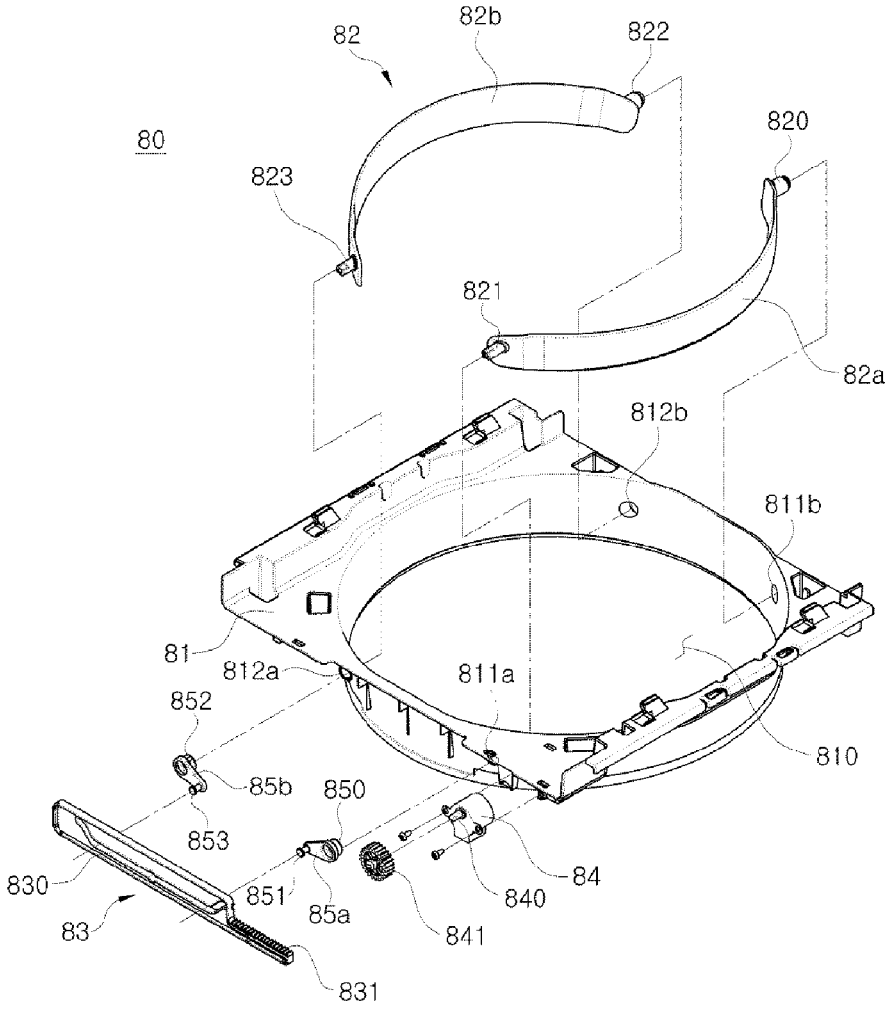
FIG. 44 is an exploded perspective view illustrating the airflow regulator according to the ninth embodiment of the present disclosure.

FIG. 43 is a perspective view illustrating an airflow regulator according to a ninth embodiment of the present disclosure. FIG. 44 is an exploded perspective view illustrating the airflow regulator according to the ninth embodiment of the present disclosure.

Referring to FIGS. 43 and 44, the airflow regulator 80 according to the ninth embodiment may include a guide blade 82 rotatably mounted to the discharge unit 710. The guide blade 82 may be directed by the holder blade 83 driven by the motor 84 such that the guide blade 82 can rotate. The guide blade 82 may be shaped to correspond to the inner surface of the fixed panel 81 configured to form the discharge unit 810.

If the discharge unit 810 is formed in a circular shape, the guide blade 82 may be formed in one ring shape corresponding to the shape of the discharge unit 810. As can be seen from FIG. 43, the guide blade 82 may include a first guide blade 82*a* and a second guide blade 82*b*, each of which has a shape corresponding to some parts of the ring. The embodiment in which the guide blade 82 includes the first guide blade 82*a* and the second guide blade 82*b* will hereinafter be described with reference to the attached drawings.

The discharge unit 810 may be formed in the fixed panel 81, and the guide blade 82 may be rotatably mounted to the inside of the discharge unit 810. Rotation protrusions (820, 821, 822, 823) may protrude from at least one end of the guide blade 82, and rotation holes (811*a*, 811*b*,812*a*, 812*b*) in which the rotation protrusions (820, 821,822,823) are inserted may be formed in the fixed panel 81.

For example, the first rotation protrusion 820 and the second rotation protrusion 821 may respectively protrude from one end and the other end of the first guide blade 82*a*. The first rotation protrusion 820 and the second rotation protrusion 821 may be rotatably inserted into the first rotation hole 811*a* and the second rotation hole 811*b* formed in the fixed panel 81, respectively.

The third rotation protrusion 822 and the fourth rotation protrusion 823 may respectively protrude from one end and the other end of the second guide blade 82*b*. The third rotation protrusion 822 and the fourth rotation protrusion 823 may be rotatably inserted into the third rotation hole 812*a* and the fourth rotation hole 812*b* formed in the fixed panel 81, respectively.

One exemplary case in which the holder blade 83 is disposed at one side of the fixed panel 81 in which the second rotation protrusion 821 of the first guide blade 82*a* and the fourth rotation protrusion 823 of the second guide blade 82*b* are located, will hereinafter be described.

The guide blade 82 may rotate by the holder blade 83 configured to receive the driving force from the motor 84. A guide hole 830 may be formed in the holder blade 83. In more detail, a rack gear unit 831 may be disposed at one side of the holder blade 83, and a curved guide hole 830 may be disposed at the other side of the holder blade 83.

The holder blade 83 may be coupled to the guide blade 82 by a guide member 85. The guide member 85 may include a first guide member 85*a* and the second guide member 85*b*. The first guide member 85*a* may be mounted to the second rotation protrusion 821, and the second guide member 85*b* may be mounted to the fourth rotation protrusion 823.

A first coupling unit 850 to which the second rotation protrusion 821 can be mounted may be disposed at one side of the first guide member 85*a*. The second rotation protrusion 821 may be coupled to the first coupling unit 850 such that the first guide member 85*a* and the first guide blade 82*a* can simultaneously move. The first guide protrusion 851 may protrude from the other end of the first guide member 75*a*. The first guide member 851 may be inserted into the guide hole 830.

Similarly, the second coupling unit 852 to which the fourth rotation protrusion 823 can be mounted may be disposed at one side of the second guide member 85*b*, and the second guide protrusion 853 may protrude from the other side of the second guide member 85*b*. The fourth rotation protrusion 823 may be coupled to the second coupling unit 852 such that the second guide member 85*b* and the second guide blade 82*b* can simultaneously move. The second guide protrusion 853 may be inserted into the guide hole 830.

A drive gear 841 may be mounted to the motor shaft 840 configured to rotate by the driving force of the motor 84. The drive gear 841 may be meshed with the rack gear 831 formed in the holder blade 83. The driving force of the motor 84 may be applied to the holder blade 83 through the drive gear 841 and the rack gear 831. The rotational force of the drive gear 841 may be applied to the rack gear 831 so that the holder blade 83 can perform rectilinear movement in a horizontal direction.

If the holder blade 83 performs rectilinear movement in a horizontal direction, the first guide protrusion 851 and the second guide protrusion 853 inserted into the guide hole 830 may be pressurized by the inner wall of the guide hole 830 due to the curved shape of the guide hole 830, and the first guide member 85*a* or the second guide member 85*b* may rotate by a predetermined angle due to the occurrence of the pressing force. If the first guide member 85*a* or the second guide member 85*b* rotates, the first guide blade 82*a* or the second guide blade 82*b* may rotate by a predetermined angle.

The operation for changing the airflow by rotating the guide blade 82 by the rectilinear movement of the holder blade 83 will hereinafter be described in detail.

Figure 45:
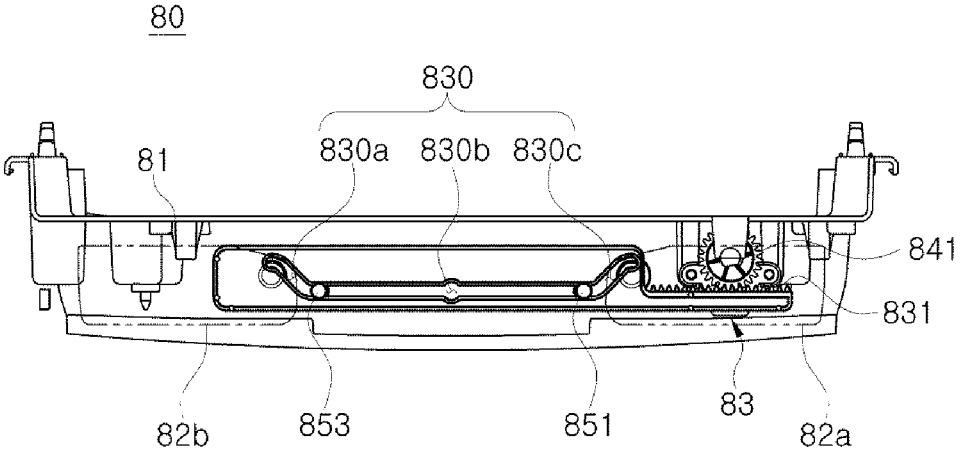
FIG. 45 is a side view illustrating the airflow regulator according to the ninth embodiment of the present disclosure.

FIG. 45 is a side view illustrating the airflow regulator according to the ninth embodiment of the present disclosure.

Figure 46:
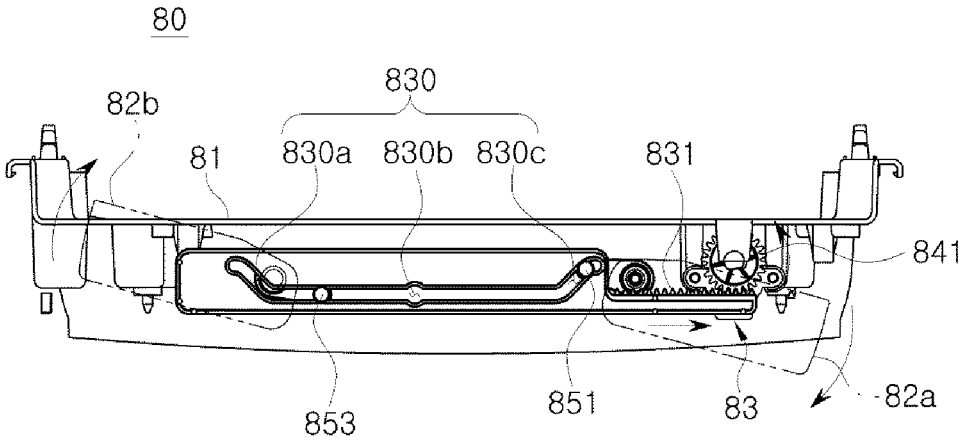
FIGS. 46 and 47 illustrate the operations of the airflow regulator according to the ninth embodiment of the present disclosure.
Figure 47:
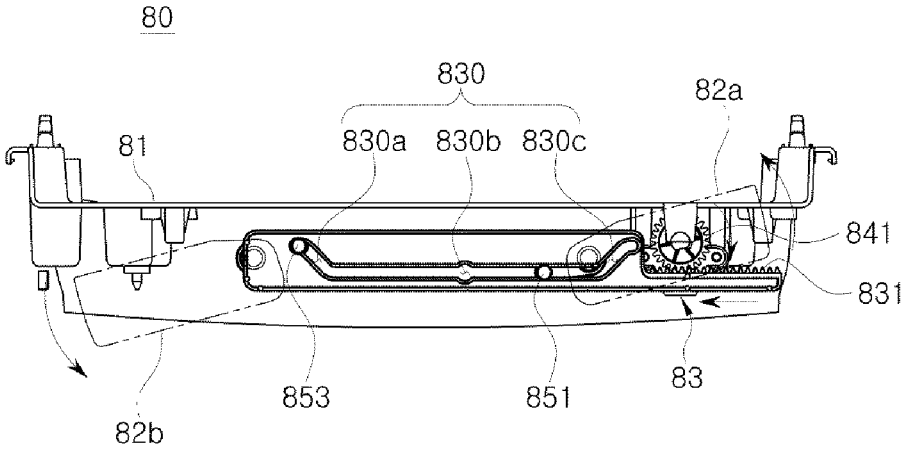

FIGS. 46 and 47 illustrate the operations of the airflow regulator according to the ninth embodiment of the present disclosure.

Referring to FIG. 45, the guide hole 830 may include a first curved section 830*a*, a linear section 830*b*, and a second curved section 830*b*. The first curved section 830*a* may be curved from the linear section 830*b* so that the first curved section 830*a* may be extended in the left rear direction. The second curved section 830*c* may be curved from the linear section 830*b* so that the second curved section 830*c* may be extended in the right rear direction.

Referring to FIG. 45, if the guide blade 82 is arranged parallel to the fixed panel 81 in a manner that the air discharged through the discharge unit 810 can be discharged to the forward direction, the first guide protrusion 851 and the second guide protrusion 853 may be located in the linear section 830*b*.

Referring to FIG. 46, since the holder blade 83 moves to the right by the motor 84, the second guide blade 82*b* may rotate counterclockwise. The air blown from the fan may be directed in the right front direction by the second guide blade 82*b*.

The drive gear 841 may rotate counterclockwise by the driving force of the motor 84, and the holder blade 83 may move to the right by the rack gear 831 meshed with the drive gear 841. If the holder blade 83 moves to the right, the second guide protrusion 853 located in the linear section 830*b* may move to the first curved section 830*a*.

Since the second guide protrusion 853 moves from the linear section 830*b* to the first curved section 830*a*, the second guide member 85*b* may rotate counterclockwise on the basis of the fourth rotation protrusion 853. The fourth rotation protrusion 853 may rotate counterclockwise along with the second guide member 85*b*, and the second guide blade 82*b* may also rotate counterclockwise along with the fourth rotation protrusion 853. The second guide blade 82*b* may rotate counterclockwise, so that the air blown from the fan may be directed in the right front direction through the discharge unit 810.

In this case, although the second guide protrusion 853 moves to the first curved section 830*a*, the first guide protrusion 851 is still located in the linear section 830*b*, so that only the position within the linear section 830*b* may be changed. The first guide member 85*a* may not rotate, and the first guide blade 82*a* connected to the first guide member 85*a* may also not rotate.

As described above, if the holder blade 83 moves to the right, the first guide blade 82*a* does not rotate and allows the air to be discharged to the forward direction, and only the second guide blade 82*b* rotates counterclockwise so that the air discharged through the discharge unit 810 can be directed in the right front direction.

Referring to FIG. 47, if the holder blade 83 moves to the left by the driving force of the motor 84, the first guide blade 82*a* rotates clockwise. For convenience of description and better understanding of the present disclosure, it is assumed that the holder blade 83 moves to the left with respect to the position shown in FIG. 45. The air blown from the fan may be directed in a manner that the air can be discharged to the right front direction by the first guide blade 82.

The drive gear 841 may rotate clockwise by the driving force of the motor 84. The holder blade 83 may move to the left by the rack gear meshed with the drive gear 841. Since the holder blade 83 moves to the left, the first guide protrusion 851 located in the linear section 830*b* may move to the second curved section 830*c*. Since the first guide protrusion 851 moves from the linear section 830*b* to the second curved section 830*c*, the first guide member 85*a* may rotate clockwise on the basis of the second rotation protrusion 851. The second rotation protrusion 851 may rotate clockwise along with the first guide member 85*a*, and the first guide blade 82*a* may rotate clockwise along with the second rotation protrusion 851. The first guide blade 82*a* may rotate clockwise such that the air blown from the fan may be directed in the left front direction through the discharge unit 810.

In this case, although the first guide protrusion 851 moves to the second curved section 830*c*, the second guide protrusion 853 is still located in the linear section 830*b*, so that only the position within the linear section 830*b* may be changed. The second guide member 85*b* may not rotate, and the second guide blade 82*b* connected to the second guide member 85*b* may not rotate.

As described above, if the holder blade 83 moves to the left, the second guide blade 82*b* does not rotate and allows the air to be discharged to the forward direction, and only the first guide blade 82*a* rotates clockwise so that the air discharged through the discharge unit 810 may be directed in the left front direction.

Although the above-mentioned embodiment has exemplarily disclosed that the discharged air is directed either in the left front direction or in the right front direction by the guide blade for convenience of description and better understanding of the present disclosure, the scope or spirit of the present disclosure is not limited thereto, and the position of the rotation protrusion used as the rotation shaft of the guide blade is changed to another position such that the discharged air can be directed in various ways.

Figure 48:
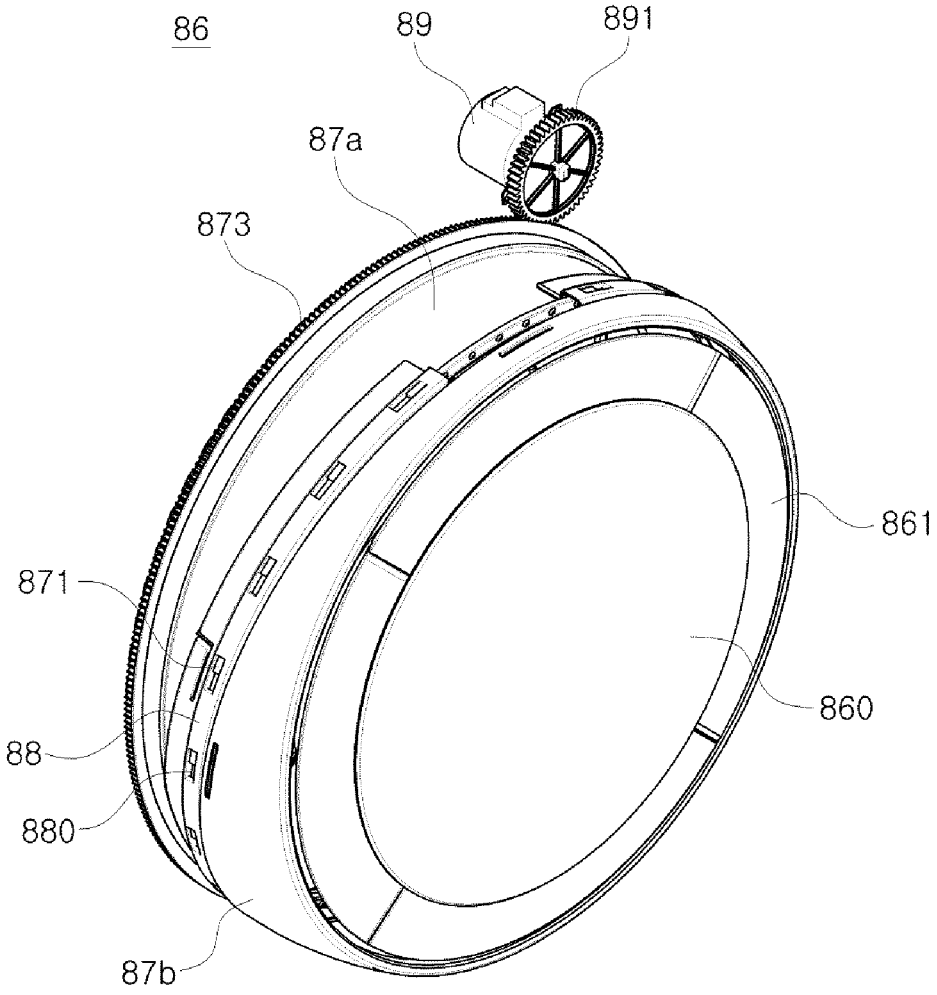
FIG. 48 is a perspective view illustrating an airflow regulator according to a tenth embodiment of the present disclosure.
Figure 49:
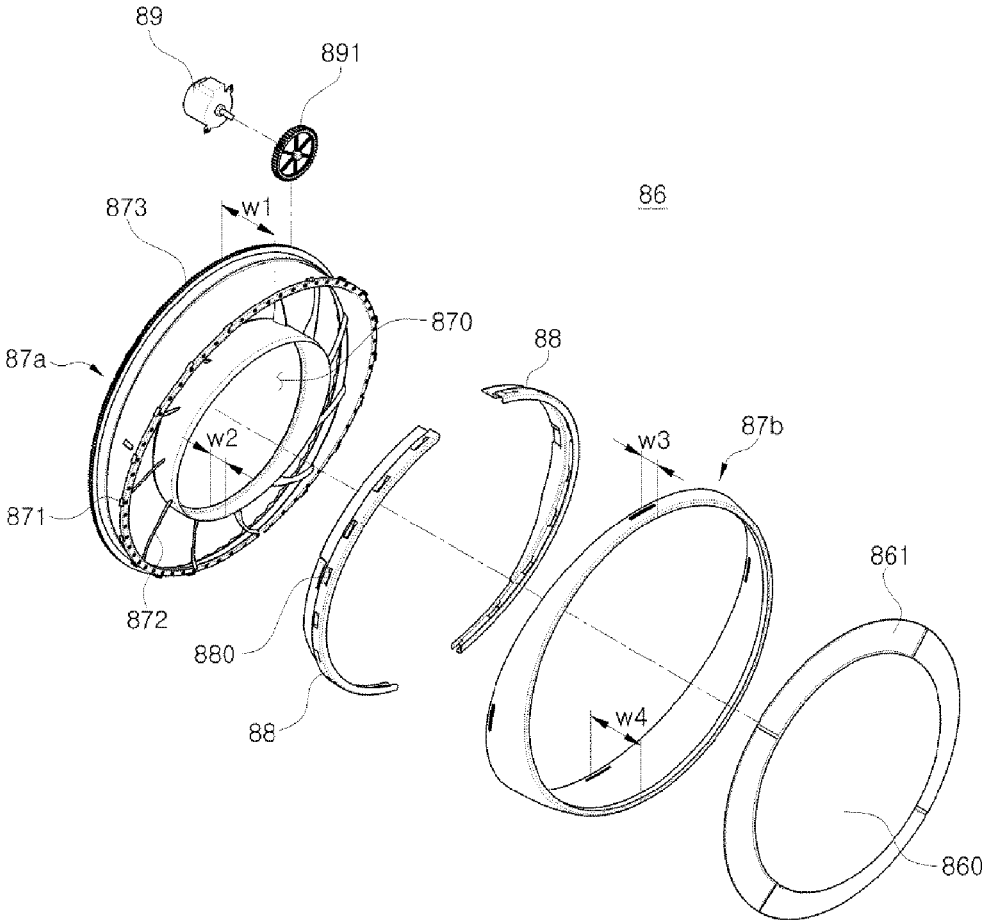
FIG. 49 is an exploded perspective view illustrating the airflow regulator according to the tenth embodiment of the present disclosure.

FIG. 48 is a perspective view illustrating an airflow regulator according to a tenth embodiment of the present disclosure. FIG. 49 is an exploded perspective view illustrating the airflow regulator according to the tenth embodiment of the present disclosure.

Referring to FIGS. 48 and 49, the airflow regulator 86 according to the tenth embodiment may include a first duct 87*a* having the discharge unit 870 and a second duct 87*b* connected to the first duct 87*a*. The first duct 87*a* may rotate upon receiving driving force from the motor 89. The first duct 87*a* may be rotatable on the basis of the second duct 87*b*.

Each of the first duct 87*a* and the second duct 87*b* may have a tilted side surface. The height of one side of the first duct 87*a* may be slightly different from the height of the other side facing the one side. The first duct 87*a* may include a first side surface having the highest height W1 and a second side surface having the lowest height W2 at a position facing the first side surface.

Similarly, the height of one side of the second duct 87*b* may be slightly different from the height of the other side facing the one side. The second duct 87*b* may include a third side surface having the highest height W3 and a fourth side surface having the lowest height W4. That is, in an embodiment, the first duct 87*a* may have a side surface that is irregular in height and the second duct 87*b* may have a side surface that is irregular in height.

The driving force of the motor 89 may be transferred to the first duct 87*a* through the gear unit. The gear unit may include a drive gear 891 connected to the motor shaft 890 configured to rotate by the driving force of the motor 89, and an output gear 873 formed at the outer surface of the first duct 87*a*. The drive gear 891 may be meshed with the output gear 873. The driving force of the motor 89 may be applied to the output gear 873 through the drive gear 891, such that the first duct 87*a* can rotate clockwise or counterclockwise.

A holder 88 may be mounted to the first duct 87*a*. The first duct 87*a* may not contact the second duct 87*b* because of the holder 88. The first duct 87*a* may be hook-coupled to the holder 88. A coupling protrusion 871 may be formed in the first duct 87*a*, and the coupling hole 880 in which the coupling protrusion 871 formed in the first duct 87*a* can be inserted may be disposed at one side of the holder 88. Since the coupling protrusion 871 may be inserted into the coupling hole 880 and interfere with the coupling hole 880, the first duct 87*a* can be fixed to the holder 88.

The second duct 87*b* may be slidably disposed at the other side of the holder 88. Since the second duct 87*b* is not fixed to the holder 88, although the first duct 87*a* rotates by the driving force of the motor 89, the driving force of the motor 89 is not applied to the second duct 87*b*.

Although the first duct 87*a* and the holder 88 simultaneously rotate, the second duct 87*b* does not rotate and may slide at the other side of the holder 88. For example, if the third side surface having the highest height from among side surfaces of the second duct 87*b* is located at an upper portion and the fourth side surface having the lowest height is located at a lower portion, the third side surface and the fourth side surface of the second duct 87*b* may remain unchanged in position, irrespective of rotation of the first duct 87*a*.

Figure 50:
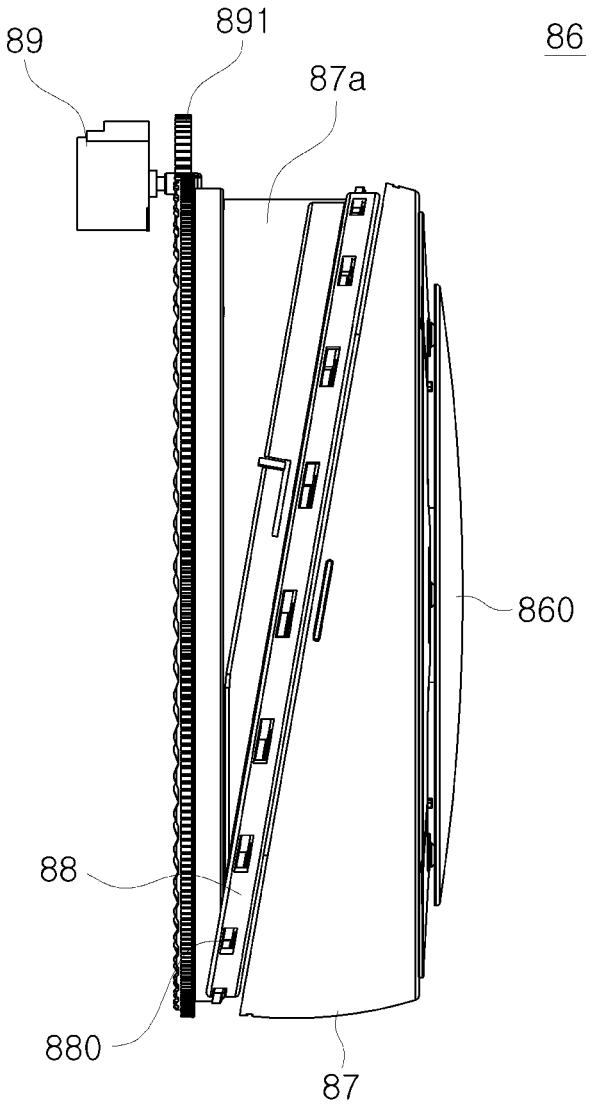
FIGS. 50 and 51 illustrate the operation states of the airflow regulator according to the tenth embodiment of the present disclosure.
Figure 51:
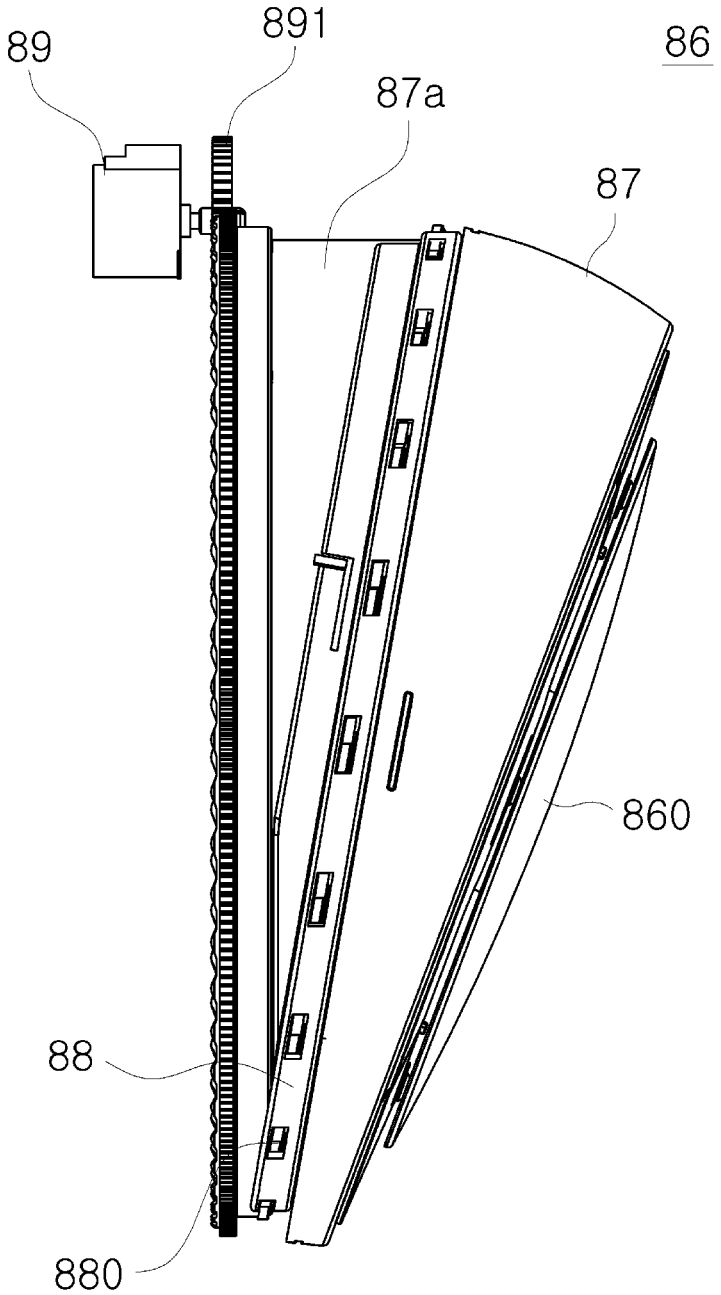

FIGS. 50 and 51 illustrate the operation states of the airflow regulator according to the tenth embodiment of the present disclosure.

Referring to FIGS. 50 and 51, the airflow regulator 86 according to the tenth embodiment may allow the first duct 87*a* to rotate clockwise or counterclockwise upon receiving driving force from the motor 89, such that the direction of the airflow can be changed. The case in which a third side surface having the highest height from among the sides of the second duct 87*b* is located at an upper part and a fourth side surface having the lowest height from among the sides of the second duct 87*b* is located at a lower part will hereinafter be described in detail.

If the first duct 87*a* rotates upon receiving the driving force from the motor 89, not only the position of the first side surface having the highest height from among the sides of the first duct 87*a*, but also the position of the second side surface having the lowest height may be changed. By rotation of the first duct 87*a*, the direction of a flow passage of the second duct 87*b* may be changed by the tilted side surface.

For example, if the first duct 87*a* continuously rotates under the situation of FIG. 48, the flow passage direction of the second duct 87*b* may be changed in the order of forward direction→upper front direction→right front direction→lower front direction→left front direction→forward direction. If the first duct 87*a* rotates counterclockwise under the situation of FIG. 48, the flow passage direction of the first duct 87*a* may be changed in the order of forward direction→left front direction→lower front direction→right front direction→forward direction.

If the first side surface of the first duct 87*a* is located at the rear of the third side surface having the highest height from among a plurality of tilted sides of the second duct 87*b*, the second duct 87*b* may be directed in a lower front direction. The air discharged through the discharge unit 870 may be directed in a lower front direction by the second duct 87*b*. If the second side surface of the first duct 87*a* is located at the rear of the fourth side surface having the lowest height from among a plurality of tilted sides of the second duct 87*b*, the second duct 87*b* may be directed in a forward direction. The air discharged through the discharge unit 870 may be directed in a forward direction by the second duct 87*b*.

Figure 52:
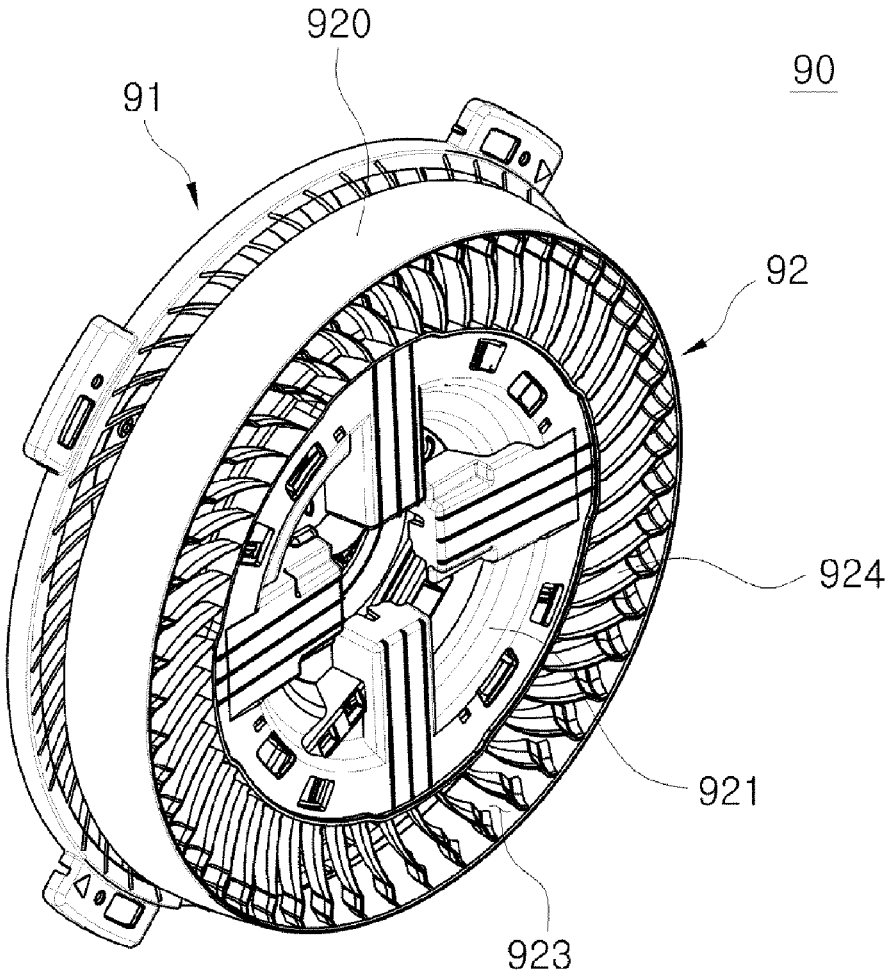
FIG. 52 is a perspective view illustrating an airflow regulator according to an eleventh embodiment of the present disclosure.
Figure 53:
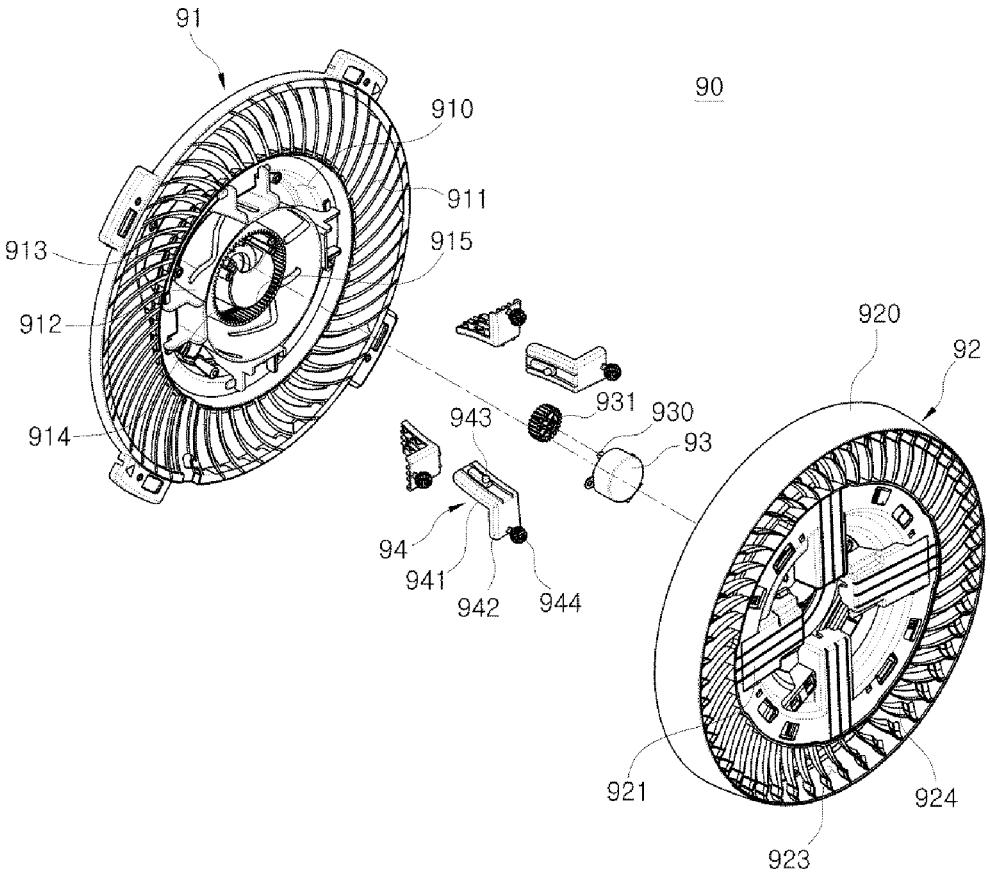
FIG. 53 is an exploded perspective view illustrating the airflow regulator according to the eleventh embodiment of the present disclosure.

FIG. 52 is a perspective view illustrating an airflow regulator according to an eleventh embodiment of the present disclosure. FIG. 53 is an exploded perspective view illustrating the airflow regulator according to the eleventh embodiment of the present disclosure.

Referring to FIGS. 52 and 53, the airflow regulator 90 according to the eleventh embodiment may be configured to change the airflow direction because the pressing member 94 coupled to the motor cover 91 exerts pressure on or pressurizes the diffuser assembly 92 so as to rotate the diffuser assembly 92.

The diffuser assembly 92 may include a grill 920 provided at the outside, and a center panel 924 provided at the inside of the grill 920. A plurality of blades 924 may be disposed between the grill 920 and the center panel 924 so that the blades 924 can direct the air discharged through the discharge unit 923.

The motor cover 91 may be disposed at the rear of the diffuser assembly 92. A case 914 in which the motor 93 is accommodated may be disposed at the center part of the motor cover 91. The output gear 915 may be located at the inner surface of the case 914.

The drive gear 931 is mounted to the motor shaft 830 contained in the motor 83, the drive gear 931 may be meshed with the output gear 915. If the driving power of the motor 83 is applied to the drive gear 831, the drive gear 931 is meshed with the output gear 915 formed at the inner surface of the case 914 so that the case 914 can be rotated.

A pressing member 94 may be disposed at the outside of the case 914. A plurality of pressing members 94 may be used, and the pressing members 94 may be spaced apart from each other by a predetermined distance so that the pressing members 94 may be located at the outside of the case 914. The pressing member 94 may include bodies (941, 942) formed in a curved shape. The bodies (941, 942) may include a first body 941 and a second body 942 curved from the first body 941. A guide protrusion 942 may protrude from one side of the first body 941, and a ball member 941 may be formed at one side of the second body 942.

A guide hole 913 curved by a predetermined angle may be formed at a side surface of the case 914. The guide protrusion 943 formed in the pressing member 94 may be inserted into the guide hole 913. If the case 914 rotates, the position of the guide protrusion 943 in the guide hole 913 may be changed.

Since the position of the guide protrusion 943 is changed, the pressing member 94 may move to the front or rear direction. Since the pressing member 94 moves to the front or rear direction, the diffuser assembly 92 located forward may be selectively pressurized by the ball member 944 of the pressing member 94. The air discharged through the discharge unit 923 of the diffuser assembly 92 may be directed in a specific direction according to the pressurization position of the diffuser assembly 92.

Figure 54:
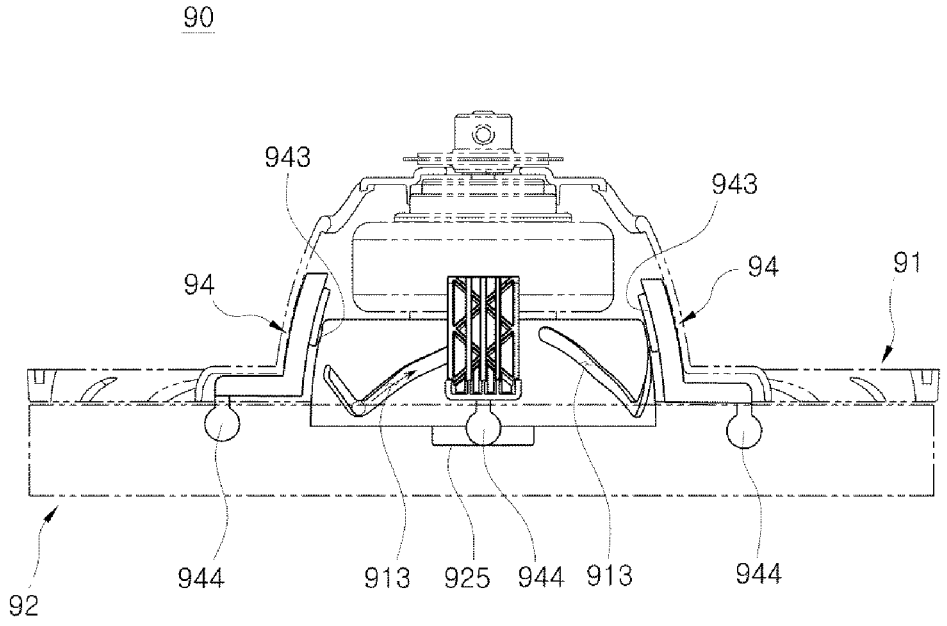
FIG. 54 is a side view illustrating the airflow regulator according to the eleventh embodiment of the present disclosure.
Figure 55:
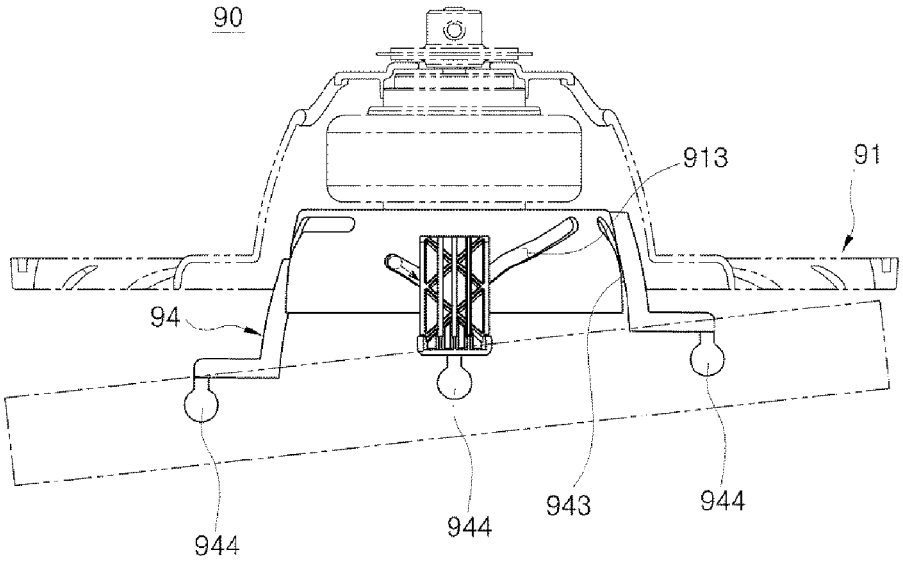
FIGS. 55 and 56 illustrate the operation states of the airflow regulator according to the eleventh embodiment of the present disclosure.
Figure 56:
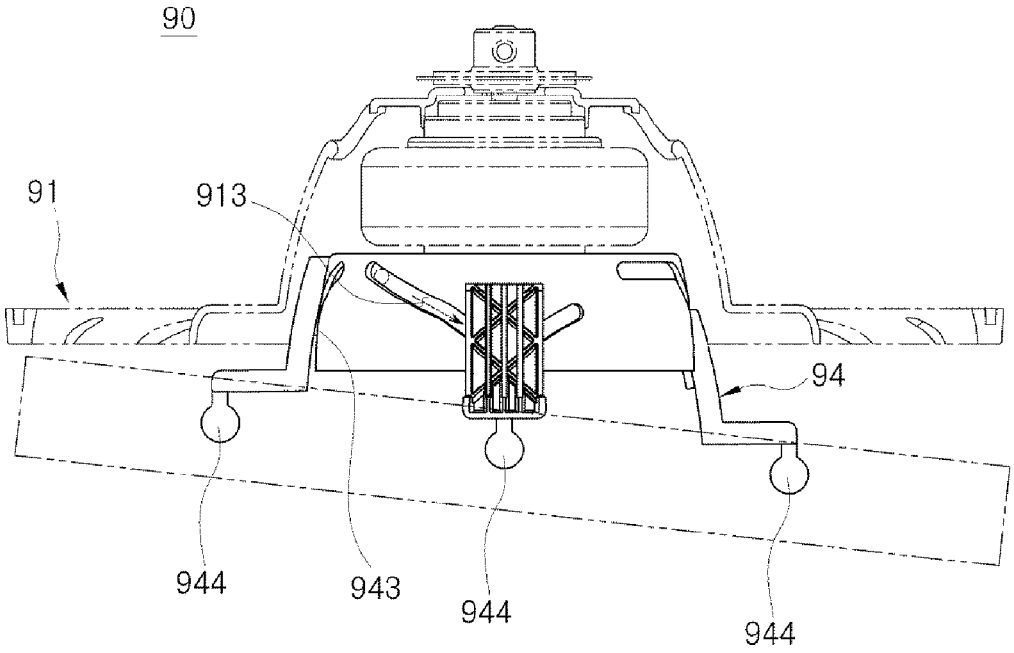

FIG. 54 is a side view illustrating the airflow regulator according to the eleventh embodiment of the present disclosure. FIGS. 55 and 56 illustrate the operation states of the airflow regulator according to the eleventh embodiment of the present disclosure.

Referring to FIGS. 54, 55, and 56, the guide protrusion 943 formed in the pressing member 94 according to the eleventh embodiment may be changed in position within the guide hole 913 formed at a side surface of the case 94 due to rotation of the case 94. The guide hole 913 may include a specific part elongated in the form of a diagonal line arranged in the forward and backward directions.

If the diffuser assembly 92 is pressurized by the left pressing member 94 by the shape of the guide hole 913, the diffuser assembly 92 may rotate in the right front direction as shown in FIG. 55. Therefore, the air discharged through the discharge unit 923 may be directed in the right front direction.

If the rear part of the diffuser assembly 92 is pressurized by the right pressing member 94, the diffuser assembly 92 may rotate in the left front direction as shown in FIG. 56. Therefore, the air discharged through the discharge unit 923 may be directed in the left front direction.

Although the above-mentioned embodiment has exemplarily disclosed that the diffuser assembly 92 is pressurized by the left pressing member 94 and the right pressing member 94 for convenience of description, the scope or spirit of the present disclosure is not limited thereto, and the air discharged through the discharge unit 923 can be directed in various ways according to the position of the pressing member 94 configured to pressurize the diffuser assembly 92.

As is apparent from the above description, the air conditioner according to the embodiments of the present disclosure can change the direction of airflow discharged through an outlet through an improved diffuser assembly structure, in various ways.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a fan assembly to blow air; and a diffuser assembly to direct movement of the air blown through the fan assembly, wherein the diffuser assembly comprises:

a center panel; and a blade unit including a grill disposed at an outside of the center panel and a plurality of blades disposed between the center panel and the grill to direct movement of the air blown from the fan assembly, wherein at least some parts of the blade unit are rotatably coupled to the center panel to change a direction of the air blown from the fan assembly according to a rotation of the at least some parts of the blade unit.

2. The air conditioner according to claim 1, wherein the blade unit comprises a first blade unit hinged to the center panel and a second blade unit fixed to the center panel.

3. The air conditioner according to claim 1, further comprising:

a cover coupled to a front of the center panel.

4. The air conditioner according to claim 3, wherein the cover comprises a guide plate in which a guide hole is formed.

5. The air conditioner according to claim 4, wherein the center panel comprises a guide protrusion inserted into the guide hole.

6. The air conditioner according to claim 4, wherein a rotation angle of the first blade is changed according to an elongated length of the guide hole.

7. The air conditioner according to claim 3, further comprising:

a support unit protruding forward of a first blade unit toward the cover.

8. The air conditioner according to claim 7, further comprising:

a pressing unit protruding from the cover toward the first blade unit.

9. The air conditioner according to claim 8, wherein:

if pressure is applied to the support unit by the pressing unit due to the guide plate sliding in a first direction, the first blade unit in which the support unit is formed rotates around a rotation shaft such that an airflow direction is directed in a second direction, different than the first direction.

10. The air conditioner according to claim 9, wherein:

the first blade unit is disposed at each of a left part and a right part of the center panel; and if the guide plate slides to a left, the airflow caused by the first blade unit is directed to the left.

* * * * *